US010023340B2

(12) United States Patent
Nagase et al.

(10) Patent No.: US 10,023,340 B2
(45) Date of Patent: Jul. 17, 2018

(54) PAPER SHEET PROCESSING DEVICE

(71) Applicant: GLORY LTD., Himeji-shi, Hyogo (JP)

(72) Inventors: Atsushi Nagase, Hyogo (JP); Toshihide Asada, Hyogo (JP); Yoshikatsu Mizushima, Hyogo (JP); Masao Okamura, Hyogo (JP)

(73) Assignee: GLORY LTD., Himeji-shi, Hyogo (JP)

( * ) Notice: Subject to any disclaimer, the term of this patent is extended or adjusted under 35 U.S.C. 154(b) by 0 days.

(21) Appl. No.: 15/125,206

(22) PCT Filed: Mar. 4, 2015

(86) PCT No.: PCT/JP2015/001150
§ 371 (c)(1),
(2) Date: Sep. 12, 2016

(87) PCT Pub. No.: WO2015/136890
PCT Pub. Date: Sep. 17, 2015

(65) Prior Publication Data

US 2017/0073100 A1 Mar. 16, 2017

(30) Foreign Application Priority Data

Mar. 11, 2014 (JP) ..... 2014-047518
Mar. 20, 2014 (JP) ..... 2014-057818

(51) Int. Cl.
*B65H 5/00* (2006.01)
*B65B 57/04* (2006.01)
(Continued)

(52) U.S. Cl.
CPC ..... *B65B 57/04* (2013.01); *B65B 13/06* (2013.01); *B65B 13/20* (2013.01); *B65B 13/32* (2013.01);
(Continued)

(58) Field of Classification Search
CPC ..... B65H 5/002; B65H 2701/1912; G07D 11/0066; G07D 7/004
See application file for complete search history.

(56) References Cited

U.S. PATENT DOCUMENTS 5,761,089 A * 6/1998 McInerny ..... G07D 7/04 194/206
8,851,472 B2 * 10/2014 Yamamoto ..... G07D 7/2016 271/265.01
(Continued)

FOREIGN PATENT DOCUMENTS

EP 2 860 709 A1 4/2015
JP 2003-346212 A 12/2003
(Continued)

*Primary Examiner* — Jeremy R Severson
(74) *Attorney, Agent, or Firm* — Renner, Kenner, Greive, Bobak, Taylor & Weber

(57) ABSTRACT

Disclosed herein is a paper sheet processing device 100 including: a hopper unit 2 configured to take in paper sheets; a recognition unit 3 configured to read serial numbers of the paper sheets taken in through the hopper unit 2; a database 1202 configured to store the serial numbers read by the recognition unit 3; and a control unit 120 configured to process the paper sheets. The control unit 120 searches the serial numbers stored in the database 1202 for any duplicated serial number, and detects, when finding any duplicated serial number, that duplicate processes have been performed on a paper sheet identified by the duplicated serial number.

16 Claims, 24 Drawing Sheets

(51) Int. Cl.

| | |
|---|---|
| ***G07D 7/004*** | (2016.01) |
| ***G07D 11/00*** | (2006.01) |
| ***B65B 13/06*** | (2006.01) |
| ***B65B 13/20*** | (2006.01) |
| ***B65B 13/32*** | (2006.01) |
| ***B65B 27/08*** | (2006.01) |

(52) U.S. Cl.
CPC ..... *B65B 27/08* (2013.01); *B65H 5/002* (2013.01); *G07D 7/004* (2013.01); *G07D 11/0066* (2013.01); *B65H 2701/1912* (2013.01)

(56) References Cited

U.S. PATENT DOCUMENTS

2015/0098642 A1* 4/2015 Jacomet ..... G07D 7/004
382/135
2015/0154473 A1* 6/2015 Shimakata ..... G07F 19/202
382/135

FOREIGN PATENT DOCUMENTS

| | | | |
|---|---|---|---|
| JP | 2012-27556 | A | 2/2012 |
| JP | 2013-114378 | A | 6/2013 |
| JP | 2013-164679 | A | 8/2013 |

* cited by examiner

FIG.23

RECOUNTING PROCESS

PUT BANKNOTES ON
HOPPER UNIT AND PRESS
START BUTTON

START CANCEL

FIG.24

ENTER SERIAL NUMBERS (1) 12345678

(2)

(3)

END

FIG.27

| | | |
|---|---|---|
| 1st TIME | SERIAL NUMBER 1 | SKEWED |
| | SERIAL NUMBER 2 | STACKER FULL |
| | SERIAL NUMBER 3 | FITNESS LEVEL DETERMINATION ERROR |
| 2nd TIME | SERIAL NUMBER 1 | SKEWED |
| | SERIAL NUMBER 2 | STACKER FULL |
| 3rd TIME | SERIAL NUMBER 1 | CHAINED |
| | SERIAL NUMBER 3 | SKEWED |
| 4th TIME | SERIAL NUMBER 1 | SKEWED |

PAPER SHEET PROCESSING DEVICE

TECHNICAL FIELD

The present disclosure relates to a paper sheet processing device.

BACKGROUND ART

Paper sheet processing devices that perform various types of processing on paper sheets have heretofore been known in the art. For example, a paper sheet processing device as disclosed in Patent Document 1 performs deposit processing and dispense processing on paper sheets. This paper sheet processing device reads the serial numbers of given paper sheets. If any transport error has occurred, the device identifies, by its serial number, the paper sheet that has caused the transport error, and accepts, when some paper sheets are taken into the device again, only the paper sheet identified by that serial number.

CITATION LIST

Patent Document

PATENT DOCUMENT 1: Japanese Unexamined Patent Publication No. 2012-27556

SUMMARY OF INVENTION

Technical Problem

If a paper sheet processing device has performed duplicate processes on the same paper sheet, that might lead to a miscalculation. For example, if the operator has allowed by mistake a paper sheet that has already been counted once during deposit processing to be counted again, then the deposit processing ends up with a wrong deposit amount. If any miscalculation has occurred, the miscalculation is normally detected at some time after its occurrence. However, when the miscalculation is detected, it is already troublesome or difficult to determine when, where and why the miscalculation occurred and how to deal with the miscalculation.

In view of the foregoing background, it is therefore an object of the present disclosure to detect such duplicate processes on the same paper sheet, if any, accurately and in an early stage.

Solution to the Problem

The present disclosure is directed to a paper sheet processing device. This paper sheet processing device includes: an intake unit configured to take in paper sheets; a recognition unit configured to read serial numbers of the paper sheets taken in through the intake unit; a memory configured to store the serial numbers read by the recognition unit; and a processing unit configured to process the paper sheets. The processing unit searches the serial numbers stored in the memory for any duplicated serial number, and detects, when finding any duplicated serial number, that duplicate processes have been performed on a paper sheet identified by the duplicated serial number.

According to this configuration, the paper sheets taken in through the intake unit have their serial numbers read by the recognition unit, and the serial numbers are stored in the memory. Then, the processing unit performs a predetermined type of processing on the paper sheets. In this case, the serial number is an identification number unique to each paper sheet. Thus, if any serial number is stored twice or more in the memory, it means that the same paper sheet has been taken in, recognized, and then processed more than once duplicately. Therefore, the processing unit detects, by the presence of such a duplicated serial number in the memory, that the same paper sheet has been processed more than once duplicately. Since this processing is carried out based on the serial number that is a unique identification number, the duplicate processes may be detected accurately. In addition, this paper sheet processing device also detects duplicate processes, and therefore, the duplicate processes may be detected in an early stage.

In one embodiment, when the processing unit detects any duplicate processes, the processing unit may notify a user of the duplicate processes detected.

According to such an embodiment, the user is notified of duplicate processes, and therefore, is allowed to deal with the duplicate processes quickly.

In another embodiment, the paper sheet processing device may further include a display unit configured to display information thereon. The processing unit may notify the user of the duplicate processes detected by displaying the duplicated serial number on the display unit.

According to this embodiment, the user may learn on what serial number the duplicate processes have been performed. Thus, the user is allowed to detect the cause of the duplicate processes and determine, by actually checking the paper sheet identified by the serial number in his or her hands, whether or not the duplicate processes have actually been performed.

In still another embodiment, the processing unit may prompt the user to choose an option to be exercised with respect to the duplicate processes.

According to such an embodiment, if any duplicate processes have been detected, the user is allowed to choose his or her desired option.

In this particular embodiment, the option to be exercised with respect to the duplicate processes may be either to allow one of the duplicate processes performed on the duplicated serial number and cancel the other of the duplicate processes or to allow all of the duplicate processes.

According to this embodiment, if any duplicate processes have been detected, the user may choose either to allow one of the duplicate processes and cancel the other or to ignore the detection of the duplicate processes. If the user picks up the former option, the duplication is removed such that only one of the duplicate processes remains. On the other hand, if the user picks up the latter option, the processes are allowed as they are even if there is a duplicated serial number. For example, if the recognition unit has read the serial number erroneously, then the same serial number may have been detected more than once, even though actually no duplicate processes have been performed. Alternatively, in a certain situation, the user may want to advance the processing with his or her decision on the action to take on the duplicate processes postponed. In that case, the latter option may be exercised.

In another embodiment, when the processing unit detects any duplicate processes, the processing unit may allow one of the duplicate processes performed on the duplicated serial number and cancel the other of the duplicate processes.

That is to say, according to this embodiment, if any duplicate processes have been detected, the action to take is not determined by the user but is selected automatically by the processing unit. Specifically, the processing unit allows one of the duplicate processes on the duplicated serial number and cancels the other. As a result, the duplication is removed such that only one of the duplicate processes remains.

In this particular embodiment, the paper sheet processing device may further include a display unit configured to display information thereon. If the processing unit has detected any duplicate processes, the processing unit may notify a user, via the display unit, of the duplicate processes detected.

Even if the processing unit automatically selects the action to take on the duplicate processes as described above, the user is still notified of the duplicate processes. The user does not have to take any particular action on the duplicate processes, but is informed of the duplicate processes anyway.

In yet another embodiment, the processing unit may search for any duplicated serial number when a predetermined operation has been performed.

That is to say, the processing unit searches for any duplicated serial number if the user has performed any operation.

In a specific embodiment, the predetermined operation may be allowing the process performed by the processing unit.

According to this embodiment, when the process performed is allowed, each and every serial number is checked at a time for any duplication. For example, every time a serial number is read by the recognition unit, the serial number could be checked for any duplication by searching the serial numbers stored in the memory for any matching serial number. In that case, however, the serial number matching needs to be performed every time a paper sheet is taken in, thus resulting in a long overall processing time. In contrast, if each and every serial number is checked for any duplication at a time after the process performed has been allowed, the overall processing time may be shortened.

In yet another embodiment, the process selected by the processing unit may be counting the number of paper sheets.

According to this embodiment, the duplicate processes mean counting the paper sheets more than once duplicately, which directly leads to a miscalculation. Thus, if the duplicate processes are detected, the miscalculation may be avoided through the correction to the number of paper sheets counted.

Advantages of the Invention

This paper sheet processing device may detect duplicate processes on the same paper sheet accurately and in an early stage.

BRIEF DESCRIPTION OF THE DRAWINGS

FIGS. 19A-19C illustrate how the respective members operate while the banknotes are transported into the large tape loop and the tape is wound around the banknotes as viewed in a thickness direction of the banknotes, wherein FIG. 19A illustrates a state where the banknotes transported are about to reach the large tape loop, FIG. 19B illustrates a state where the banknotes are transported into the large tape loop, and FIG. 19C illustrates a state where the tape is wound around the banknotes.

FIG. 23 illustrates an exemplary dialog box to be displayed during the recovery processing.

FIG. 24 illustrates another exemplary dialog box to be displayed during the recovery processing.

FIG. 27 illustrates an exemplary situation where some banknotes are rejected repeatedly.

DESCRIPTION OF EMBODIMENTS

Exemplary embodiments will now be described in detail with reference to the drawings.

First Embodiment

<General Configuration for Banknote Handling Apparatus>

Figure 1:
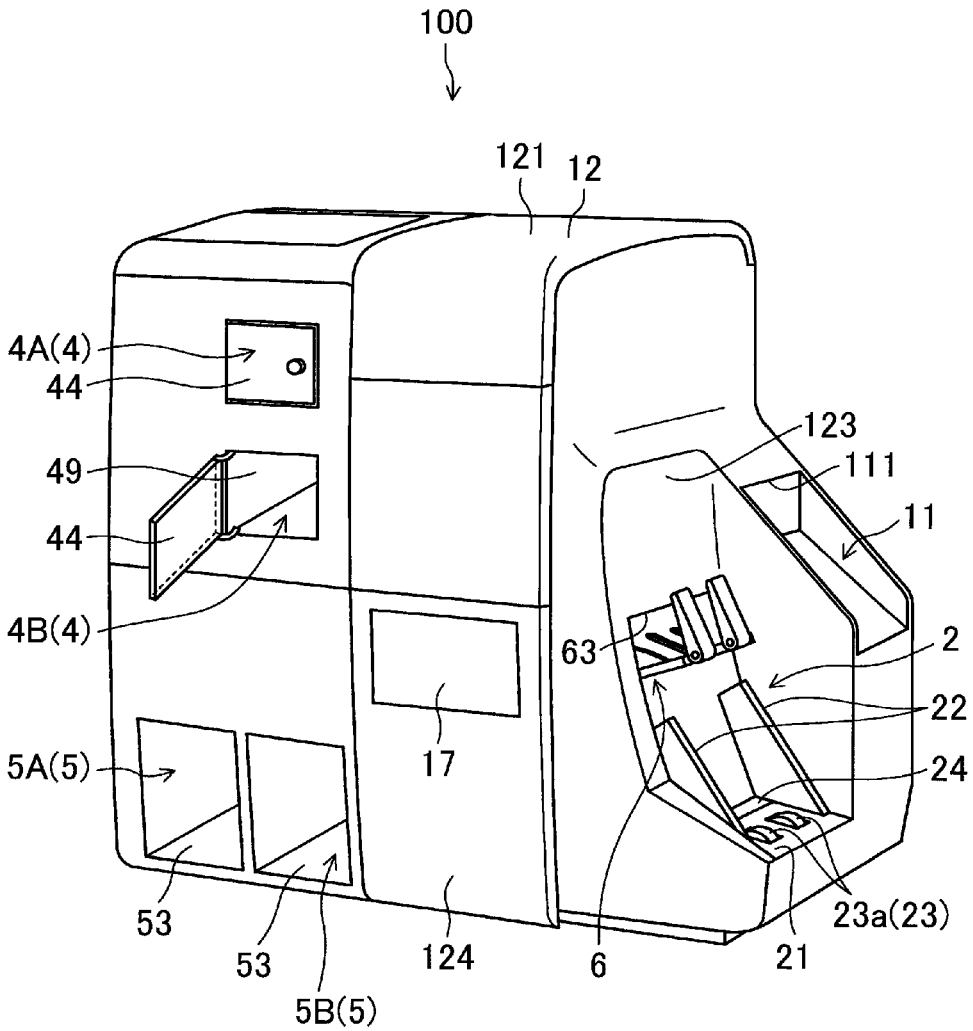
FIG. 1 is a view illustrating the appearance of a banknote handling apparatus according to a first embodiment.
Figure 2:
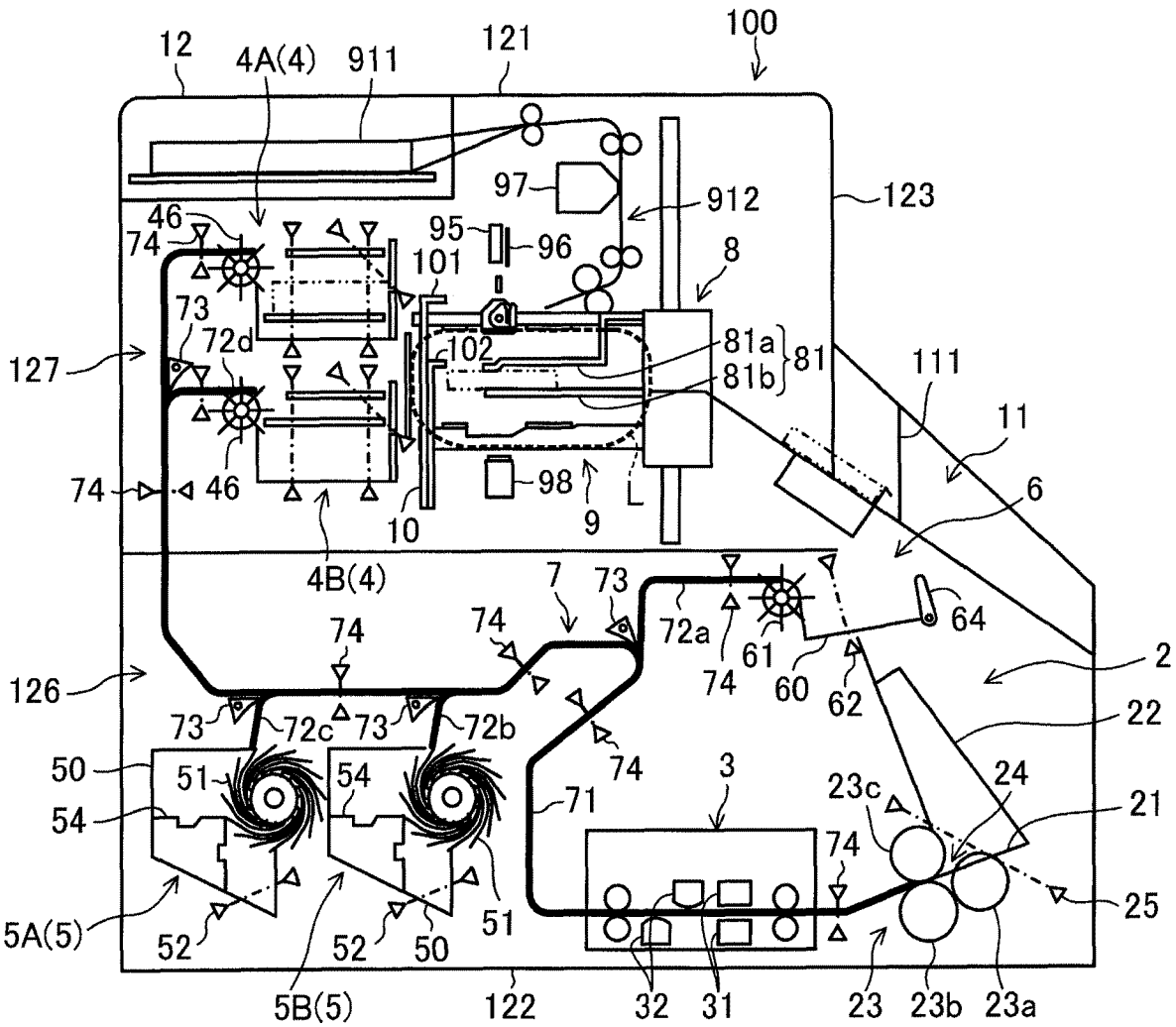
FIG. 2 illustrates a general configuration for the banknote handling apparatus.

FIG. 1 illustrates the appearance of a banknote handling apparatus 100, and FIG. 2 illustrates a general configuration for the banknote handling apparatus 100.

The banknote handling apparatus 100 is placed on a teller counter of a bank, for example, and is used by an operator. The banknote handling apparatus 100 takes loose banknotes therein, stacks the banknotes of a predetermined kind, bundles the banknotes in a predetermined bundling number, and dispenses the bundled banknotes. The banknote handling apparatus 100 is an exemplary paper sheet processing device, and banknotes are an example of paper sheets.

The banknote handling apparatus 100 includes a hopper unit 2 which takes the banknotes placed thereon into the apparatus, a recognition unit 3 which recognizes the banknotes, bundling stackers 4 which stack the banknotes to be bundled, non-bundling stackers 5 which stack the banknotes not to be bundled, a reject stacker 6 which stacks rejected banknotes, a first transport unit 7 which transports the banknotes taken in through the hopper unit 2 to the recognition unit 3, the bundling stackers 4, the non-bundling stackers 5, and the reject stacker 6, a second transport unit 8 which transports the banknotes stacked in the bundling stackers 4 to the predetermined position, a bundling unit 9 which bundles the banknotes transported by the second transport unit 8, a third transport unit 10 which transports the banknotes that have been bundled (hereinafter referred to as "bundled banknotes"), a dispense unit 11 through which the bundled banknotes are dispensed, and a box-shaped housing 12 which houses the recognition unit 3, the bundling stackers 4, the non-bundling stackers 5, the reject stacker 6, the first transport unit 7, the second transport unit 8, the bundling unit 9, and the third transport unit 10.

The housing 12 has a top surface 121, a bottom surface 122, and four side surfaces. The housing 12 is a desktop type housing. That is to say, the bottom surface 122 of the housing 12 is not provided with casters or any other similar parts, and thus the housing 12 is configured to be placed on the desk.

The hopper unit 2 and the dispense unit 11 are provided through a first side surface 123, which is one of the four side surfaces of the housing 12. First outlets 49 of the bundling stackers 4 and second outlets 53 of the non-bundling stackers 5, which will be described in detail later, are provided through a second side surface 124, which is another one of the four side surfaces. The first and second side surfaces 123 and 124 are adjacent to each other.

The space inside the housing 12 is divided into a first handling section 126 configured to perform various kinds of handling processing for recognizing and sorting the banknotes and a second handling section 127 configured to perform various kinds of handling processing for bundling the banknotes to be bundled. The second handling section 127 is provided above the first handling section 126. The first handling section 126 includes the hopper unit 2, the recognition unit 3, the non-bundling stackers 5, and the reject stacker 6. The second handling section 127 includes the bundling stackers 4, the second transport unit 8, the bundling unit 9, and the third transport unit 10. Most of the first transport unit 7 is included in the first handling section 126.

The bundling stackers 4 include two stackers, namely, a first bundling stacker 4A and a second bundling stacker 4B. Both of the first and second bundling stackers 4A and 4B stack the banknotes to be bundled. The banknotes stacked as those to be bundled are determined as appropriate. The banknotes to be bundled are banknotes of a predetermined kind. The predetermined kind is identified by denomination or the orientation of the banknotes, or by determining whether the banknotes are fit or unfit, whether the banknotes are facing up or down, or whether the banknotes are new or not, for example. In this example, the banknotes to be bundled are fit banknotes of a predetermined denomination (e.g., 100 Chinese Yuan). In the following description, the banknotes which are recognized as normal by the recognition unit 3 will be hereinafter referred to as "normal banknotes," the banknotes which are not recognized as normal by the recognition unit 3 will be hereinafter referred to as "abnormal banknotes," and the banknotes which are transported in an abnormal state, e.g., skewed or multi-fed, will be hereinafter referred to as "abnormally transported banknotes." For example, one of the conditions for determining whether the banknotes are normal or not is whether the serial numbers of the banknotes are distinguishable or not. However, the normality of the banknotes may be checked based on a different condition, or an additional condition may be applied to determine whether the banknotes are normal or not. The banknotes which are determined as the normal banknotes but the destination of which (the bundling stacker, the non-bundling stacker, or other stackers) is not designated will be hereinafter referred to as "undesignated banknotes." Among the normal banknotes, those which are not stained or torn significantly will be hereinafter referred to as "fit banknotes," and those which are stained or torn significantly will be hereinafter referred to as "unfit banknotes." The bundling stacker 4 is an exemplary stacking unit.

The first and second bundling stackers 4A and 4B are arranged substantially vertically, i.e., one on top of the other, in the second handling section 127. The first bundling stacker 4A is positioned over the second bundling stacker 4B. The first and second bundling stackers 4A and 4B have identical configurations. When it is not necessary to distinguish the two stackers from each other, they will be hereinafter referred to as "bundling stackers 4." A detailed configuration of the bundling stackers 4 will be described later.

The non-bundling stackers 5 include two stackers, namely, a first non-bundling stacker 5A and a second non-bundling stacker 5B. The first and second non-bundling stackers 5A and 5B are arranged substantially horizontally, i.e., side by side, in the first handling section 126. The second non-bundling stacker 5B is arranged closer to the hopper unit 2 than the first non-bundling stacker 5A is. When it is not necessary to distinguish the two stackers from each other, they will be hereinafter referred to as "non-bundling stackers 5." A detailed configuration of the non-bundling stackers 5 will be described later. The banknotes to be stacked in the non-bundling stackers 5 may be determined as appropriate. Here, the first non-bundling stacker 5A stacks unfit banknotes of the predetermined denomination. The second non-bundling stacker 5B stacks banknotes of every denomination but the predetermined denomination.

The reject stacker 6 stacks the rejected banknotes. The reject stacker 6 is positioned closer to the hopper unit 2 than the first and second non-bundling stackers 5A and 5B are. The reject stacker 6 is positioned at a level slightly higher than the first and second non-bundling stackers 5A and 5B. A detailed configuration of the reject stacker 6 will be described later. The banknotes to be stacked in the reject stacker 6 may be determined as appropriate. Here, the reject stacker 6 stacks "undesignated banknotes," "abnormal banknotes," and "abnormally transported banknotes" as the rejected banknotes.

The hopper unit 2 is provided for a portion of the first side surface 123 corresponding to the first handling section 126, and the dispense unit 11 is provided in a portion of the first side surface 123 corresponding to the second handling section 127.

The hopper unit 2 includes a mount 21 on which banknotes are placed, two guides 22 which guide the banknotes placed on the mount 21, intake rollers 23, an inlet 24 through which the banknotes are taken in, and a banknote sensor 25 which detects the banknotes on the mount 21. In the present embodiment, the banknotes are placed on the hopper unit 2 such that the banknotes are taken in a direction parallel to their shorter edges.

As shown in FIG. 1, the inlet 24 is arranged at a corner where the mount 21 and the first side surface 123 intersect with each other. The mount 21 is tilted such that the closer to the inlet 24, the lower the level of the mount 21. Thus, the banknotes on the mount 21 go toward the inlet 24 by themselves. The banknotes placed on the mount 21 are taken into the housing 12 through the inlet 24.

The banknote sensor 25 is provided near the inlet 24. The banknote sensor 25 includes a transmitter which emits light and a receiver which receives the light, and detects the banknotes when the light emitted from the transmitter toward the receiver is blocked. First and second banknote sensors 47 and 48, stacking sensors 52 and 62, tracking sensors 74, and first and second tape sensors 9210 and 9211 to be described later are also configured in the same manner. The banknote sensor 25 is arranged such that the light is blocked by the banknotes placed on the mount 21. That is to say, the banknote sensor 25 can detect that the banknotes are placed on the mount 21 when the light is blocked.

The guides 22 are configured such that the interval between them is adjustable. Specifically, the interval between the guides 22 is adjusted according to the banknotes placed on the mount 21.

The intake rollers 23 include kicker rollers 23*a*, feed rollers 23*b*, and gate rollers 23*c*. The kicker rollers 23*a* are partially exposed from the mount 21, and are in contact with the lowermost one of the banknotes placed on the mount 21. The kicker rollers 23*a* feed the lowermost one of the banknotes on the mount 21 to the inlet 24. Thus, the banknotes are taken in through the inlet 24 one by one. The banknotes taken in through the inlet 24 are distributed one by one by the feed rollers 23*b* and the gate rollers 23*c* into the housing 12. The banknotes thus taken in are passed to the first transport unit 7.

The dispense unit 11 includes a dispense port 111 through which the bundled banknotes are dispensed. In the dispense unit 11, the bundled banknotes are dispensed through the dispense port 111 in the direction parallel to their shorter edges.

The first transport unit 7 may be configured as a transport belt or any other suitable member. The first transport unit 7 includes a main transport path 71, first to fourth diverged paths 72*a* to 72*d* diverged from the main transport path 71, sorting mechanisms 73 provided at junctions between the main transport path 71 and the diverged paths, and a plurality of tracking sensors 74 which detect the passage of the banknotes. The first transport unit 7 transports the banknotes in the direction parallel to their shorter edges. The first transport unit 7 is an exemplary transport unit.

The main transport path 71 extends from the intake rollers 23 through the first bundling stacker 4A. The first diverged path 72*a* is the most upstream path in the main transport path 71, and the second, third, and fourth diverged paths 72*b*, 72*c* and 72*d* are arranged in this order downstream of the first diverged path 72*a*. When it is not necessary to distinguish the first to fourth diverged paths 72*a* to 72*d* from each other, they will be hereinafter referred to as "diverged paths 72." The first diverged path 72*a* extends to reach the reject stacker 6. The second diverged path 72*b* extends to reach the second non-bundling stacker 5B. The third diverged path 72*c* extends to reach the first non-bundling stacker 5A. The fourth diverged path 72*d* extends to reach the second bundling stacker 4B.

The sorting mechanisms 73 are driven by a solenoid (not shown). Each of the sorting mechanisms 73 sorts the banknotes transported through the main transport path 71 depending on whether they need to be diverged to an associated one of the diverged paths 72 or not. A tracking sensor 74 is provided upstream of each of the sorting mechanisms 73. The tracking sensors 74 are configured in the same manner as the banknote sensor 25. That is, the tracking sensors 74 can detect the passage of the banknotes if the reception of light by the receiver of the tracking sensor 74 is temporarily interrupted and then resumed. In guiding the banknotes to the diverged path 72, each sorting mechanism 73 is turned ON as soon as the tracking sensor 74 immediately upstream thereof detects the passage of the banknotes.

The recognition unit 3 is provided on the main transport path 71 upstream of the first diverged path 72*a*. The recognition unit 3 is configured to recognize each of the banknotes being transported in terms of their denomination, authenticity, and fitness. Specifically, the recognition unit 3 includes a line sensor 31 and a magnetic sensor 32, and detects the feature of each banknote. The recognition unit 3 determines whether the feature of the banknote thus detected corresponds with any of the features of the banknotes stored, thereby making a determination about their denomination, authenticity, and fitness.

The recognition unit 3 does not always include the line sensor and the magnetic sensor, but may include any other suitable sensor such as an infrared sensor or an ultraviolet sensor as long as they can detect the features of the banknotes. The line sensor 31 also has the function of optically reading the serial numbers printed on the banknotes. Note that a control unit 120 to be described later may have all of the functions of the recognition unit 3 but the detecting function.

The bundling unit 9 bundles the stacked banknotes. As will be described in detail later, the bundling unit 9 forms a tape loop L from a tape, and rewinds the tape after the banknotes have been transported into the tape loop L so that the banknotes are bundled with the tape.

The second transport unit 8 grips the banknotes stacked in the bundling stacker 4 to transport the banknotes into the tape loop L. The second transport unit 8 includes a gripper 81 which grips the banknotes, a first horizontal displacement mechanism which displaces the gripper 81 in the horizontal direction parallel to the shorter edges of the banknotes (this direction will be hereinafter referred to as a "first horizontal direction"), a second horizontal displacement mechanism which displaces the gripper 81 in the horizontal direction parallel to the longer edges of the banknotes (hereinafter referred to as a "second horizontal direction"), and a vertical displacement mechanism which displaces the gripper 81 in the vertical direction. The second transport unit 8 is an exemplary paper sheet transport unit.

The gripper 81 includes an upper arm 81*a*, a lower arm 81*b* facing the upper arm 81*a*, and a gripping mechanism which displaces the upper arm 81*a* in the vertical direction. The upper arm 81*a* includes three fingers extending parallel to each other and a coupling portion which couples the three fingers together. Likewise, the lower arm 81*b* also has three fingers extending parallel to each other and a coupling portion which couples the three fingers together. The gripping mechanism supports the upper arm 81*a* so that the upper arm 81*a* is movable in the vertical direction, and moves the upper arm 81*a* in the vertical direction using a motor and a drive belt. This configuration allows the upper and lower arms 81*a* and 81*b* to grip the banknotes.

The first horizontal displacement mechanism supports the gripper 81 so that the gripper 81 is movable in the first horizontal direction, and displaces the gripper 81 in the first horizontal direction using the motor and the drive belt.

The vertical displacement mechanism supports the first horizontal displacement mechanism so that the first horizontal displacement mechanism is movable in the vertical direction, and displaces the first horizontal displacement mechanism in the vertical direction using the motor and the drive belt.

The second horizontal displacement mechanism supports the vertical displacement mechanism so that the vertical displacement mechanism is movable in the second horizontal direction, and displaces the vertical displacement mechanism in the second horizontal direction using the motor and the drive belt.

Thus, the gripper 81 is configured to be readily moved along three orthogonal axes by the first and second horizontal displacement mechanisms and the vertical displacement mechanism.

The third transport unit 10 transports the bundled banknotes to the dispense unit 11. The third transport unit 10 includes an upper gripping part 101, a lower gripping part 102, and a horizontal displacement mechanism which displaces the upper and lower gripping parts 101 and 102 in the first horizontal direction. In displacing the upper gripping part 101 in the first horizontal direction, the horizontal displacement mechanism displaces the upper gripping part 101 in the vertical direction, too. That is, the third transport unit 10 is configured to pass beside the bundling unit 9 in the first horizontal direction. When the third transport unit 10 is positioned opposite to the dispense unit 11 relative to the bundling unit 9, the upper gripping part 101 is positioned over, and sufficiently distant from, the lower gripping part 102. The upper gripping part 101 moves downward from this position as it approaches the bundled banknotes in the bundling unit 9. Then, when the upper gripping part 101 reaches the bundled banknotes, the bundled banknotes are gripped by the upper and lower gripping parts 101 and 102. The upper and lower gripping parts 101 and 102 transport the bundled banknotes to the vicinity of the dispense unit 11 while gripping them. In the vicinity of the dispense unit 11, the upper gripping part 101 moves upward as it approaches the dispense unit 11. As a result, the bundled banknotes gripped by the upper and lower gripping parts 101 and 102 are released from the upper and lower gripping parts 101 and 102 at the dispense unit 11, and are dispensed to the dispense unit 11.

On the second side surface 124 of the housing 12, as shown in FIG. 1, a touch panel 17 is provided to serve as an operating unit through which information is entered into the banknote handling apparatus 100 and as a display unit which displays information about the banknote handling apparatus 100. The touch panel 17 is a human interface for the operator who operates this banknote handling apparatus 100.

<Configuration of Bundling Stacker 4>

Figure 3:
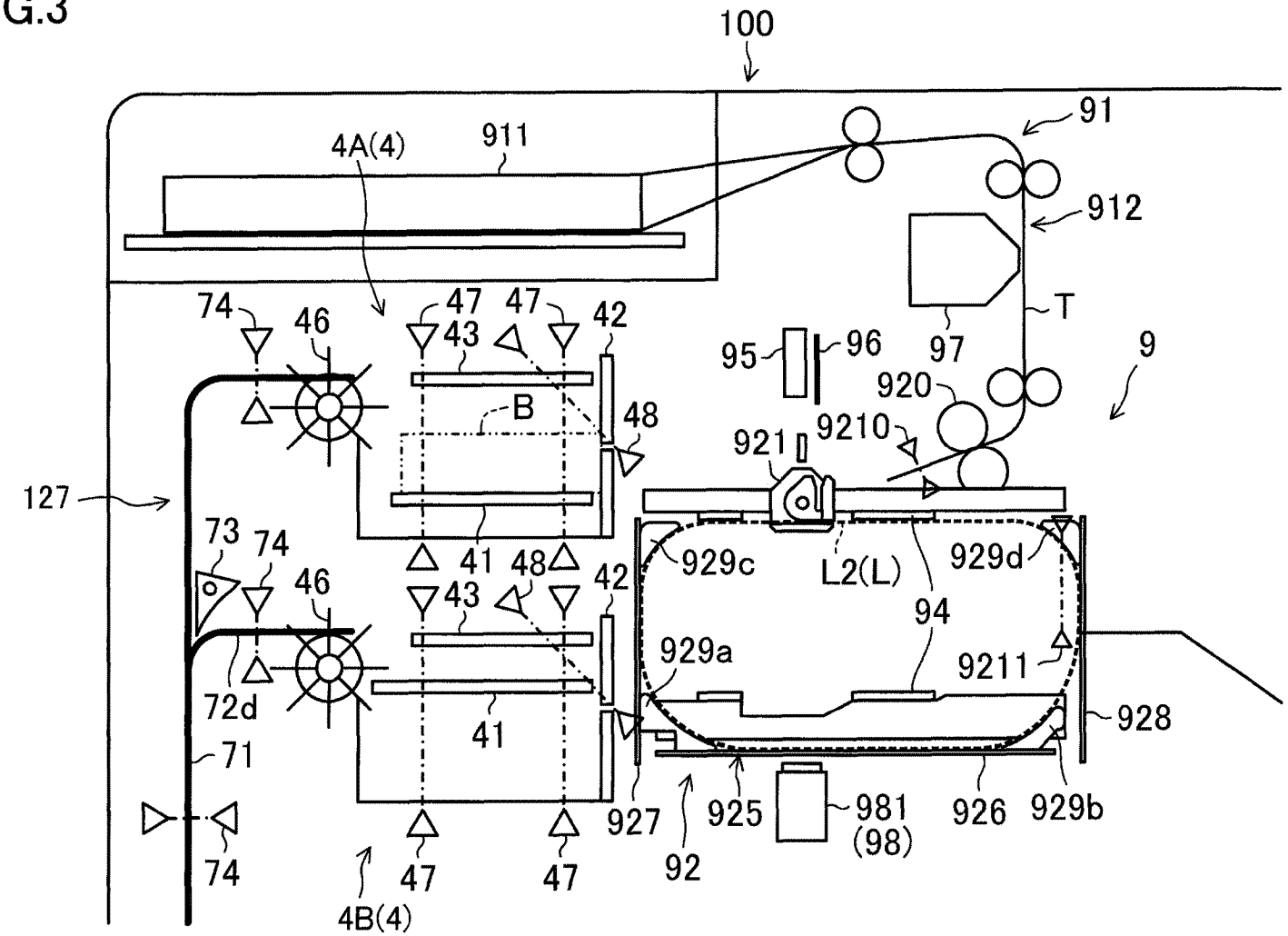
FIG. 3 illustrates a general configuration for bundling stackers and a bundling unit.

FIG. 3 illustrates a general configuration for the bundling stackers 4 and the bundling unit 9.

The bundling stackers 4 pile and stack the banknotes B that have been transported through the first transport unit 7. The banknotes B are transported in the direction parallel to their shorter edges with one of their longer sides facing front before entering the bundling stackers 4. As shown in FIG. 3, each of the bundling stackers 4 includes a stage 41 which carries the banknotes B thereon, a guide 42 which aligns the respective longer sides of the banknotes B at the frontend in their transport direction, a top plate 43 which defines a ceiling of the bundling stacker 4, a door 44 (see FIG. 1) which opens/closes the first outlet 49 to be described later, an alignment mechanism 45 (see FIG. 6) which aligns the respective edges of the banknotes stacked, a stacking wheel 46 which brings the transported banknotes B into the bundling stacker 4, a first banknote sensor 47 which detects the banknotes B in the bundling stacker 4, and a second banknote sensor 48 which detects the banknotes B of a predetermined height in the bundling stacker 4. Detailed configurations of the stage 41, guide 42, door 44, and alignment mechanism 45 will be described later.

The stacking wheel 46 includes a plurality of flexible blades, and has the function of tapping the banknotes B transported into the bundling stacker 4 on their rear edges in the transport direction so as to help the banknotes B fall. Even when the banknotes B are brought into the bundling stacker 4 successively, each of the banknotes B is prevented from being inserted below the rear edge of the preceding banknote B, and thus the banknotes B can be sequentially stacked one by one on top of the previously stacked ones.

Two or more first banknote sensors 47 are provided for each of the bundling stackers 4. In the present embodiment, two first banknote sensors 47 are provided in the bundling stacker 4 at different positions in the transport direction of the banknotes B. The first banknote sensor 47 is configured in the same manner as the banknote sensor 25. Each of the first banknote sensors 47 is arranged to project light in the stacking direction of the banknotes B in the bundling stacker 4. That is to say, the first banknote sensor 47 can detect the presence of the banknotes B in the bundling stacker 4 when the light is blocked. The provision of the two first banknote sensors 47 at the different positions in the transport direction enables any one of the first banknote sensors 47 to detect the presence of the banknotes B even when the positions of the banknotes B vary in the transport direction in the bundling stacker 4. Note that two or more first banknote sensors 47 may be provided at different positions in the direction orthogonal to both of the transport and thickness directions of the banknotes B (the direction coming out of the paper of FIG. 2).

The second banknote sensor 48 is configured to detect the banknotes B located at a predetermined height in the bundling stacker 4. The second banknote sensor 48 is configured in the same manner as the banknote sensor 25. The second banknote sensor 48 is arranged such that light emitted from the transmitter to the receiver is blocked by the banknotes B when the banknotes B are present at a level higher than the predetermined height, and that the light emitted from the transmitter reaches the receiver when the banknotes B are not present at the level higher than the predetermined height.

Figure 4:
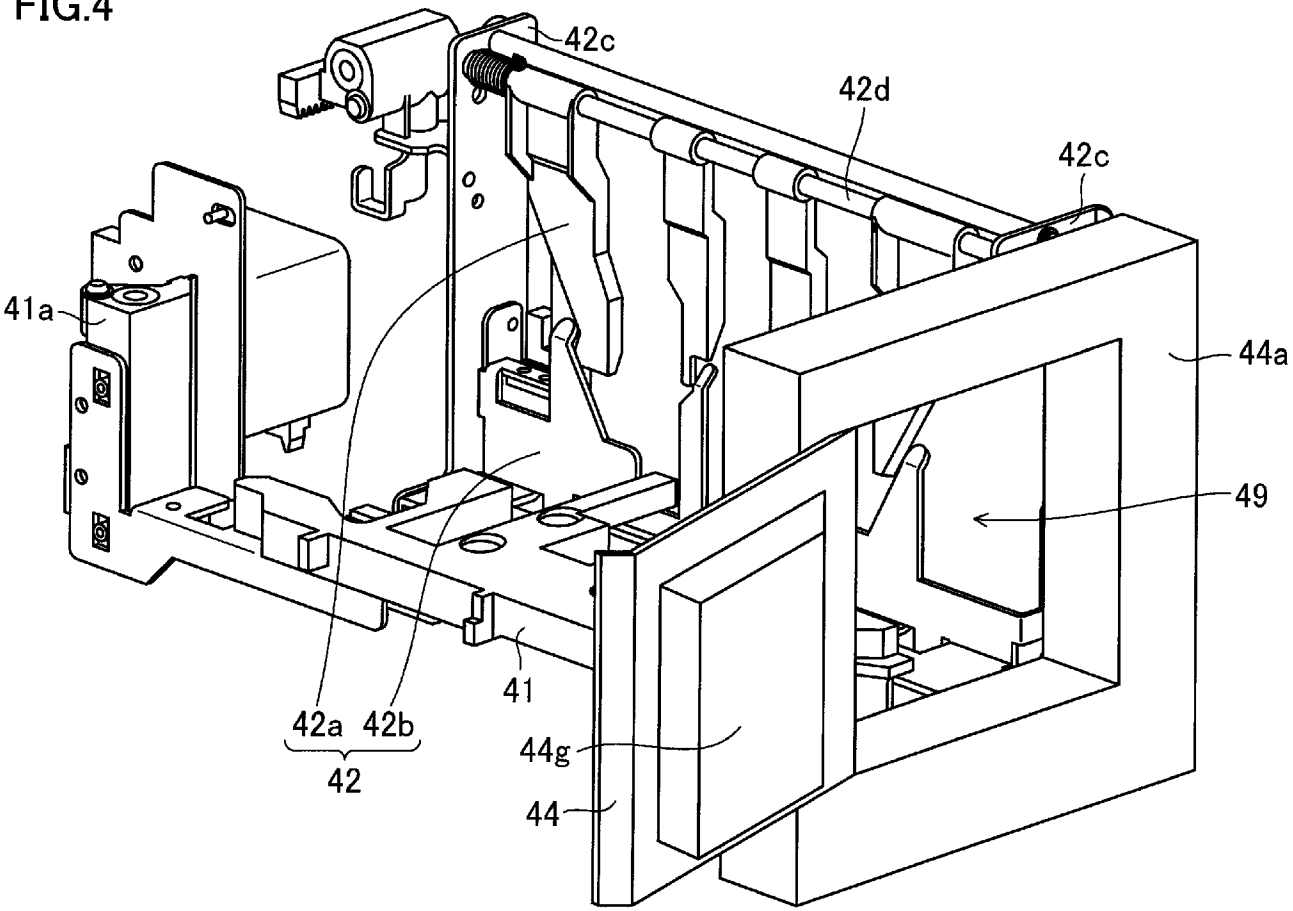
FIG. 4 is a perspective view illustrating a principal section of the bundling stackers.
Figure 5:
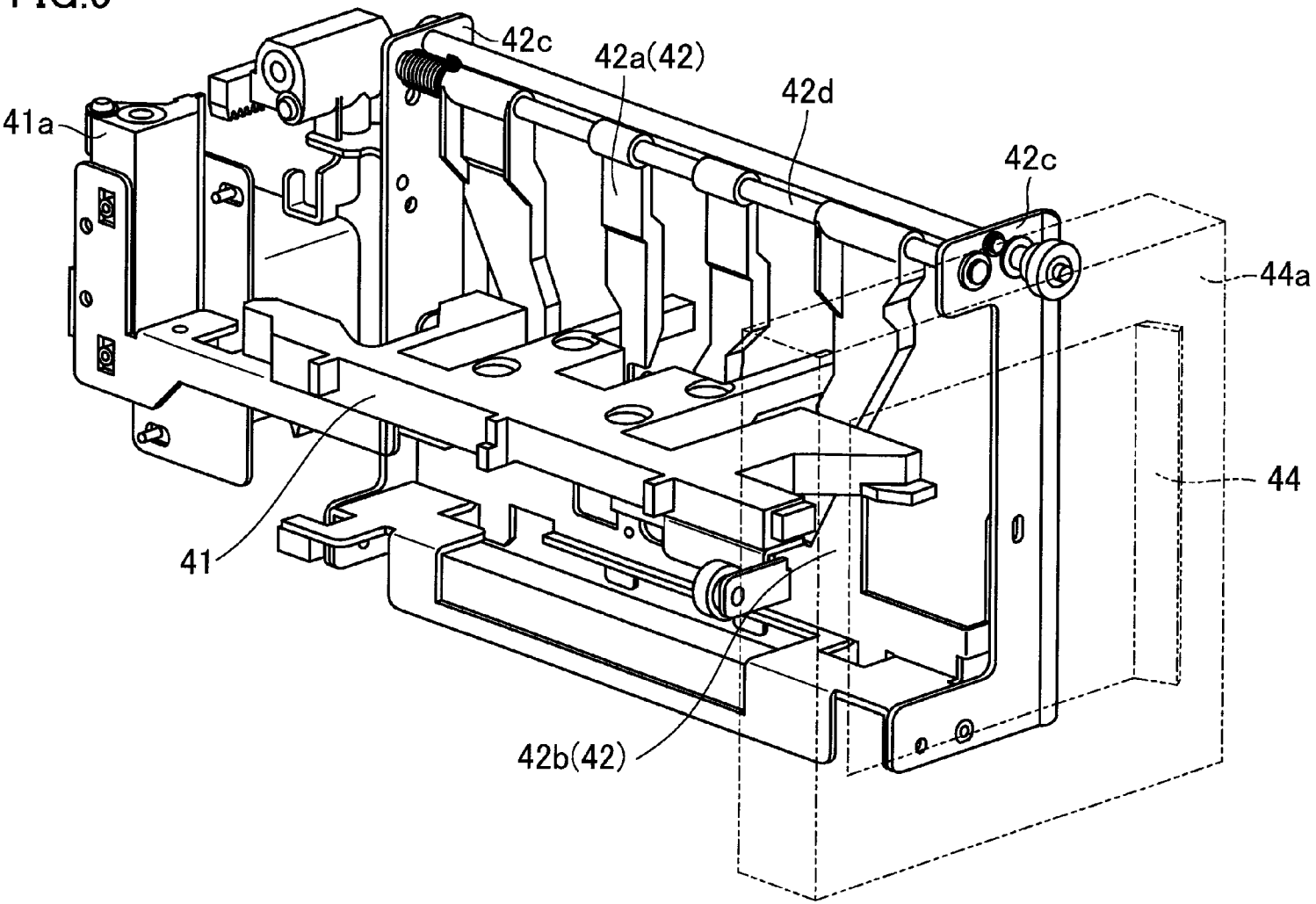
FIG. 5 is a perspective view corresponding to FIG. 4 and illustrating a state where the stage and guide of the bundling stacker have moved.
Figure 6:
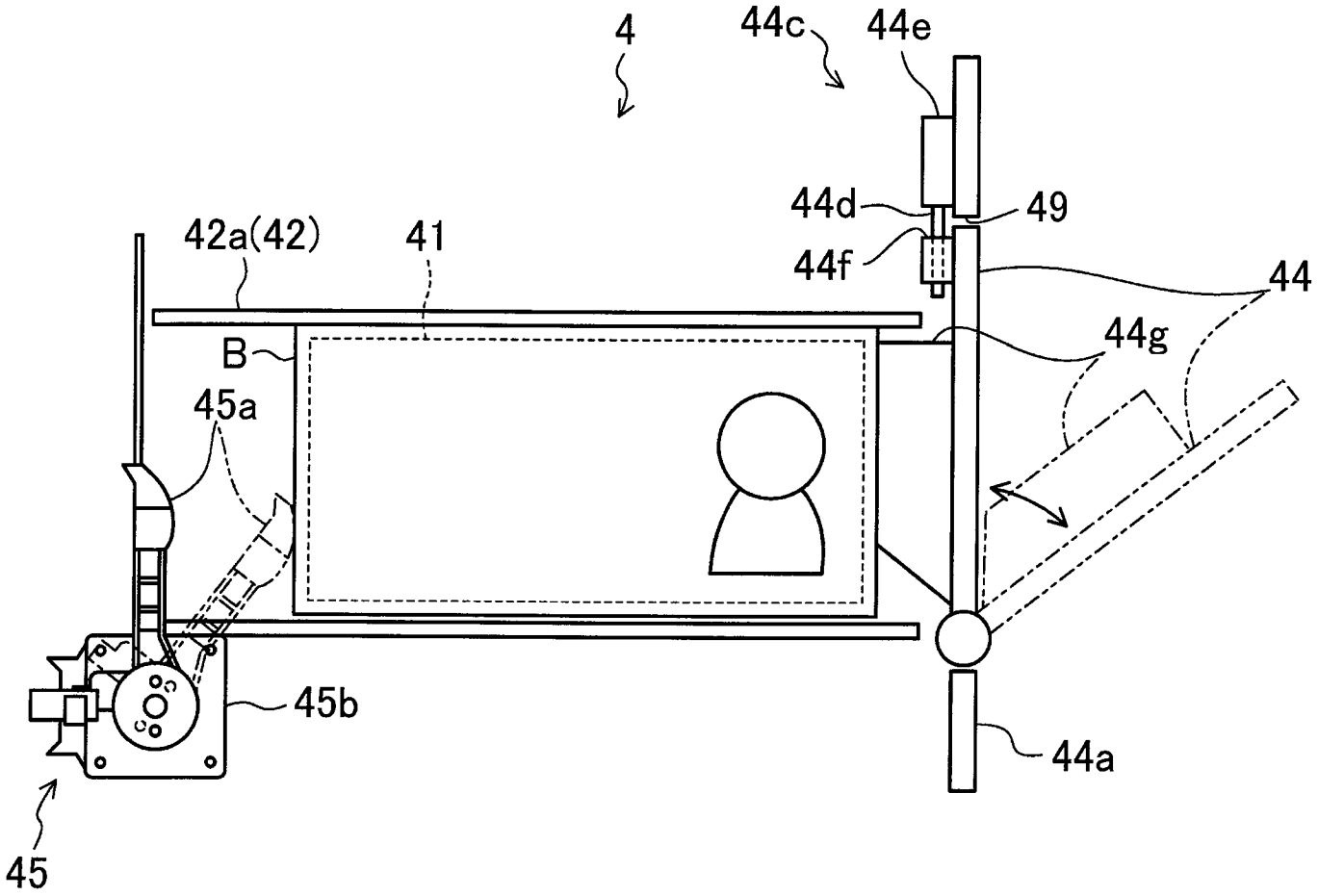
FIG. 6 is a plan view illustrating generally the bundling stacker with a portion thereof omitted.

FIG. 4 is a perspective view illustrating a principal section of the bundling stacker 4. FIG. 5 is a perspective view corresponding to FIG. 4 and illustrating a state where the stage 41 and guide 42 of the bundling stacker 4 have moved. FIG. 6 is a plan view illustrating generally the bundling stacker 4 with a portion thereof omitted. In FIG. 5, the door 44 and the frame 44*a* are indicated by phantom lines.

The stage 41 is configured to be movable up and down. Specifically, the stage 41 is coupled to a vertical mover 41*a*, which is secured to a vertically extending shaft (not shown)

so as to be movable up and down, and which is driven vertically by a motor (not shown). The stage 41 has a comb-tooth shape.

The guide 42 is configured to be movable in the transport direction of the banknotes B. Specifically, the guide 42 is comprised of an upper guide 42*a* and a lower guide 42*b*. The upper guide 42*a* is mounted to a rotatable shaft 42*a* provided for a pair of frames 42*c* which moves in the transport direction of the banknotes B. The pair of frames 42*c* is movably mounted to a horizontal shaft (not shown) extending in the transport direction, and is driven by a motor (not shown) along the horizontal shaft. The rotatable shaft 42*d* is supported rotatably by the pair of frames 42*c*. The rotatable shaft 42*d* is driven in rotation by the motor (not shown). The upper guide 42*a* rotates along with the rotatable shaft 42*d*. On the other hand, the lower guide 42*b* is fixed on the pair of frames 42*c*. The lower guide 42*b* is provided under the upper guide 42*a*. The upper guide 42*a* is formed to have a shape with four comb teeth. Likewise, the lower guide 42*b* is also formed to have such a shape with four comb teeth.

With the upper guide 42*a* hanging down from the rotatable shaft 42*d*, the upper guide 42*a* and the lower guide 42*b* form a wall at the frontend of the transport direction for the bundling stacker 4. In this case, the respective comb teeth of the upper and lower guides 42*a* and 42*b* define three slits extending vertically. Two outer ones of these three slits are arranged at such positions as to allow two comb teeth of the stage 41 to enter the slits. As described above, as the frames 42*c* move, the upper and lower guides 42*a* and 42*b* move back and forth in the transport direction of the banknotes B. In the meantime, the comb teeth of the stage 41 enter the slits formed by the respective comb teeth of the upper and lower guides 42*a* and 42*b*, thereby substantially preventing the stage 41 from interfering with the upper and lower guides 42*a* and 42*b*. In addition, since the slits extend vertically, the interference between the comb teeth of the stage 41 and the upper and lower guides 42*a* and 42*b* is also avoidable even if the stage 41 moves vertically.

Meanwhile, as the rotatable shaft 42*d* rotates, the upper guide 42*a* turns so as to open forward in the transport direction, thereby opening the bundling stacker 4 forward in the transport direction.

At one end of the bundling stacker 4 in the direction perpendicular to both the transport direction and stacking direction of the banknotes B (such a direction will be hereinafter referred to as a "width direction"), provided is a generally square frame 44*a*, which has a first outlet 49 in a generally square shape.

The door 44 is attached so as to be pivotable freely on a shaft provided on one side of the frame 44*a*. The door 44 rotates to change between an open state where the first outlet 49 is open and a closed state where the first outlet 49 is closed. The door 44 is biased to such a direction as to have the open state by a coil spring (not shown) provided for the shaft. The door 44 is made of a material which allows visual check of the inside of the bundling stacker from outside. For example, the door 44 may be made of a transparent or translucent material (e.g., glass or a resin). The first outlet 49 is an exemplary outlet.

The door 44 is also provided with a locking mechanism 44*c* as shown in FIG. 6. The locking mechanism 44*c* is configured to be switchable between a locked state in which the door 44 is locked to the closed state and an unlocked state in which the door 44 is allowed to open and close freely. Specifically, the locking mechanism 44*c* includes a pin 44*d* provided for the frame 44*a*, a drive mechanism 44*e* including a solenoid for driving the pin 44*d*, and an engaging portion 44*f* provided for the door 44 and engaging with the pin 44*d*. The locking mechanism 44*c* is controlled by the control unit 120 individually on a bundling stacker 4 basis. That is to say, its door 44 is openable and closable individually.

The locking mechanism 44*c* switches to such a state of unlocking the door 44 at least while the transportation of the banknotes by the first, second and third transport units 7, 8, and 10, stacking the banknotes in the bundling stackers 4, or bundling of the banknotes by the bundling unit 9 is not affected. In other words, the locking mechanism 44*c* is in the locked state at least while the transportation, stacking or bundling of the banknotes is affected. Unless the transportation, stacking, or bundling of the banknotes is affected, the locking mechanism 44*c* may be switched from the locked state to the unlocked state. It should be noted, however, that the locking mechanism 44*c* is not automatically unlocked whenever the transportation, stacking, or bundling of the banknotes is not affected. Depending on the control performed by the control unit 120, the locking mechanism 44*c* may be in the locked state, even while the transportation, stacking, or bundling of the banknotes is not affected.

Inside the door 44, provided is a stopper 44*g* (not shown in FIG. 1) with which one of the shorter edges of the banknotes B contacts. The stopper 44*g* is made of a material which allows visual check of the inside of the bundling stacker from outside. For example, the stopper 44*g* may be made of a transparent or translucent material (e.g., glass or a resin).

An alignment mechanism 45 is provided at the other end of the bundling stacker 4 opposite from the door 44. That is to say, the alignment mechanism 45 is provided so as to face the other shorter edge of the banknotes B in the bundling stacker 4 opposite from the door 44. The alignment mechanism 45 aligns the respective edges of the banknotes in the width direction with each other. In this embodiment, as the banknotes are transported in the direction parallel to the shorter edges of the banknotes, the width direction corresponds to the direction parallel to the longer edges of the banknotes. In other words, the alignment mechanism 45 aligns the respective shorter edges of the banknotes. The alignment mechanism 45 includes an arm 45*a* which is provided to be rotatable on a shaft extending in the stacking direction of the banknotes B and a stepping motor 45*b* which rotates the arm 45*a*. By pressing one shorter edge of the banknotes B toward the door 44 with the arm 45*a*, the alignment mechanism 45 brings the other shorter edge of the banknotes into contact with the stopper 44*g*. That is to say, the alignment mechanism 45 aligns the respective shorter edges of the banknotes B in cooperation with the door 44. In this manner, the banknotes in the bundling stacker 4 are aligned with each other in contact with the stopper 44*g*.

<Configuration for Non-Bundling Stacker 5>

The non-bundling stackers 5 pile and stack the banknotes. As shown in FIG. 2, each of the non-bundling stackers 5 includes a container 50 in which the banknotes are stacked, a stacking wheel 51 which brings the transported banknotes into the container 50, and a stacking sensor 52 which detects the presence of the banknotes.

The container 50 of each of the non-bundling stackers 5 has a tilted bottom. Thus, the banknotes brought into the container 50 are collected to the lower end of the bottom.

The stacking sensor 52 is provided at the lower end of the bottom of the container 50. The stacking sensor 52 is configured in the same manner as the banknote sensor 25, and detects the banknotes in the container 50 when the light is blocked. The stacking sensor 52 is arranged such that the light is blocked by the banknotes in the container 50.

The stacking wheel 51 includes a plurality of blades, and catches the transported banknotes between the blades to bring them into the container 50. The banknotes are released from the blades of the stacking wheel 51 near the bottom of the container 50, and are stacked in the container 50.

The container 50 has openings through the second side surface 124 of the housing 12 as shown in FIG. 1. That is to say, the second side surface 124 is provided with second outlets 53 through which the banknotes stacked in the non-bundling stackers 5 are removed out of the housing 12. The second outlets 53 have no door, and are kept opened. The second outlets 53 of the first and second non-bundling stackers 5A and 5B are cut open through the second side surface 124 and are arranged side by side in the horizontal direction.

Each of the non-bundling stackers 5 is provided with a pushing mechanism 54 which pushes the stacked banknotes toward the second outlet 53. The pushing mechanism 54 is provided farthest from the second outlet 53, and is configured to push the banknotes from the farthest point toward the front (toward the second outlet 53).

<Configuration for Reject Stacker 6>

The reject stacker 6 piles and stacks the banknotes. The reject stacker 6 includes, as shown in FIG. 2, a container 60 in which the banknotes are stacked, a stacking wheel 61 which brings the transported banknotes into the container 60, a stacking sensor 62 which detects the presence of the banknotes, and stoppers 64 which prevent the banknotes in the container 60 from being ejected outside.

Specifically, the container 60 of the reject stacker 6 has an opening through the first side surface 123 of the housing 12 as shown in FIG. 1. That is, a reject outlet 63 through which the banknotes stacked in the reject stacker 6 are removed out of the housing 12 is provided through the first side surface 123. The reject outlet 63 is cut open through the first side surface 123 to be positioned above the inlet 24. The reject outlet 63 has no door and is kept opened.

The bottom of the container 60 is tilted such that the greater the distance from the first side surface 123, the lower the bottom is. Thus, the banknotes in the container 60 are stacked deep inside the first side surface 123. In this manner, the banknotes are prevented from being ejected outside through the reject outlet 63 of the first side surface 123 when they are brought into the container 60.

The two stoppers 64 are provided at one edge of the bottom of the container 60 closer to the first side surface 123. The stoppers 64 are supported to be rotatable around an axis extending parallel to the edge of the bottom closer to the first side surface 123, and are biased by bias springs (not shown) to stand up on the bottom of the container 60. These stoppers 64 can also prevent the banknotes in the container 60 from being ejected outside through the reject outlet 63 of the first side surface 123. Note that the banknotes stacked in the reject stacker 6 may be removed through the reject outlet 63 with the stoppers 64 pressed down against the elastic force of the bias springs.

The stacking wheel 61 includes a plurality of flexible blades, and has the function of tapping the banknotes falling into the container 60 on their rear edges in the transport direction so as to help the banknotes fall. Even when the banknotes are brought into the container 60 successively, each of the banknotes is prevented from being inserted below the rear edge of the preceding banknote, and thus the banknotes can be sequentially stacked one by one on top of the previously stacked ones.

The stacking sensor 62 is configured in the same manner as the banknote sensor 25, and detects the banknotes in the container 60 when the light is blocked. The stacking sensor 62 is arranged such that the light is blocked by the banknotes in the container 60.

<Configuration of Bundling Unit 9>

As shown in FIG. 3, the bundling unit 9 includes a tape feeding unit 91 which feeds a tape T, a tape loop forming unit 92 which forms a tape loop L from the tape T, a clamp 94 which presses the banknotes B in the stacking direction when the banknotes B are bundled together with the tape T, a heater 95 which heat-seals portions of the tape T wound around the banknotes B, a cutter 96 which cuts the tape T at a portion not wound around the banknotes B, a printer 97 which prints characters on the tape T, and a stamper 98 which stamps a seal on the tape T.

The tape feeding unit 91 includes a tape reel 911 around which the tape T is wound, and a tape transport unit 912 which transports the tape T drawn from the tape reel 911. The tape transport unit 912 transports the tape T along a predetermined transport path. The tape transport unit 912 has a guide (not shown) and multiple pairs of rollers.

The tape loop forming unit 92 forms a tape loop L from the tape T, and rewinds the tape T after the stacked banknotes B have been arranged in the tape loop L to wind the tape T around the banknotes B. The tape loop forming unit 92 includes a pair of feed rollers 920 which feeds and rewinds the tape T, a tape gripping part 921 which grips an end portion of the tape T, a guide 925 which defines the shape of the tape loop L being formed from the tape T, a first tape sensor 9210 which detects the end portion of the tape T, and a second tape sensor 9211 which detects that a large tape loop L2 has been formed. Although not illustrated in detail, the tape loop forming unit 92 has a small tape loop formed from the tape T by the tape gripping part 921, and then has the tape T fed by the pair of feed rollers 920 to enlarge the small tape loop into a large tape loop L2. In the meantime, the guide 925 guides the tape T to define the shape of the large tape loop L2, and the second tape sensor 9211 detects that the large tape loop L2 has been formed.

The pair of feed rollers 920 is driven by a tape feed motor 9212 (see FIG. 7), and feeds the tape T in forming the tape loop L. The pair of feed rollers 920 is located at the downstream end of the tape transport unit 912, and forms part of the tape transport unit 912. The pair of feed rollers 920 is an exemplary feeder. A pair of rollers of the tape transport unit 912 is also driven by the tape feed motor 9212 through a belt, a gear, or any other suitable mechanism.

The tape reel 911 is further provided with a tape reel motor 9111 (see FIG. 7) which rotates the tape reel 911 in the direction in which the tape T is rewound. When the tape T is going to be wound around the banknotes B that have been arranged into the tape loop L, this tape reel motor 9111 and the tape feed motor 9212 rotate in such a direction as to rewind the tape T. The tape feed motor 9212 and the tape reel motor 9111 are each implemented as a stepping motor.

The first tape sensor 9210 is provided on the transport path of the tape T between the pair of feed rollers 920 and the tape gripping part 921. The first tape sensor 9210 is configured in the same manner as the banknote sensor 25. The first tape sensor 9210 detects the tape T when the light is blocked. For example, the first tape sensor 9210 may detect the end portion of the tape T when the light that has been blocked starts being received again by the first tape sensor 9210 as the pair of feed rollers 920 rewinds the tape T.

The tape gripping part 921 is arranged at a position where the tape gripping part 921 can receive the tape T fed from the pair of feed rollers 920. Although not shown in detail, the tape gripping part 921 rotates while gripping, at the end portion thereof, the tape T fed from the pair of feed rollers 920, thereby forming the tape loop L.

While the large tape loop L2 is being formed, the guide 925 comes into contact with an outer peripheral surface of the large tape loop L2 to define the shape of the large tape loop L2. The guide 925 defines the shape of the large tape loop L2 to be a generally rectangular shape, more specifically, a rectangular shape having rounded corners.

The guide 925 includes a lower guide 926 which comes into contact with the outer peripheral surface of the large tape loop L2 from under the large tape loop L2, first and second lateral guides 927 and 928 which come into contact with the outer peripheral surface of the large tape loop L2 horizontally, and four corner guides, namely, first to fourth corner guides 929*a* to 929*d*, which respectively correspond to the four corners of the rectangle.

The lower guide 926 is provided with a displacement mechanism, and is configured to be readily moved in the vertical direction by the displacement mechanism. The displacement mechanism also functions as a displacement mechanism for lower clamps which will be described later.

The first lateral guide 927 extends in the vertical direction at one of longitudinal ends of the lower guide 926 closer to the bundling stacker 4, and regulates the position of the tape T in the tape width direction.

The second lateral guide 928 extends in the vertical direction at the other longitudinal end of the lower guide 926 closer to the dispense unit 11. The second lateral guide 928 is supported to be movable up and down by the support, and is coupled to the lower guide 926 through the link. Thus, the second lateral guide 928 moves upward or downward as the lower guide 926 moves upward or downward. Note that the magnitude of movement of the second lateral guide 928 is amplified by the link. The second lateral guide 928 is configured to retreat upward during the transportation of the bundled banknotes B so as not to interfere with the transportation of the bundled banknotes B.

The second tape sensor 9211 is configured in the same manner as the banknote sensor 25, and detects the tape T when the light is blocked. The receiver of the second tape sensor 9211 is attached to the fourth corner guide 929*d* as shown schematically in FIG. 3. The transmitter of the second tape sensor 9211 is arranged such that the light emitted from the transmitter is blocked by the tape T guided along the fourth corner guide 929*d*. That is, the second tape sensor 9211 detects that the fourth corner guide 929*d* is guiding the tape T, i.e., the tape loop L has reached a predetermined size, when the light emitted from the transmitter is not received by the receiver.

The clamp 94 presses the banknotes B in the stacking direction when the banknotes B are bundled together with the tape T. The clamp 94 presses the banknotes B around their portion to be bundled with the tape T. The clamp 94 includes a pair of upper clamps provided above the banknotes B transported into the tape loop L, a pair of lower clamps provided below the banknotes B, and a displacement mechanism which allows the lower clamps to move up and down.

The lower clamps are configured to be movable up and down. In this embodiment, the lower clamps are attached to the lower guide 926 of the guide 925, and move up and down together with the lower guide 926. In other words, the displacement mechanism which displaces the lower clamps in the vertical direction also functions as the displacement mechanism for the lower guide 926.

The heater 95 bonds together portions of the tape T wound around the banknotes B. The heater 95 heat-seals such portions of the tape T. The heater 95 is an exemplary bonding unit.

The cutter 96 cuts a portion of the tape T not wound around the banknotes B, that is, an excessive portion of the tape T that has not been used to bundle the banknotes B together with the tape T. The cutter 96 has a saw-toothed cutting edge at its end. The cutter 96 is an exemplary cutting unit.

The heater 95 and the cutter 96 are configured as a unit, and is arranged opposite to the stamper 98 relative to the banknotes B brought into the tape loop L, that is, opposite to the stamper 98 in the stacking direction of the banknotes B. More specifically, the heater 95 and the cutter 96 are arranged above the tape gripping part 921. The heater 95 bonds those portions of the tape T on the tape gripping part 921. The cutter 96 cuts the tape T on the tape gripping part 921.

The printer 97 is arranged in the tape transport unit 912 as shown in FIG. 3. The printer 97 includes a print head which prints characters on the tape T transported by the tape transport unit 912. The printer 97 prints, for example, information about the banknotes B to be bundled (e.g., denomination, date, and/or serial number) on the tape T. The print made by the printer 97 is shifted in the tape width direction from a portion on which a seal will be stamped by the stamper 98 so that the print does not overlap with the seal stamped by the stamper 98.

The stamper 98 stamps a seal on the tape T wound around the banknotes B compressed by the clamp 94. The stamper 98 stamps a seal related to the banknotes B to be bundled (e.g., a seal of a financial institution, a seal indicating the kind of the banknotes such as fit or unfit notes) on the tape T. The stamper 98 is arranged opposite to the heater 95 and the cutter 96 relative to the banknotes B brought into the tape loop L, in particular, opposite to the heater 95 and the cutter 96 in the stacking direction of the banknotes B. The stamper 98 includes a stamp 981 and a displacement mechanism (not shown) which displaces the stamp 981 in the vertical direction. When the displacement mechanism displaces the stamp 981 upward, the stamp 981 stamps a seal on the tape T wound around the banknotes B in the stacking direction of the banknotes B. The stamper 98 forms an integral part of the lower guide 926, and moves up and down along with the lower guide 926 that is moving up and down.

<System Configuration for Banknote Handling Apparatus>

Figure 7:
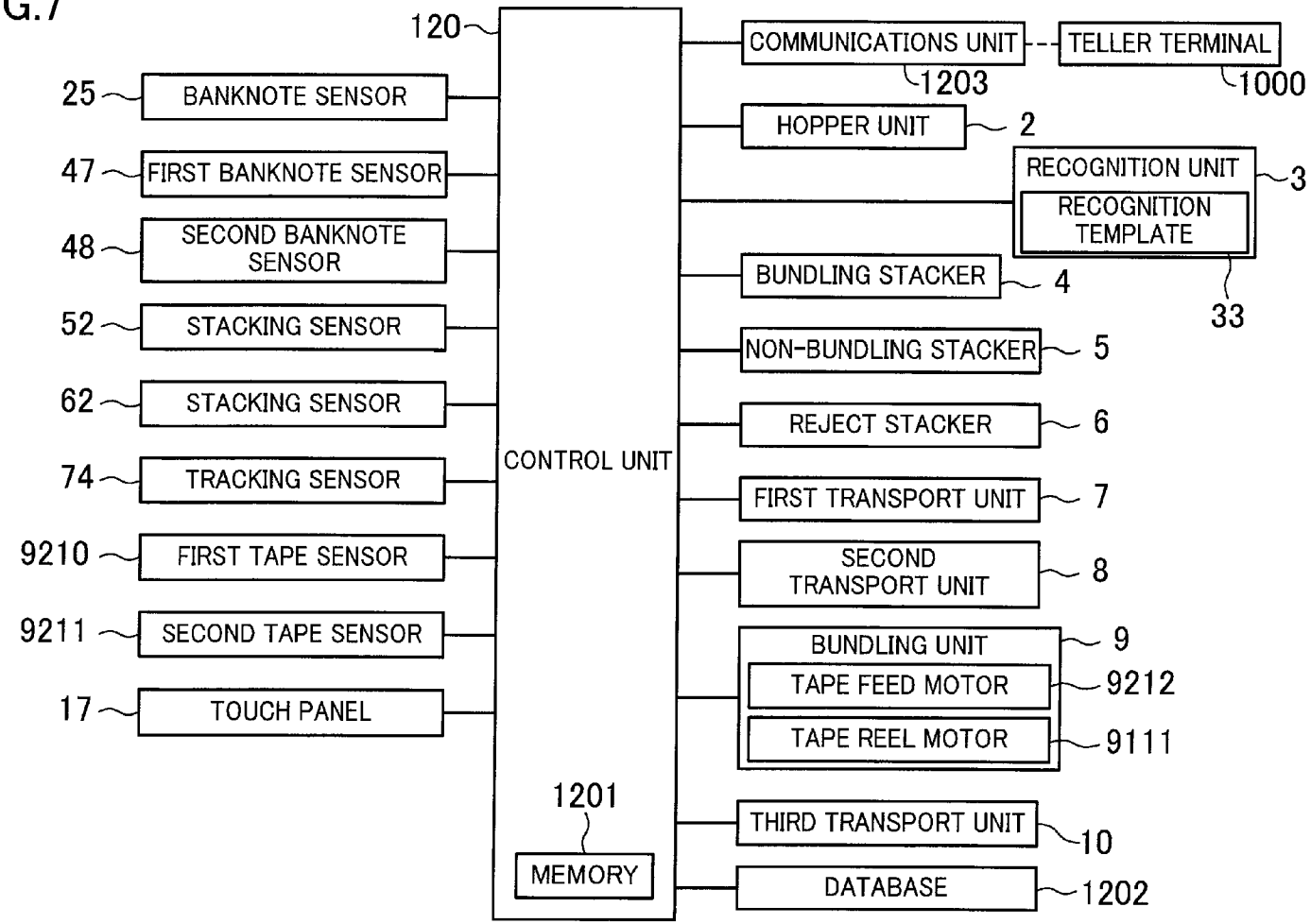
FIG. 7 is a block diagram illustrating a general configuration for the banknote handling apparatus.

FIG. 7 is a block diagram illustrating a general configuration for the banknote handling apparatus 100.

The banknote handling apparatus 100 includes a control unit 120 based on a well-known processor, for example. The control unit 120 includes a memory 1201 which stores various kinds of information. The control unit 120 is connected to the above-described units, namely, the hopper unit 2, the recognition unit 3, the bundling stackers 4, the non-bundling stackers 5, the reject stacker 6, the first and second transport units 7 and 8, the bundling unit 9, the third transport unit 10, and the touch panel 17 so as to transmit and receive signals to/from these units. The control unit 120 is also connected to the banknote sensor 25, the first and second banknote sensors 47 and 48, the stacking sensors 52 and 62, the tracking sensors 74, and the first and second tape sensors 9210 and 9211 to receive detection signals from these sensors. The control unit 120 generates a control signal based on the signal supplied from the touch panel 17, the detection signals from the sensors and other suitable signals, and outputs the generated control signal to the hopper unit 2 and other units. The hopper unit 2 and other units operate in accordance with the control signal. Taking the bundling stacker 4 as an example, the control unit 120 controls the stage 41, the guide 42, the locking mechanism 44*c*, the alignment mechanism 45, and the stacking wheel 46. The control unit 120 is an exemplary processing unit.

A database 1202 is connected to the control unit 120. The database 1202 is provided for this banknote handling apparatus 100 and stores at least results of counting related to deposit processing (i.e., transactions) and information about the serial numbers read from the respective banknotes. The serial number information is stored in association with information to identify a bundle including the banknote. The information to identify the bundle is information to be printed on a tape that bundles the banknotes together. The database 1202 is also configured to store information about the processing that was carried out in the past by this banknote handling apparatus 100. The database 1202 is an exemplary memory. Note that the range of the data stored in the database 1202 (e.g., data of the transactions for the past half year period) is determined depending on the storage capacity of the database 1202. Furthermore, the banknote handling apparatus 100 is connected to a teller terminal 1000 via a communications unit 1203. The teller terminal 1000 also stores the results of counting related to deposit processing, information about the serial numbers read from the respective banknotes, and information about bundles. The teller terminal 1000 has a larger storage capacity (i.e., may store a greater deal of information (or information about older transactions)) than the database 1202 of the banknote handling apparatus 100. The teller terminal 1000 corresponds to a database provided outside of the housing 12 of the banknote handling apparatus 100.

<Working Mechanism of Banknote Handling Apparatus>

It will be described how to perform deposit processing as an example of a process to be performed by this banknote handling apparatus 100. In the deposit processing, loose banknotes are sorted and stacked in the predetermined stackers, and predetermined ones of the banknotes are bundled. In the following description, single-kind banknote bundling processing will be described, in which a predetermined number of banknotes of a prescribed kind to be bundled are stacked alternately in the first and second bundling stackers 4A, 4B, and the predetermined number of banknotes stacked are bundled sequentially by the bundling unit 9.

First, the operator receives loose banknotes to be deposited from the customer, and places the banknotes on the hopper unit 2. At this time, even if the loose banknotes include banknotes of multiple different kinds, all the banknotes are just placed on the hopper unit 2 without being sorted. The operator adjusts the guides 22 according to the dimensions of the banknotes. Then, the operator operates the touch panel 17 to start the intake of the banknotes. The banknote handling apparatus 100 may automatically start the intake of the banknotes when the banknote sensor 25 detects the banknotes placed on the hopper unit 2.

The banknotes placed on the hopper unit 2 are brought into the housing 12 one by one through the inlet 24 as the intake rollers 23 are activated. The banknotes thus taken in are transported by the first-stage transport unit 7, and pass through the recognition unit 3. The recognition unit 3 detects the kind of the banknotes passed, and informs the control unit 120 of the kind of the banknotes. The recognition unit 3 also reads and recognizes the serial numbers of those banknotes. Information about the serial numbers thus recognized is stored in the database 1202.

The control unit 120 designates the banknotes' destination according to the kind of the banknotes. In particular, if the banknotes are fit banknotes of a predetermined denomination to be bundled, the control unit 120 designates the bundling stacker 4 (any one of the bundling stackers 4A and 4B) as their destination. If the banknotes are unfit banknotes of the predetermined denomination to be bundled, the control unit 120 designates the first non-bundling stacker 5A as their destination. If the banknotes are of any denomination other than the predetermined denomination, the control unit 120 designates the second non-bundling stacker 5B as their destination. If the banknotes are rejected banknotes, the control unit 120 designates the reject stacker 6 as their destination.

The control unit 120 controls the first-stage transport unit 7 such that the banknotes are transported to the stacker designated as their destination. In particular, the control unit 120 controls the sorting mechanism 73 corresponding to the diverged path 72 leading to the destination stacker such that the banknotes are guided from the main transport path 71 to the diverged path 72. The control unit 120 switches the sorting mechanism 73 when the tracking sensor 74 just before the diverged path 72 detects the banknotes. Further, the control unit 120 controls the stacking wheel 46 or 51 of the destination stacker to bring the banknotes into that stacker.

The banknotes to be transported to the bundling stacker 4 are transported to one of the two bundling stackers 4. When the number of banknotes stacked in one of the bundling stackers 4 reaches a predetermined bundling number (e.g., 100), the remaining banknotes are then transported to the other bundling stacker 4. In this example, the banknotes are intended to be transported to the first bundling stacker 4A first.

When the banknotes are transported one after another to the first bundling stacker 4A, the stacking wheel 46 rotates to stack the banknotes one by one. The banknotes transported into the first bundling stacker 4A have their longer sides aligned with each other by coming into contact with the guide 42.

Meanwhile, the arm 45*a* of the alignment mechanism 45 presses one of the shorter sides of each banknote B transported into the bundling stacker 4, thereby making the other shorter side of the banknote B come into contact with the stopper 44*g* of the door 44. In this manner, the respective shorter sides of the banknotes B stacked are aligned with each other.

When the number of banknotes stacked in the first bundling stacker 4A reaches the bundling number, the control unit 120 rotates the upper guide 42*a* of the guide 42 toward the frontend in the transport direction, thereby opening the bundling stacker 4. The control unit 120 also controls the second transport unit 8 so that the banknotes B are gripped by making the gripper 81 enter the first bundling stacker 4A through the opening. Since the gripper 81 has such a shape as to be insertable through the comb teeth of the stage 41, the banknotes B on the stage 41 may be gripped without interfering with the stage 41. Then, the second transport unit 8 transports the banknotes B from the bundling stacker 4 to the bundling unit 9. Thereafter, the bundling processing will be performed.

When the number of banknotes stacked in the first bundling stacker 4A reaches the bundling number, the remaining banknotes are stacked in the second bundling stacker 4B.

Then, when the number of banknotes stacked in the second bundling stacker 4B reaches the bundling number, the remaining banknotes are stacked again in the first bundling stacker 4A. By this time, the banknotes in the first bundling stacker 4A have been all bundled together, and thus the first bundling stacker 4A is now empty. Thus, the provision of the two bundling stackers 4 makes it possible to perform the bundling processing while stacking the banknotes continuously.

When the banknotes are all bundled together, the control unit 120 controls the third transport unit 10 so that the bundled banknotes are dispensed through the dispense unit 111.

The unfit banknotes of the predetermined denomination are transported to the first non-bundling stacker 5A. When the banknotes are transported to the first non-bundling stacker 5A, the stacking wheel 51 rotates to stack the transported banknotes in the container 50. Thus, the unfit banknotes of the predetermined denomination are stacked in the first non-bundling stacker 5A. Likewise, the banknotes of any denominations other than the predetermined denomination are transported to, and stacked in, the second non-bundling stacker 5B. The rejected banknotes are also transported to, and stacked in, the reject stacker 6.

This series of processing steps will be performed over and over again until there are no banknotes placed on the hopper unit 2. The banknote sensor 25 determines whether banknotes are still present on the hopper unit 2 or not.

When the handling of the banknotes placed on the hopper unit 2 is finished, the rejected banknotes are taken in and recognized again. Specifically, the operator extracts the rejected banknotes from the reject stacker 6, and places them on the hopper unit 2 to take them into the apparatus again. The rejected banknotes are those which were not recognized as normal banknotes for any reason, and thus another attempt is made to take in and recognize them. Banknotes still recognized as rejected banknotes, if any, are restacked in the reject stacker 6. Then, the operator returns those restacked banknotes to the customer.

Note that the banknotes stacked in the first and second non-bundling stackers 5A, 5B are not taken in again.

Thus, when the handling of the banknotes placed on the hopper unit 2 and the re-handling of the rejected banknotes is finished, the single-kind banknote bundling processing is finished, i.e., the counting and sorting of the banknotes passed as those to be deposited by the customer are finished. The touch panel 17 displays the counted amount of the banknotes. The operator asks for a customer's approval of the amount, or checks whether the displayed amount corresponds with the amount written down on a deposit slip by the customer, and, if the answer is YES, the operator operates the touch panel 17 to confirm the deposit amount. When the confirmation is done, the teller terminal 1000 is informed of the confirmed deposit amount, thereby finishing the deposit processing. The teller terminal 1000 stores not only the deposit amount but also information about the serial numbers of the banknotes that have been subjected to the bundling processing and other types of processing as described above by this banknote handling apparatus 100 in association with information about the bundles including those banknotes. In the same way, the database 1202 of the banknote handling apparatus 100 also stores information about the serial numbers of the banknotes that have been subjected to the bundling processing and other types of processing in association with information about the bundles including those banknote. In this case, the information stored in the database 1202 during the processing is in a provisionally confirmed state. When the transaction has been completed, the stored information will be changed from the provisionally confirmed state into a confirmed state.

After the deposit processing has been finished, the operator removes the bundled banknotes stacked in the dispense unit 11, the banknotes stacked in the bundling stackers 4, and the banknotes stacked in the non-bundling stackers 5, and stores them in a predetermined storage place.

Through this series of processing steps, loose banknotes of different kinds are sorted into fit banknotes of a predetermined denomination, unfit banknotes of the predetermined denomination, banknotes of every denomination but the predetermined denomination, and rejected banknotes. The fit banknotes of the predetermined denomination are bundled on a bundling number basis.

In the example described above, after the deposit processing has been finished, the banknotes stacked in the bundling stackers 4 and non-bundling stackers 5 are intended to be removed by the operator. That is to say, the banknote handling operation is intended to be performed such that bundles of banknotes processed on a single transaction completed are treated as a different set from bundles of banknotes processed on the next transaction. However, the banknote handling operation may also be performed differently such that banknotes are continuously stacked and bundled over multiple transactions until the number of banknotes bundled reaches a predetermined number, for example.

Thus, this banknote handling apparatus 100 is configured to be switchable between the former mode of operation in which the banknotes stacked in the bundling stackers 4 and non-bundling stackers 5 are removed when a single transaction has been completed and the latter mode of operation in which the banknotes stacked in the bundling stackers 4 and non-bundling stackers 5 are not removed when a single transaction has been completed but continue to be stacked there from the next transaction and on (i.e., a leftover mode of operation). This banknote handling apparatus 100 is configured such that the leftover mode of operation is performed by the bundling stackers 4 only, or by the non-bundling stackers 5 only, or by both of the bundling and non-bundling stackers 4 and 5. Any of these modes of operation may be selected through a tap on the touch panel 17.

Also, this banknote handling apparatus 100 is configured to allow the user to enter a batch setting such that the number of banknotes stacked in the bundling stackers 4 and/or the non-bundling stackers 5 is limited to a preset number (of, e.g., 100). The batch setting may be entered into the bundling stackers 4 only, or the non-bundling stackers 5 only, or both the bundling and non-bundling stackers 4 and 5. If the batch setting is entered into the bundling stackers 4, the preset number of banknotes stacked in the bundling stackers 4 may be either bundled together in the bundling unit 9 or removed by the operator through the first outlet 49 with the operation of the banknote handling apparatus 100 temporarily suspended. On the other hand, if the batch setting is entered into the non-bundling stackers 5, the preset number of banknotes stacked in the non-bundling stackers 5 may be removed by the operator through the second outlet 53 with the operation of the banknote handling apparatus 100 temporarily suspended. If no batch setting is entered, the banknotes continue to be stacked in the bundling stackers 4 and/or non-bundling stackers 5 until their full capacity (i.e., maximum capacity) is reached. When their full capacity is reached, the operation of the banknote handling apparatus 100 is temporarily suspended or the banknotes are bundled together by the bundling unit 9. The batch setting may also be entered through a tap on the touch panel 17.

The leftover mode of operation and batch setting described above may be selectively adopted and selectively entered independently of each other. There are four options as for the leftover mode of operation. Specifically, the leftover mode of operation may be applied to only the bundling stackers 4, only the non-bundling stackers 5, both the bundling stackers 4 and non-bundling stackers 5, or neither the bundling stackers 4 nor non-bundling stackers 5. There are four options as for the batch setting. The batch setting may be entered into only the bundling stackers 4, only the non-bundling stackers 5, both the bundling stackers 4 and non-bundling stackers 5, or neither the bundling stackers 4 nor non-bundling stackers 5. Thus, as far as the combination of the leftover mode of operation and batch setting is concerned, the apparatus may operate in any of 4×4 (=sixteen) different modes. For example, if the leftover mode of operation is applied to only the bundling stackers 4 and if the batch setting is entered into both the bundling stackers 4 and non-bundling stackers 5, the operation of the banknote handling apparatus 100 is suspended or the banknotes are bundled when the number of banknotes stacked in the bundling stackers 4 during a single transaction reaches a predetermined number or when the number of banknotes continuously stacked in the bundling stackers 4 over multiple transactions reaches a predetermined number. As for the non-bundling stackers 5, on the other hand, the operation of the banknote handling apparatus 100 is suspended only when the number of banknotes stacked in the non-bundling stackers 5 reaches a predetermined number during a single transaction.

Also, if the leftover mode of operation is applied to both the bundling stackers 4 and non-bundling stackers 5 and if the batch setting is entered into only the bundling stackers 4, for example, the operation of the banknote handling apparatus 100 is suspended or the banknotes are bundled when the number of banknotes stacked in the bundling stackers 4 during a single transaction reaches a predetermined number or when the number of banknotes continuously stacked in the bundling stackers 4 over multiple transactions reaches a predetermined number. As for the non-bundling stackers 5, on the other hand, the operation of the banknote handling apparatus 100 is suspended when the number of banknotes stacked in the non-bundling stackers 5 during a single transaction reaches their full capacity or when the number of banknotes stacked in the non-bundling stackers 5 over multiple transactions reaches their full capacity.

By allowing the user to select any of these various combinations of leftover mode of operation and batch setting, this banknote handling apparatus 100 may be used even more conveniently.

<Duplication Check>

The banknote handling apparatus 100 with such a configuration performs a duplication check before confirming a transaction to see if any duplicate processes have been performed on the same banknote.

For example, if any error such as a banknote jam has occurred during the processing, then the operator may suspend the processing once, remove the banknote that has caused that error from the banknote handling apparatus 100, and then insert that banknote along with unprocessed banknotes into the banknote handling apparatus 100 again such that the banknote will be processed again. On the other hand, even when every banknote to be deposited is counted and sorted, the operator may remove the banknotes left in the bundling stackers 4 or the banknotes stacked in the non-bundling stackers 5 or reject stacker 6 without having the banknotes bundled together. In addition, since neither the second outlets 53 of the non-bundling stackers 5 nor the reject outlet 63 of the reject stacker 6 has a door such as the door 44 provided for the first outlets 49 of the bundling stackers 4, the operator may remove the banknotes during the processing. As can be seen, the operator may remove the banknotes from the banknote handling apparatus 100 in various situations. If such a banknote handling apparatus 100 is used, the operator could take a processed banknote that has been removed from the banknote handling apparatus 100 for some reason for a banknote to be processed again and insert it into the banknote handling apparatus 100 again by mistake. In that case, duplicate processes would be performed on the same banknote (e.g., in the case of counting processing, the same banknote would be counted twice or more).

If such duplicate processes were performed, the result of processing including the duplicate processes (such as the deposit amount and the number of deposited banknotes of each denomination in the case of deposit processing) would be transferred to the teller terminal 1000. In the meantime, the processed banknotes including the duplicately processed one would be transported to a predetermined place and then circulated. After that, the duplicate processes (such as miscalculation) would be detected some time somewhere. In that case, by reference to the serial number information stored in the teller terminal 1000 and information printed on the tape bundling the banknotes, the banknote handling apparatus 100 and transaction associated with the duplicate processes would be identified. Then, some measure to remove the duplication would be taken. However, if the duplicate processes were detected after the banknotes have been processed by the banknote handling apparatus 100, then it could be troublesome or difficult to deal with the duplicate processes.

Figure 8:
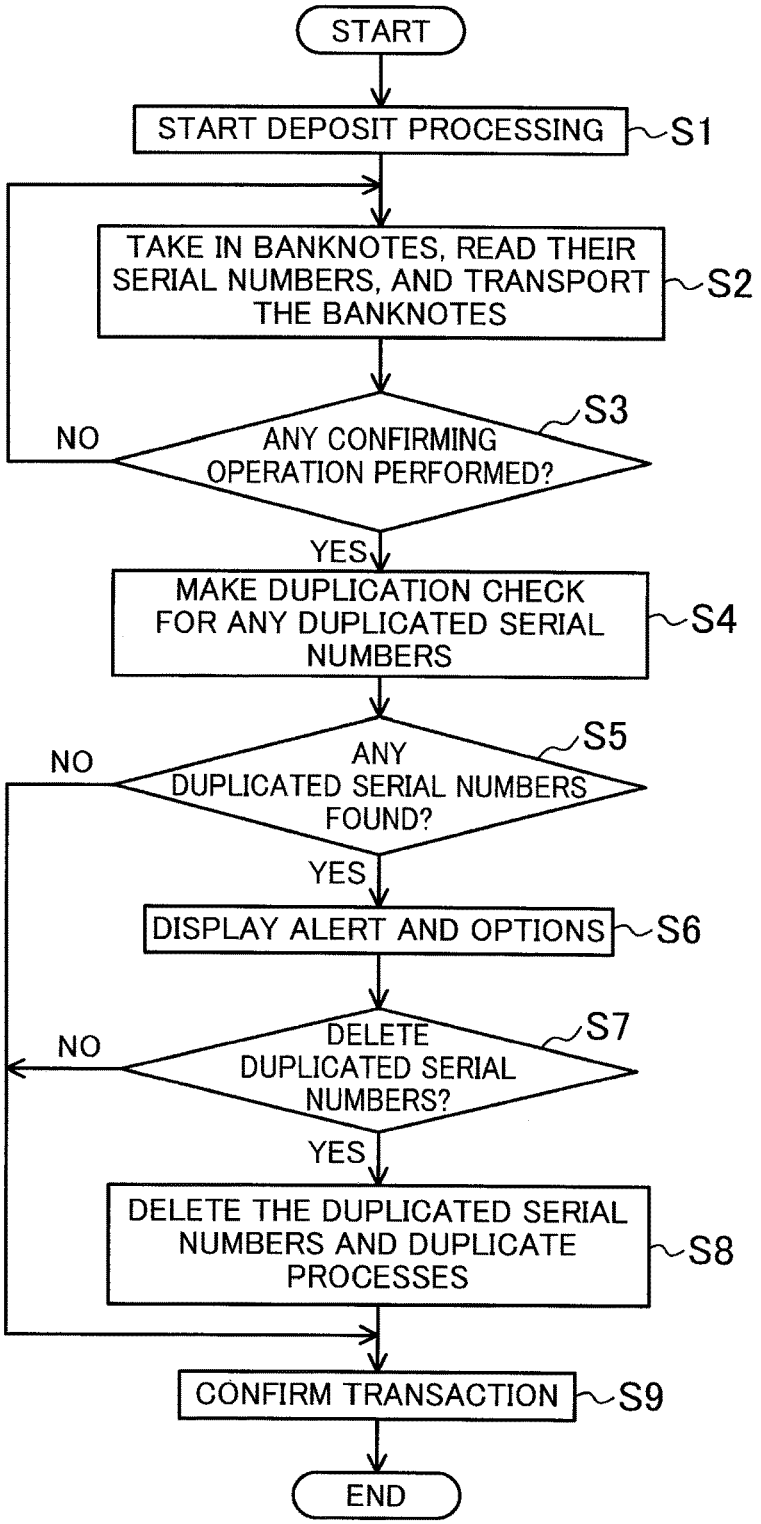
FIG. 8 is a flowchart showing the procedure of duplication check processing.

Thus, the banknote handling apparatus 100 makes a duplication check when a transaction is going to be confirmed to see if any duplicate processes have been performed on the same banknote. Now it will be described with reference to the flowchart of FIG. 8 how to make the duplication check during the deposit processing.

First, in Step S1, the deposit processing described above is started in response to the operator's operation.

Next, in Step S2, the control unit 120 has the deposit processing performed. Specifically, the control unit 120 makes the hopper unit 2 take in banknotes, makes the recognition unit 3 read their serial numbers, and then has the banknotes transported to their target stackers. Subsequently, in Step S3, the control unit 120 determines whether or not the operator has performed the operation of confirming a transaction. This operation of confirming a transaction may be the operation of confirming the deposit amount described above, for example. If no such confirming operation has been performed, the control unit 120 goes back to the processing step S2 to have the banknotes taken in, have their serial numbers read, and then have the banknotes transported again. On the other hand, if any confirming operation has been performed, then the control unit 120 proceeds to the processing step S4.

In Step S4, the control unit 120 makes a duplication check on the serial numbers. More specifically, the control unit 120 searches the provisionally confirmed serial numbers stored in the database 1202 for any pair serial numbers in duplicate (hereinafter referred to as "duplicated serial numbers"). In this example, the "provisionally confirmed serial numbers"

refer herein to the serial numbers of all banknotes that have been taken into the banknote handling apparatus 100 during this single transaction.

If the answer to the processing step S5 of asking if there are any duplicated serial numbers is YES, the control unit 120 proceeds to the processing step S6. On the other hand, if the answer to the processing step S5 is NO, the control unit 120 proceeds to the processing step S9.

In Step S6, the control unit 120 has an alert to the presence of duplicated serial numbers and the duplicated serial numbers themselves displayed on the touch panel 17. Note that the alert to the presence of duplicated serial numbers means that duplicate processes have been detected. Alternatively, instead of having such an alert to the presence of duplicated serial numbers displayed, the control unit 120 may also have an alert to the detection of duplicate processes displayed on the touch panel 17.

In addition, the control unit 120 also has options to be exercised by the operator to deal with the duplicated serial numbers displayed on the touch panel 17 and prompts the operator to take one of those options. In this case, the option to be exercised may be either to allow only one of the processes performed on the duplicated serial numbers and cancel the other of the processes or to confirm the transaction as it is.

In Step S7, the control unit 120 determines whether or not the operator has selected the option of canceling the duplicated serial numbers. If the answer is YES, the control unit 120 proceeds to the processing step S8. On the other hand, if the operator has selected the option of confirming the transaction, then the control unit 120 proceeds to the processing step S9.

In Step S8, the control unit 120 may enter only the temporally newest one of the duplicated serial numbers stored in the database 1202, delete the other older one(s), and cancel the banknote processing (more specifically, counting) associated with the serial number(s) deleted. That is to say, the count of the banknotes is reduced by the number of the serial number(s) deleted, and the total deposit amount is reduced by the amount corresponding to the number of banknotes deleted.

After that, in Step S9, the control unit 120 confirms the transaction.

Meanwhile, if the operator wants to postpone deciding what to do with the duplicated serial numbers when such an alert to the presence of duplicated serial numbers is displayed on the touch panel 17, then he or she may select the option of confirming the transaction. Alternatively, even if it turns out, when the operator actually checks the banknotes identified by the duplicated serial numbers in response to the alert displayed, that the serial numbers have just been detected erroneously, then he or she may also select the option of confirming the transaction. A read error of a serial number may occur, for example, when not full digits, but only some digits, of the serial number are read. In addition, a read error of a serial number may also occur if the scanner has only low ability to read the serial numbers or if the fitness level of a given banknote is very low.

In any case, if the operator has selected the option of confirming the transaction, then the control unit 120 has the transaction confirmed in Step S9. By providing such an option of confirming the transaction in this manner, the banknote handling apparatus 100 may save the trouble of performing unnecessary processing on the duplicated serial numbers detected, thus increasing the degree of handiness for users.

As can be seen, this banknote handling apparatus 100 makes such a duplication check every time a single transaction is going to be completed. If proper countermeasures against duplicate processes are provided in this manner during the processing by the banknote handling apparatus 100, the user is allowed to deal with the duplicate processes appropriately and timely.

<Reprocessing Check at the Time of Error>

In addition, before a transaction is confirmed, the banknote handling apparatus 100 makes a reprocessing check to see if the banknote to be processed again when recovery is made from an error that has occurred has been reprocessed appropriately.

For example, if an error such as a banknote jam has occurred, then the banknote that has caused the error is removed with the housing 12 of the banknote handling apparatus 100 opened. At this point in time, the banknotes remaining in the banknote handling apparatus 100, more specifically, the banknotes remaining in the bundling stackers 4, non-bundling stackers 5, reject stacker 6, and first and second transport units 7, 8, are still unprocessed. Also, if any banknotes are removed during the error recovery, the number of banknotes remaining in the banknote handling apparatus 100 might become an incorrect one. For that reason, the banknotes remaining in the banknote handling apparatus 100 at the time of error are all taken into the banknote handling apparatus 100 and processed again when error recovery has been completed. Note that the banknotes that have already been bundled at the time of error have been provisionally confirmed, and therefore, are not processed again.

However, due to the operator's handling error or for some other reason, the transaction could be continued even though the banknotes to be processed again have failed to be reprocessed.

Thus, before a transaction is confirmed, the banknote handling apparatus 100 makes a reprocessing check to see if the banknote to be processed again has been reprocessed appropriately. More specifically, the control unit 120 temporarily stores, in the database 1202, the serial numbers of the banknotes remaining in the banknote handling apparatus 100 at the time of error as those of targets of reprocessing.

Then, while the transaction is being confirmed (i.e., when the operator is performing the operation of confirming the transaction), the control unit 120 searches the serial numbers that have been provisionally confirmed upon the completion of the deposit processing for any serial numbers that have been temporarily stored as the targets of reprocessing.

If the serial numbers that have been provisionally confirmed just before the deposit processing is completed include no such serial numbers of the targets of reprocessing, then the control unit 120 has an alert to no reprocessing and the serial numbers of the targets of reprocessing displayed on the touch panel 17. In addition, the control unit 120 also has options to be exercised by the operator to deal with the reprocessing displayed on the touch panel 17 and prompts the operator to take one of those options. In this case, the option to be exercised may be either to perform the reprocessing or to confirm the transaction as it is without performing the reprocessing.

If the operator has selected the option of performing the reprocessing, the control unit 120 starts to have the banknotes to be reprocessed, which have been mounted on the hopper unit 2 by the operator, taken in.

Note that as in the duplication check, if the operator wants to postpone deciding what to do with the reprocessing or if it has turned out that the serial numbers have been detected erroneously, the operator may select the option of confirming the transaction.

If the reprocessing check is made based on the serial numbers as described above just before the transaction is confirmed to see if the banknotes to be processed again have actually been reprocessed, no reprocessing of the banknotes to be processed again may be detected accurately and in an early stage.

As can be seen from the foregoing description, the banknote handling apparatus 100 includes: a hopper unit 2 configured to take in banknotes; a recognition unit 3 configured to read the serial numbers of the banknotes that have been taken in through the hopper unit 2; a database 1202 configured to store the serial numbers read by the recognition unit 3; and a control unit 120 configured to process the banknotes. The control unit 120 searches the serial numbers stored in the database 1202 for any duplicated serial number, and detects, when finding any duplicated serial number, that duplicate processes have been performed on a banknote identified by the duplicated serial number.

According to this configuration, the banknotes taken in through the hopper unit 2 have their serial numbers read by the recognition unit 3, and the serial numbers are stored in the database 1202. Then, the control unit 120 performs a predetermined type of processing (e.g., counting) on the banknotes. In this case, the serial number is an identification number unique to each banknote. Thus, if any duplicated serial number is stored in the database 1202, it means that the same banknote has been taken in, recognized, and then processed more than once duplicately. Therefore, the control unit 120 detects, by the presence of such a duplicated serial number in the database 1202, that the same banknote has been processed duplicately. Since this processing is carried out based on the serial numbers that are unique identification numbers, the duplicate processes may be detected accurately. In addition, this banknote handling apparatus 100 also detects duplicate processes, and therefore, the duplicate processes may be detected in an early stage.

Second Embodiment

Next, a second embodiment will be described.

For example, Japanese Unexamined Patent Publication No. 2012-141863 discloses a banknote teller machine. According to this document, if a banknote jam has occurred on a banknote transport path inside its housing, the location of that banknote left on the transport path and its serial number are displayed on a display unit when the machine is stopped. In this manner, the machine prevents the operator from forgetting to remove that banknote from the transport path when recovery from the jam has been completed.

On the other hand, Japanese Unexamined Patent Publication No. 2013-114378 discloses a banknote teller machine configured to read the serial numbers of banknotes taken in through an inlet/outlet and then sort the banknotes into multiple groups of banknotes to be stored separately in respective containers such that the serial numbers of the banknotes stacked in the respective containers may be managed. If any banknote jam has occurred, this banknote teller machine also reads again the serial number of the banknote left on the transport path, and compares the serial number thus read to the serial numbers managed as those of the banknotes stacked in the containers such that the banknote management information matches the real banknotes actually stacked in those containers.

Each of these patent documents teaches how to process such an error that has occurred as a banknote jam during its transportation. The occurrence of the jam may be detected by a sensor, and there is substantially no time lag between the time of occurrence of the jam and the timing for the sensor to detect the jam. Thus, even if the machine is performing processing when the jam occurs, it is easy to locate the banknote in question.

On the other hand, the fall or any other unexpected move of a banknote from the banknote transport path in the housing (note that the "path" herein refers to not only a transport path on which banknotes are transported via rollers, guides, belts and other members but also a configuration for gripping and moving stacked banknotes) may be detected by a sensor of a light blocking type, for example. If any banknote has actually fallen, however, the banknote could fail to be detected by the sensor when the banknote is located in a blind spot for the sensor, but the fallen banknote could happen to be detected by a fall detecting sensor in some cases. If any banknote has fallen, then the operator opens the housing and removes the fallen banknote. However, since the time of detection by the sensor does not always agree with the time when the banknote actually fell as described above, the exact date and time of the fall of the banknote cannot be determined, which is a problem. Thus, when the fall of any banknote is detected, the entire processing that has been performed on the day of detecting the fall may be canceled and performed all over again. Alternatively, not only the processing performed on the same day but also processing performed earlier may be canceled and performed all over again. In any case, this will cause a significant decrease in processing efficiency.

In a more specific example, in a processing device configured to stack a predetermined number of banknotes taken into a housing through an inlet, bundle those banknotes, and then dispense the bundles out of the housing, while the stacked banknotes are being transported, for example, some of those banknotes could fall accidentally. In that case, if the fall detecting sensor fails to detect the fall of the banknote, then the processing will be continued. Thus, there will be a bundle consisting of less than a predetermined number of banknotes. In addition, as described above, even if the fall detecting sensor outputs a detection signal to abort the processing, the determination cannot be made whether the banknote has actually fallen when or before the fall of the banknote is detected by the sensor. It is virtually impossible to determine what bundle should include the banknote fallen in the housing when the fall detecting sensor outputs the detection signal.

As can be seen, if there can be a time lag between a time when an error actually occurred and a time when the error is detected, some measure for determining exactly when the banknote causing that error fell needs to be provided. Such a problem arises not only in a banknote handling apparatus for handling only banknotes but also in a paper sheet processing device for processing paper sheets including checks and gift certificates as well.

In view of the foregoing background, it is therefore an object of the present disclosure to provide a measure for determining exactly when a paper sheet removed from a housing at the time of occurrence of an error was subjected to its associated processing.

The present disclosure relates to a paper sheet processing device. This paper sheet processing device includes: a housing with an inlet through which paper sheets are taken in one by one; a recognition unit configured to read serial numbers of the paper sheets; a memory configured to store the serial numbers read by the recognition unit; a processing unit configured to make the recognition unit sequentially read the serial numbers of the paper sheets taken in through the inlet and to perform a predetermined type of processing on the paper sheets; a sensing unit configured to detect such an error that causes the processing unit to abort its processing; and a recovery unit configured to compare the serial number of the paper sheet removed by a user from the housing after the sensing unit has detected the error and aborted its processing to the serial numbers stored in the memory and determine exactly when the removed paper sheet was subjected to its associated processing.

According to this configuration, after the sensing unit has detected the error and the processing unit has aborted its processing, the user removes at least one paper sheet from the housing. The paper sheet(s) removed from the housing include(s) a paper sheet that has caused the error. Note that the paper sheets removed from the housing may include not only the paper sheet that has caused the error but also a paper sheet remaining on a transport path in the housing and paper sheets stacked in a predetermined stacking unit in the housing in some cases. The "predetermined stacking unit in the housing" includes a stacking unit having an opening, which faces the outside of the housing such that the paper sheets stacked in the stacking unit may be removed through the opening, and configured to allow the user to directly remove the stacked paper sheets from outside of the housing.

After the user has removed the paper sheet, the recovery unit compares the serial number of the paper sheet removed to the serial numbers stored in the memory. The serial numbers stored in the memory have been read during the processing. Thus, this matching allows the user to determine exactly when the paper sheet removed from the housing was processed. As a result, when there can be a time lag between the time of detection of an error and the time when an event causing that error actually happened, the processing associated with the event causing the error may be determined accurately, and recovery from the error may be done appropriately.

Another paper sheet processing device according to the present disclosure includes: a housing with an inlet through which paper sheets are taken in one by one; a recognition unit configured to read serial numbers of the paper sheets; a memory configured to store the serial numbers read by the recognition unit; a stacking and bundling unit configured to stack and bundle a predetermined number of paper sheets; a processing unit configured to instruct the recognition unit to sequentially read the serial numbers of the paper sheets taken in through the inlet and then instruct the stacking and bundling unit to perform bundling processing of forming bundles of the paper sheets; a sensing unit configured to detect such an error that causes the processing unit to abort its processing; and a recovery unit configured to compare the serial number of the paper sheet removed by a user from the housing after the sensing unit has detected the error and aborted its processing to the serial numbers stored in the memory and identify a bundle associated with the paper sheet removed.

According to this configuration, the paper sheet processing device reads one by one the serial numbers of paper sheets taken in through the inlet, and performs bundling processing of sequentially forming bundles, each consisting of a predetermined number of paper sheets. The serial numbers thus read are stored in the memory.

Then, when the sensing unit detects an error that causes the bundling processing to be aborted, the recovery unit compares the serial number of the paper sheet removed by the user from the housing to the serial numbers stored in the memory. In this manner, a bundle associated with the paper sheet removed may be identified. In this case, the "bundle associated with the paper sheet removed" includes both a bundle in which the paper sheets have already been bundled and a bundle in which the paper sheets have not been bundled yet due to the error detected by the sensing unit during their bundling but which is associated with the paper sheet removed. According to this configuration, when there can be a time lag between the time of detection of an error and the time when an event causing that error actually happened, the bundle associated with the paper sheet removed from the housing (and including the paper sheet causing the error) may be identified accurately, and recovery from the error may be done appropriately.

The recovery unit may also be configured to obtain the serial number of the removed paper sheet by having the serial number read by the recognition unit.

The paper sheets removed may be taken in one by one through the inlet, for example, and the recognition unit may read the serial numbers of the paper sheets again. According to such an embodiment, the serial numbers of the paper sheets may be read automatically by the paper sheet processing device, and therefore, the user's load may be lightened particularly when there are a large number of paper sheets removed.

The recovery unit may be configured to prompt the user to insert the removed paper sheet through the inlet into the housing and to instruct the recognition unit to stop reading the serial numbers in response to the user's cancel operation.

If the user is prompted to insert the removed paper sheet through the inlet into the housing when the processing is aborted upon the detection of an error, the serial numbers of the paper sheets may be read automatically by the paper sheet processing device.

On the other hand, the processing may be aborted due to an erroneous detection by the sensing unit, for example, even though actually no error has occurred. In that case, there may be no paper sheets to remove from the housing. If there are no paper sheets to remove from the housing, their serial numbers cannot be read again by the recognition unit. However, if the recovery unit is configured to instruct the recognition unit to stop reading the serial numbers in response to the user's cancel operation, the error recovery may be ended smoothly.

Optionally, the user's cancel operation does not have to be performed to end the error recovery as described above, but may be performed to make the recognition unit cancel re-reading the serial numbers in order to allow the user to enter the serial numbers manually.

The recovery unit may be configured to obtain the serial number of the removed paper sheet by having the user enter the serial number manually.

According to such an embodiment, the user is allowed to enter the serial number manually while looking at the paper sheet removed from the housing. As a result, even if the serial numbers of given paper sheets tend to be read inaccurately by the recognition unit (e.g., stained paper sheets), the recovery unit of the paper sheet processing device is allowed to obtain the serial numbers of such paper sheets exactly as well.

The recovery unit may be configured to require the user to manually enter the serial numbers of paper sheets, of which the serial numbers have not been successfully read by the recognition unit, and to accept an operation of canceling manually entering the serial numbers of some or all of the paper sheets in question.

If the user is required to manually enter the serial numbers of paper sheets, of which the serial numbers have not been successfully read by the recognition unit, the recovery unit of the paper sheet processing device is allowed to obtain their exact serial numbers. Meanwhile, since the user is allowed to perform an operation of canceling manually entering the serial numbers of some or all of the paper sheets in question, the error recovery may be ended smoothly if the user cancels manually entering the serial numbers as needed.

The recovery unit may be configured to compare the obtained serial numbers to the serial numbers stored in the memory by making fuzzy matching following a predetermined rule, and if a plurality of serial numbers have been extracted as a result of the fuzzy matching, to present the plurality of serial numbers to the user so that the user is allowed to pick any one of the serial numbers presented.

According to such an embodiment, there are more chances of extracting matching paper sheets when the recovery unit compares the serial numbers that have been either read by the recognition unit or manually entered by the user to the serial numbers stored in the memory after the processing has been aborted upon the detection of an error. As a result, particularly if the recognition unit is reading the serial numbers with just low accuracy before an error is detected (i.e., when the serial numbers are being read while the paper sheet processing device is performing processing) and/or after an error has been detected, or if the user has entered any wrong serial number, the chances of identifying a bundle associated with the paper sheet removed from the housing do increase.

In this case, "to present a plurality of serial numbers to the user so that the user is allowed to pick any one of the serial numbers presented," the plurality of serial numbers may be presented on a display unit and an operating button or any other operating means allowing the user to select any one of the serial numbers presented may be displayed on the display unit. Note that this is only a non-limiting exemplary embodiment.

Each of the bundles formed by the stacking and bundling unit may be provided with an identification code allowing the user to identify the bundle. The identification code may be printed on a tape that bundles the paper sheets together, for example. Any type of identification code may be used as long as the bundle is identifiable with the code. For example, the identification code may be a sequential number added every time a bundle is formed or the date and time of creation of the bundle. Specifically, for instance, if the bundle is created at 12:00 sharp on Jan. 1, 2014, then the identification code may be 20140101120000. Alternatively, the identification code may also be a combination of a sequential number and the date and time of creation.

The memory may store the serial number of each paper sheet and information about a bundle including the paper sheet in association with each other, and the recovery unit may be configured to identify a bundle that should include the serial number of the paper sheet removed.

According to such an embodiment, the recovery unit is allowed to identify a bundle that should, but actually does not, include the paper sheet removed from the housing by comparing the serial number of a paper sheet obtained (i.e., the paper sheet removed from the housing) to the serial numbers stored in the memory.

The processing unit may be configured to perform the processing of counting the paper sheets taken in through the inlet while the bundling processing is being performed, and the recovery unit may be configured to present the result of counting that has been determined with respect to the bundle identified with a one that should include the removed paper sheet to the user such that the user is allowed to decide either changing the determined result of counting into an undetermined one or keeping the determined result of counting unchanged.

When a particular bundle is identified with a one that should include the paper sheet removed from the housing, that particular bundle does not include the paper sheet that should be there. That is why the result of counting that has already been determined with respect to that bundle does not match the real bundle. Thus, the mismatch between the result of counting and the real bundle may be resolved if the result of counting determined with respect to the bundle is changed into an undetermined one (which is equivalent to canceling the result of counting). Also, as the case may be, if the determined result of counting is allowed to be left unchanged, the error recovery may be ended smoothly.

In this case, the result of counting may be, but does not have to be, "presented" on the display unit as described above.

If after a bundle that should include the serial number of the paper sheet removed has been identified, a bundle comprised of that bundle and the removed paper sheet needs to be formed again, the recovery unit may be configured to compare the serial numbers of the paper sheets that have been newly read by the recognition unit to the serial numbers stored in the memory for the paper sheets that are now included in that bundle.

If after a bundle that should include the serial number of the paper sheet removed has been identified, a bundle comprised of that bundle and the removed paper sheet is formed again, a bundle of paper sheets that should have been formed may be formed.

In addition, if while a bundle is being formed, the serial numbers of the paper sheets that have been newly read by the recognition unit are compared to the serial numbers stored in the memory for the paper sheets that are now included in that bundle, it is possible to avoid an unwanted situation where when a bundle is being formed again, paper sheets that should not be included in the bundle (e.g., paper sheets other than those removed) are mixed with the bundle by mistake.

The sensing unit may be configured to detect that a paper sheet has fallen from a transport path provided inside the housing.

In this case, the sensor "configured to detect that a paper sheet has fallen" may be a detecting sensor of a light blocking type which determines whether transmitting light is blocked or not, for example. If a detecting sensor of such a light blocking type is arranged appropriately, the transmitting light is blocked by a paper sheet fallen, if any. As a result, the fall of the paper sheet may be detected. However, even if a paper sheet has fallen, the paper sheet fallen may be in a blind spot for the detecting sensor of the light blocking type and may fail to block the transmitting light. In that case, the fall of the paper sheet cannot be detected, which is inconvenient. In addition, if the user forgets to remove the paper sheet that has fallen and caused the processing to be aborted and if the paper sheet fallen is in a blind spot for the detecting sensor, the fall of the paper sheet cannot be detected, either.

Meanwhile, if the fallen paper sheet happens to change its location or orientation accidentally to block the transmitting light, then the fall of the paper sheet may be detected afterward. That is to say, when a detecting sensor of such a light blocking type for detecting the fall of a paper sheet is used, there may be a time lag between the time when the paper sheet actually fell and the time when the detecting sensor detects that fall. Thus, if a bundle associated with the paper sheet removed from the housing after an error has been detected is identified by its serial number, the period when the paper sheet was processed may be specified, and therefore, the error recovery may be ended accurately and quickly.

The recovery unit may be configured to present an option of canceling a transaction which was performed when the sensing unit output the detection signal and an option of continuing the transaction to the user such that the user is allowed to pick one of these two options.

If the processing has been aborted upon the detection of an error by the sensing unit, it is recommended that the processing be canceled altogether once and then started over from the beginning. On the other hand, if the processing has been aborted upon an erroneous detection by the sensing unit, there is no need to start over the processing from the beginning.

Thus, if when the processing is aborted upon the detection of an error by the sensing unit, an option of canceling the transaction associated with the processing and an option of continuing the transaction are presented to the user such that he or she is allowed to pick one of these two options, then it is more convenient for him or her. In this case, these options may also be, but does not have to be, "presented" on the display unit as described above.

The recovery unit may be configured to determine whether or not the serial number of the removed paper sheet is included in a bundle that was being formed when the sensing unit output the detection signal, and to identify the paper sheet fallen in the housing with a one that should be included in that bundle if the answer is YES, or to compare the serial number based on the data stored about a bundle that had been formed before the detection signal was output if the answer is NO.

As described above, there may be a time lag between the time when a paper sheet actually fell and the time when the fall of that paper sheet is detected. Generally speaking, however, the fall of a paper sheet is detected more often than not at the very time of falling. That is why the paper sheet removed from the housing when the sensing unit output a detection signal to abort the processing is most likely included in a bundle that was being formed when the sensing unit output that detection signal. Thus, the recovery unit determines whether or not the serial number of the removed paper sheet is included in the bundle that was being formed when the sensing unit output the detection signal. If the answer is YES, the recovery unit identifies the paper sheet fallen in the housing with a one that should be included in that bundle. On the other hand, if the answer is NO, then the recovery unit compares the serial number based on the data stored about a bundle that had been formed before the detection signal was output. In this manner, a bundle including the paper sheet in question may be identified quickly.

The recovery unit may be configured to retrograde to the data stored about a bundle that was formed on the day of detection of the error.

Alternatively, the recovery unit may also be configured to retrograde to the data stored about a bundle that was formed on or after a predetermined day preceding the day of detection of the error.

The memory may include a database provided outside of the housing and the recovery unit may be configured to be able to refer to the data stored in the database.

If a database provided outside of the paper sheet processing device is used, the limit of the storage capacity may be substantially eliminated, and therefore, a bundle that should include the paper sheet in question may be identified with reliability.

As can be seen from the foregoing description, the paper sheet processing device described above may determine the period of processing associated with a paper sheet that was removed from the housing at the time of occurrence of an error.

A second embodiment will now be described with reference to the accompanying drawings.

<General Configuration for Banknote Handling Apparatus>

Figure 9:
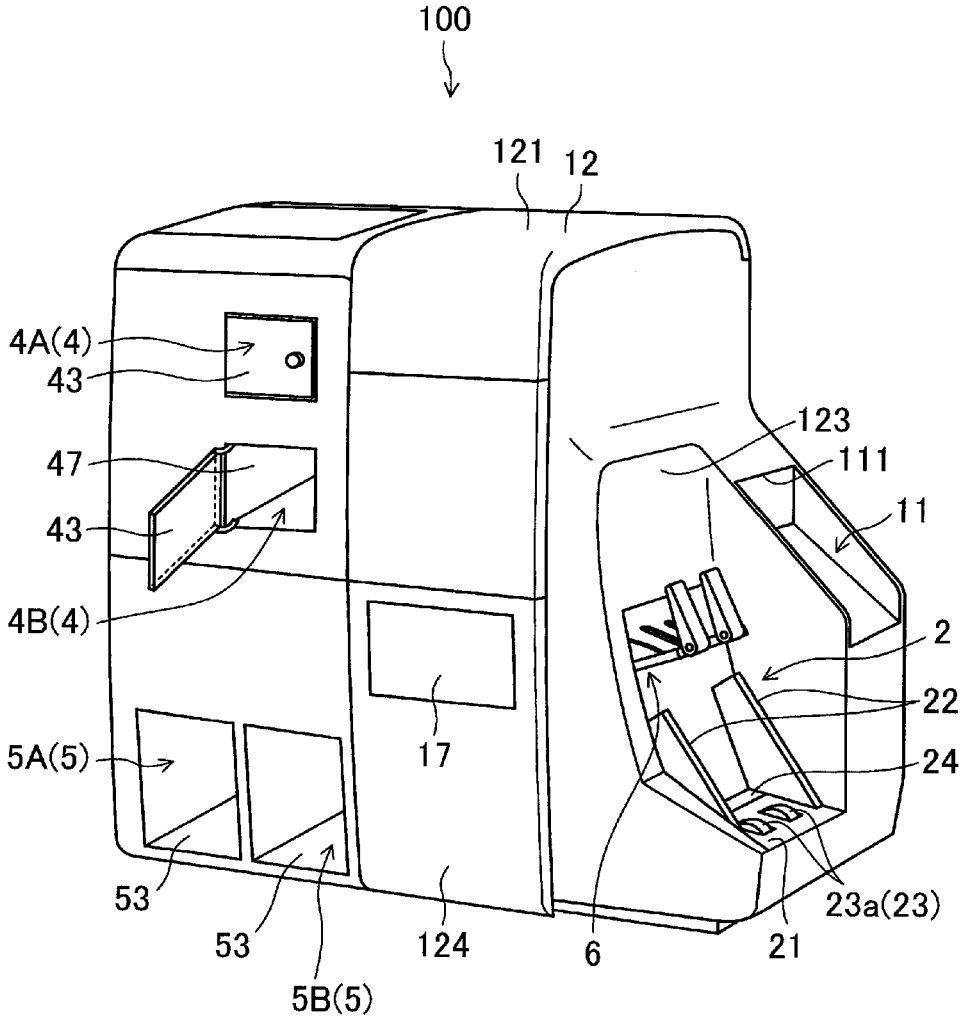
FIG. 9 is a view illustrating the appearance of a banknote handling apparatus according to a second embodiment.
Figure 10:
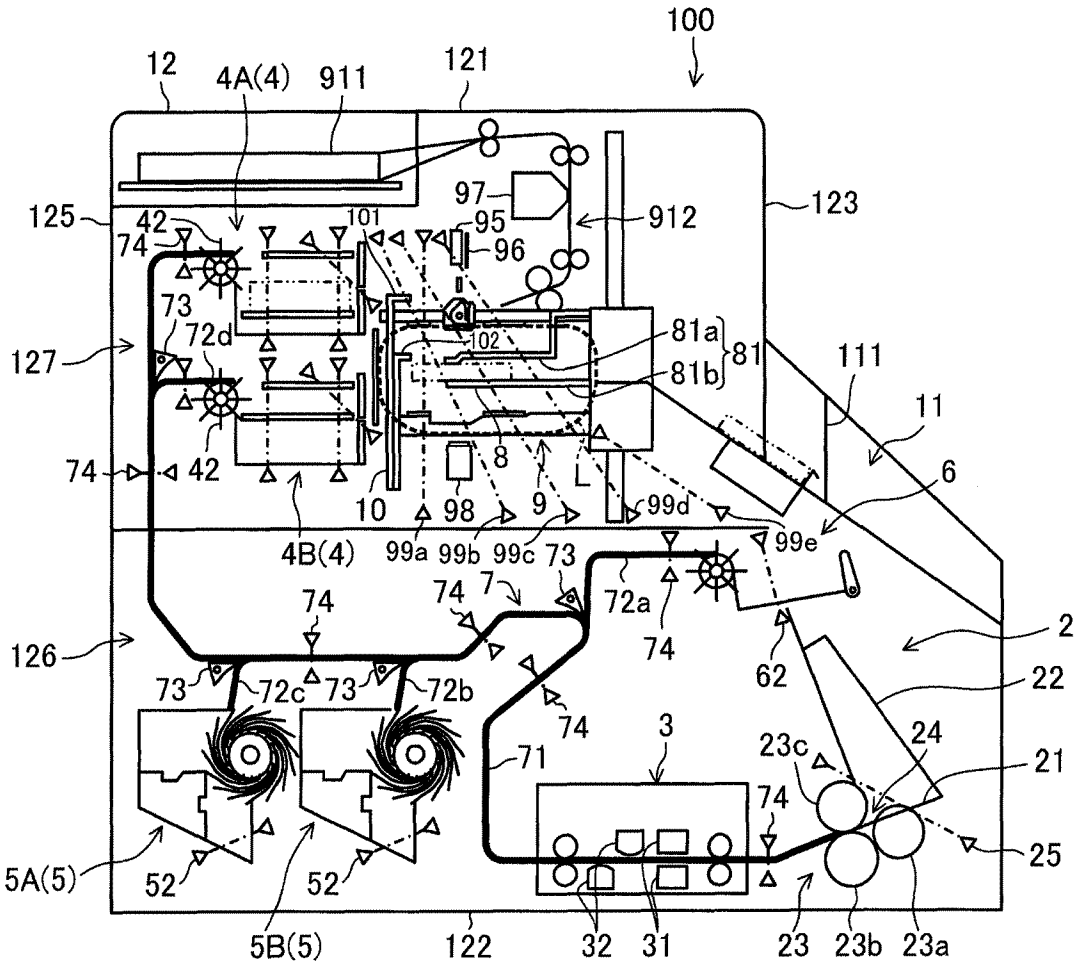
FIG. 10 illustrates a general configuration for the banknote handling apparatus.

FIG. 9 illustrates the appearance of a banknote handling apparatus 100, and FIG. 10 illustrates a general configuration for the banknote handling apparatus 100.

The banknote handling apparatus 100 is placed on a teller counter of a bank, for example, and is used by an operator. The banknote handling apparatus 100 takes loose banknotes therein, stacks the banknotes of a predetermined kind, bundles the banknotes in a predetermined bundling number, and dispenses the bundled banknotes.

The banknote handling apparatus 100 includes a hopper unit 2 which takes the banknotes placed thereon into the apparatus, a recognition unit 3 which recognizes the banknotes, bundling stackers 4 which stack the banknotes to be bundled, non-bundling stackers 5 which stack the banknotes not to be bundled, a reject stacker 6 which stacks rejected banknotes, a first transport unit 7 which transports the banknotes taken in through the hopper unit 2 to the recognition unit 3, the bundling stackers 4, the non-bundling stackers 5, and the reject stacker 6, a second transport unit 8 which transports the banknotes stacked in the bundling stackers 4 to the predetermined position, a bundling unit 9 which bundles the banknotes transported by the second transport unit 8, a third transport unit 10 which transports the banknotes that have been bundled (hereinafter referred to as "bundled banknotes"), a dispense unit 11 through which the bundled banknotes are dispensed, and a box-shaped housing 12 which houses the recognition unit 3, the bundling stackers 4, the non-bundling stackers 5, the reject stacker 6, the first transport unit 7, the second transport unit 8, the bundling unit 9, and the third transport unit 10.

The housing 12 has a top surface 121, a bottom surface 122, and four side surfaces. The housing 12 is a desktop type housing. That is to say, the bottom surface 122 of the housing 12 is not provided with casters or any other similar parts, and thus the housing 12 is configured to be placed on the desk.

The hopper unit 2 and the dispense unit 11 are provided through a first side surface 123, which is one of the four side surfaces of the housing 12. First outlets 47 of the bundling stackers 4 and second outlets 53 of the non-bundling stackers 5, which will be described in detail later, are provided through a second side surface 124, which is another one of the four side surfaces. The first and second side surfaces 123 and 124 are adjacent to each other.

The space inside the housing 12 is divided into a first handling section 126 configured to perform various kinds of handling processing for recognizing and sorting the banknotes and a second handling section 127 configured to perform various kinds of handling processing for bundling the banknotes to be bundled. The second handling section 127 is provided above the first handling section 126. The first handling section 126 includes the hopper unit 2, the recognition unit 3, the non-bundling stackers 5, and the reject stacker 6. The second handling section 127 includes the bundling stackers 4, the second transport unit 8, the bundling unit 9, and the third transport unit 10. Most of the first transport unit 7 is included in the first handling section 126.

The bundling stackers 4 include two stackers, namely, a first bundling stacker 4A and a second bundling stacker 4B. Both of the first and second bundling stackers 4A and 4B stack the banknotes to be bundled. The banknotes stacked as those to be bundled are determined as appropriate. The banknotes to be bundled are banknotes of a predetermined kind. The predetermined kind is identified by denomination or the orientation of the banknotes, or by determining whether the banknotes are fit or unfit, whether the banknotes are facing up or down, or whether the banknotes are new or not, for example. In this example, the banknotes to be bundled are fit banknotes of a predetermined denomination (e.g., 100 Chinese Yuan). In the following description, the banknotes which are recognized as normal by the recognition unit 3 will be hereinafter referred to as "normal banknotes," the banknotes which are not recognized as normal by the recognition unit 3 will be hereinafter referred to as "abnormal banknotes," and the banknotes which are transported in an abnormal state, e.g., skewed or multi-fed, will be hereinafter referred to as "abnormally transported banknotes." For example, one of the conditions for determining whether the banknotes are normal or not is whether the serial numbers of the banknotes are distinguishable or not. However, the normality of the banknotes may be checked based on a different condition, or an additional condition may be applied to determine whether the banknotes are normal or not. The banknotes which are determined as the normal banknotes but the destination of which (the bundling stacker, the non-bundling stacker, or other stackers) is not designated will be hereinafter referred to as "undesignated banknotes." Among the normal banknotes, those which are not stained or torn significantly will be hereinafter referred to as "fit banknotes," and those which are stained or torn significantly will be hereinafter referred to as "unfit banknotes." The bundling stacker 4 is an exemplary stacking unit.

The first and second bundling stackers 4A and 4B are arranged substantially vertically, i.e., one on top of the other, in the second handling section 127. The first bundling stacker 4A is positioned over the second bundling stacker 4B. The first and second bundling stackers 4A and 4B have the same configuration. When it is not necessary to distinguish the two stackers from each other, they will be hereinafter referred to as "bundling stackers 4." A detailed configuration of the bundling stackers 4 will be described later.

The non-bundling stackers 5 include two stackers, namely, a first non-bundling stacker 5A and a second non-bundling stacker 5B. The first and second non-bundling stackers 5A and 5B are arranged substantially horizontally, i.e., side by side, in the first handling section 126. The second non-bundling stacker 5B is arranged closer to the hopper unit 2 than the first non-bundling stacker 5A is. When it is not necessary to distinguish the two stackers from each other, they will be hereinafter referred to as "non-bundling stackers 5." The banknotes to be stacked in the non-bundling stackers 5 may be determined as appropriate. Here, the first non-bundling stacker 5A stacks unfit banknotes of the predetermined denomination. The second non-bundling stacker 5B stacks banknotes of every denomination but the predetermined denomination.

The reject stacker 6 stacks the rejected banknotes. The reject stacker 6 is positioned closer to the hopper unit 2 than the first and second non-bundling stackers 5A and 5B are. The reject stacker 6 is positioned at a level slightly higher than the first and second non-bundling stackers 5A and 5B. The banknotes to be stacked in the reject stacker 6 may be determined as appropriate. Here, the reject stacker 6 stacks "undesignated banknotes," "abnormal banknotes," and "abnormally transported banknotes" as the rejected banknotes.

The hopper unit 2 is provided for a portion of the first side surface 123 corresponding to the first handling section 126, and the dispense unit 11 is provided in a portion of the first side surface 123 corresponding to the second handling section 127.

The hopper unit 2 includes a mount 21 on which banknotes are placed, two guides 22 which guide the banknotes placed on the mount 21, intake rollers 23, an inlet 24 through which the banknotes are taken in, and a banknote sensor 25 which detects the banknotes on the mount 21. In the present embodiment, the banknotes are placed on the hopper unit 2 such that the banknotes are taken in a direction parallel to their shorter edges.

As shown in FIG. 9, the inlet 24 is arranged at a corner where the mount 21 and the first side surface 123 intersect with each other. The mount 21 is tilted such that the closer to the inlet 24, the lower the level of the mount 21. Thus, the banknotes on the mount 21 go toward the inlet 24 by themselves. The banknotes placed on the mount 21 are taken into the housing 12 through the inlet 24.

The banknote sensor 25 is provided near the inlet 24. The banknote sensor 25 includes a transmitter which emits light and a receiver which receives the light, and detects the banknotes when the light emitted from the transmitter toward the receiver is blocked. First and second banknote sensors 45 and 46, stacking sensors 52 and 62, tracking sensors 74, and first and second tape sensors 9210 and 9211 to be described later are also configured in the same manner. The banknote sensor 25 is arranged such that the light is blocked by the banknotes placed on the mount 21. That is to say, the banknote sensor 25 can detect that the banknotes are placed on the mount 21 when the light is blocked.

The guides 22 are configured such that the interval between them is adjustable. Specifically, the interval between the guides 22 is adjusted according to the banknotes placed on the mount 21.

The intake rollers 23 include kicker rollers 23*a*, feed rollers 23*b*, and gate rollers 23*c*. The kicker rollers 23*a* are partially exposed from the mount 21, and are in contact with the lowermost one of the banknotes placed on the mount 21. The kicker rollers 23*a* feed the lowermost one of the banknotes on the mount 21 to the inlet 24. Thus, the banknotes are taken in through the inlet 24 one by one. The banknotes taken in through the inlet 24 are distributed one by one by the feed rollers 23*b* and the gate rollers 23*c* into the housing 12. The banknotes thus taken in are passed to the first transport unit 7.

The dispense unit 11 includes a dispense port 111 through which the bundled banknotes are dispensed. In the dispense unit 11, the bundled banknotes are dispensed through the dispense port 111 in the direction parallel to their shorter edges.

The first transport unit 7 may be configured as a transport belt or any other suitable member. The first transport unit 7 includes a main transport path 71, first to fourth diverged paths 72*a* to 72*d* diverged from the main transport path 71, sorting mechanisms 73 provided at junctions between the main transport path 71 and the diverged paths, and a plurality of tracking sensors 74 which detect the passage of the banknotes. The first transport unit 7 transports the banknotes in the direction parallel to their shorter edges. The first transport unit 7 is an exemplary transport unit.

The main transport path 71 extends from the intake rollers 23 through the first bundling stacker 4A. The first diverged path 72*a* is the most upstream path in the main transport path 71, and the second, third, and fourth diverged paths 72*b*, 72*c* and 72*d* are arranged in this order downstream of the first diverged path 72*a*. When it is not necessary to distinguish the first to fourth diverged paths 72*a* to 72*d* from each other, they will be hereinafter referred to as "diverged paths 72." The first diverged path 72*a* extends to reach the reject stacker 6. The second diverged path 72*b* extends to reach the second non-bundling stacker 5B. The third diverged path 72*c* extends to reach the first non-bundling stacker 5A. The fourth diverged path 72*d* extends to reach the second bundling stacker 4B.

The sorting mechanisms 73 are driven by a solenoid (not shown). Each of the sorting mechanisms 73 sorts the banknotes transported through the main transport path 71 depending on whether they need to be diverged to an associated one of the diverged paths 72 or not. A tracking sensor 74 is provided upstream of each of the sorting mechanisms 73. The tracking sensors 74 are configured in the same manner as the banknote sensor 25. That is, the tracking sensors 74 can detect the passage of the banknotes if the reception of light by the receiver of the tracking sensor 74 is temporarily interrupted and then resumed. In guiding the banknotes to the diverged path 72, each sorting mechanism 73 is turned ON as soon as the tracking sensor 74 immediately upstream thereof detects the passage of the banknotes.

The recognition unit 3 is provided on the main transport path 71 upstream of the first diverged path 72*a*. The recognition unit 3 is configured to recognize each of the banknotes being transported in terms of their denomination, authenticity, and fitness. Although not shown in detail, the recognition unit 3 is provided as an integrated unit in the banknote handling apparatus 100, and is provided with its own control circuit board separately from the control unit 120 which performs overall control on the entire banknote handling apparatus 100. This control circuit board includes a recognition template 33 (see FIG. 14) which stores information to be used to recognize banknotes and which is referred to by the recognition unit 3 that is going to recognize the given banknote. The recognition unit 3 also includes a line sensor 31 and a magnetic sensor 32, and detects the feature of each banknote. The recognition unit 3 determines whether the feature of the banknote thus detected corresponds with any of the features of the banknotes stored in the recognition template 33, thereby making a determination about their denomination, authenticity, and fitness.

The recognition unit 3 does not always include the line sensor and the magnetic sensor, but may include any other suitable sensor such as an infrared sensor or an ultraviolet sensor as long as they can detect the features of the banknotes. The line sensor 31 also has the function of optically reading the serial numbers printed on the banknotes. The recognition unit 3 may have the function of recognizing the serial numbers that have been read by the line sensor 31. Alternatively, a serial number recognition unit may be provided separately from the recognition unit 3. Note that a control unit 120 to be described later may perform all of the functions of the recognition unit 3 but the detecting function.

The bundling unit 9 bundles the stacked banknotes. As will be described in detail later, the bundling unit 9 forms a tape loop L from a tape, and rewinds the tape after the banknotes have been transported into the tape loop L so that the banknotes are bundled with the tape.

The second transport unit 8 grips the banknotes stacked in the bundling stacker 4 to transport the banknotes into the tape loop L. The second transport unit 8 includes a gripper 81 which grips the banknotes, a first horizontal displacement mechanism which displaces the gripper 81 in the horizontal direction parallel to the shorter edges of the banknotes (this direction will be hereinafter referred to as a "first horizontal direction"), a second horizontal displacement mechanism which displaces the gripper 81 in the horizontal direction parallel to the longer edges of the banknotes (hereinafter referred to as a "second horizontal direction"), and a vertical displacement mechanism which displaces the gripper 81 in the vertical direction. The second transport unit 8 is an exemplary paper sheet transport unit.

Figure 19A:
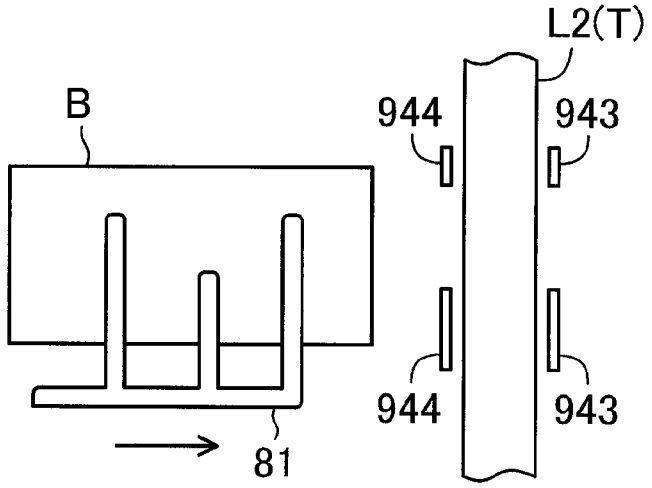
Figure 19B:
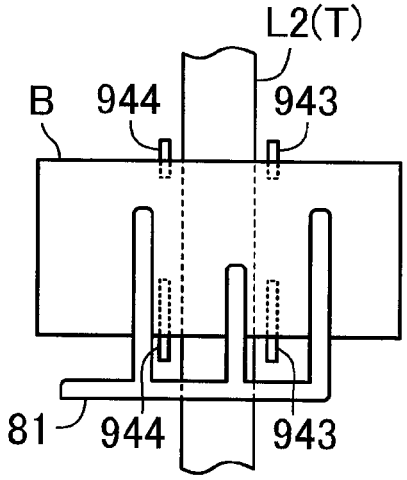
Figure 19C:
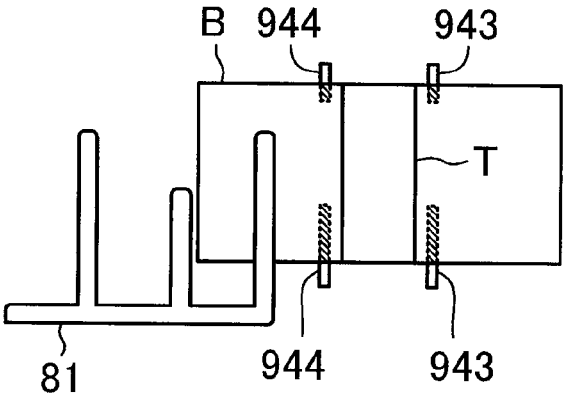

The gripper 81 includes an upper arm 81*a*, a lower arm 81*b* facing the upper arm 81*a*, and a gripping mechanism which displaces the upper arm 81*a* in the vertical direction. As shown in FIGS. 19A-19C and other drawings, the upper arm 81*a* includes three fingers extending parallel to each other and a coupling portion which couples the three fingers together. Likewise, the lower arm 81*b* also has three fingers extending parallel to each other and a coupling portion which couples the three fingers together. The gripping mechanism supports the upper arm 81*a* so that the upper arm 81*a* is movable in the vertical direction, and moves the upper arm 81*a* in the vertical direction using a motor and a drive belt. This configuration allows the upper and lower arms 81*a* and 81*b* to grip the banknotes.

The first horizontal displacement mechanism supports the gripper 81 so that the gripper 81 is movable in the first horizontal direction, and displaces the gripper 81 in the first horizontal direction using the motor and the drive belt.

The vertical displacement mechanism supports the first horizontal displacement mechanism so that the first horizontal displacement mechanism is movable in the vertical direction, and displaces the first horizontal displacement mechanism in the vertical direction using the motor and the drive belt.

The second horizontal displacement mechanism supports the vertical displacement mechanism so that the vertical displacement mechanism is movable in the second horizontal direction, and displaces the vertical displacement mechanism in the second horizontal direction using the motor and the drive belt.

Thus, the gripper 81 is configured to be readily moved along three orthogonal axes by the first and second horizontal displacement mechanisms and the vertical displacement mechanism.

The third transport unit 10 transports the bundled banknotes to the dispense unit 11. The third transport unit 10 includes an upper gripping part 101, a lower gripping part 102, and a horizontal displacement mechanism which displaces the upper and lower gripping parts 101 and 102 in the first horizontal direction. In displacing the upper gripping part 101 in the first horizontal direction, the horizontal displacement mechanism displaces the upper gripping part 101 in the vertical direction, too. That is, the third transport unit 10 is configured to pass beside the bundling unit 9 in the first horizontal direction. When the third transport unit 10 is positioned opposite to the dispense unit 11 relative to the bundling unit 9, the upper gripping part 101 is positioned over, and sufficiently distant from, the lower gripping part 102. The upper gripping part 101 moves downward from this position as it approaches the bundled banknotes in the bundling unit 9. Then, when the upper gripping part 101 reaches the bundled banknotes, the bundled banknotes are gripped by the upper and lower gripping parts 101 and 102. The upper and lower gripping parts 101 and 102 transport the bundled banknotes to the vicinity of the dispense unit 11 while gripping them. In the vicinity of the dispense unit 11, the upper gripping part 101 moves upward as it approaches the dispense unit 11. As a result, the bundled banknotes gripped by the upper and lower gripping parts 101 and 102 are released from the upper and lower gripping parts 101 and 102 at the dispense unit 11, and are dispensed to the dispense unit 11.

On the second side surface 124 of the housing 12, as shown in FIG. 9, a touch panel 17 is provided to serve as an operating unit through which information is entered into the banknote handling apparatus 100 and as a display unit which displays information about the banknote handling apparatus 100. The touch panel 17 is a human interface for the operator who operates this banknote handling apparatus 100.

<Detailed Configuration of Bundling Stacker 4>

Figure 11:
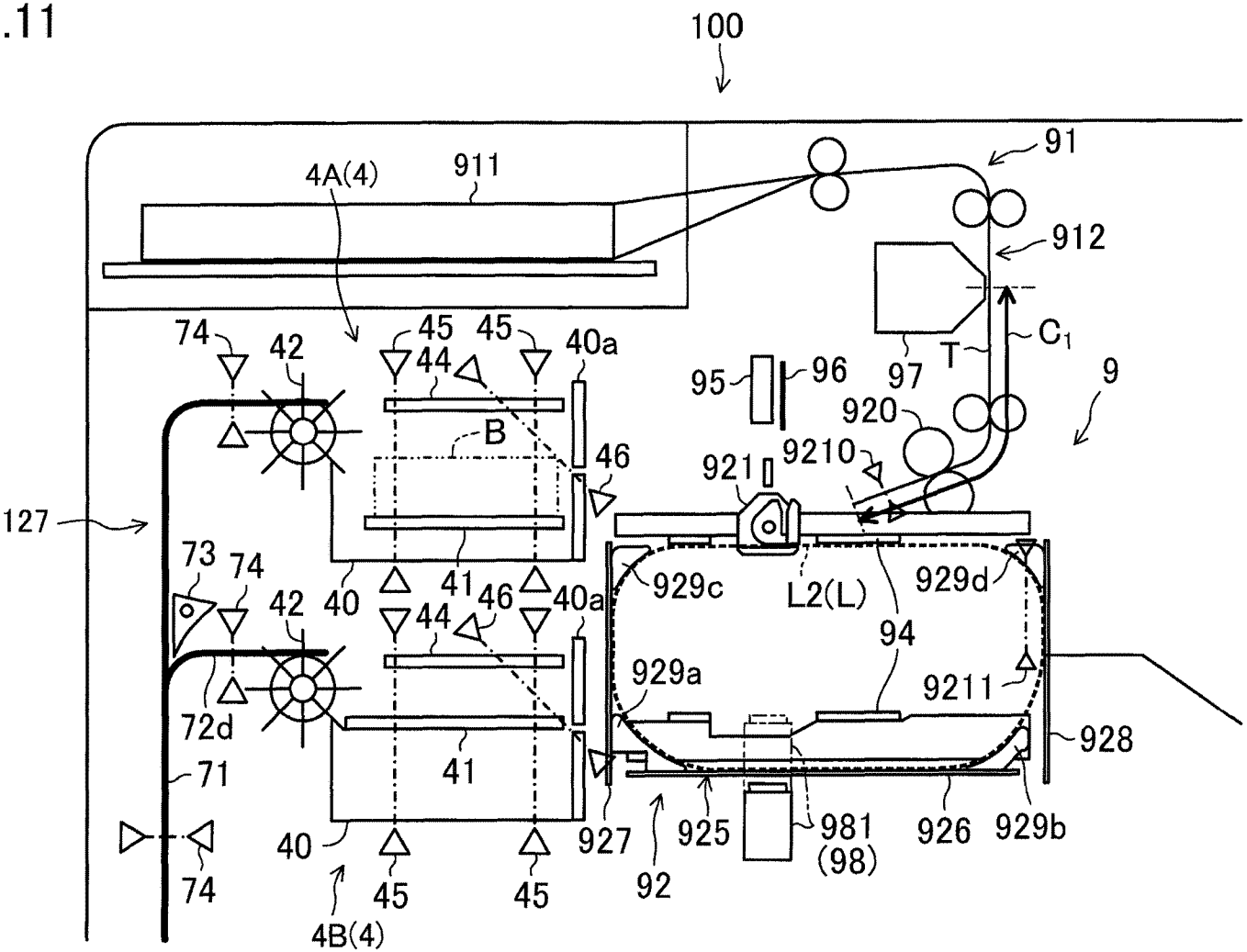
FIG. 11 illustrates a general configuration for bundling stackers and a bundling unit.

FIG. 11 illustrates a general configuration for the bundling stackers 4 and the bundling unit 9.

The bundling stackers 4 pile and stack banknotes B. As shown in FIGS. 9-11, each of the bundling stackers 4 includes a container 40 in which the banknotes B are stacked, a stage 41 arranged in the container 40 to carry the banknotes B thereon, a stacking wheel 42 which brings the transported banknotes B into the container 40, a door 43 which opens/closes the first outlet 47 to be described later, a top plate 44 which determines a ceiling of the container 40, a first banknote sensor 45 which detects the banknotes B in the container 40, and a second banknote sensor 46 which detects the banknotes B of a predetermined height in the container 40.

The container 40 has a front wall 40*a* which is located in front in the transport direction of the banknotes B and is configured to be movable forward and backward in the transport direction. The position of the front wall 40*a* is adjusted according to the dimension of the shorter edges of the banknotes B specified as those to be bundled. In particular, the front wall 40*a* is arranged such that the banknotes B brought into the container 40 collide against the front wall 40*a* and fall as they are to the bottom of the container 40 so as to be stacked there in contact with the front wall 40*a*. The front wall 40*a* is also configured to open/close in the vertical direction. The front wall 40*a* opens when the stacked banknotes B are transported by the second transport unit 8.

The stage 41 is configured to be movable in the vertical direction. For example, the stage 41 moves in the vertical direction in accordance with the amount of the banknotes B stacked.

The container 40 has an opening through the second side surface 124 of the housing 12. That is, the first outlet 47 through which the banknotes B stacked in the bundling stackers 4 are removed out of the housing 12 is provided through the second side surface 124 as shown in FIG. 9.

The door 43 is provided for each of the bundling stackers 4. The door 43 is configured to be rotatable around a predetermined rotation axis to change between an open state where the first outlet 47 is opened and a closed state where the first outlet 47 is closed, and is opened/closed manually. The door 43 is made of a material which allows visual check of the inside of the bundling stacker from outside. For example, the door 43 may be made of a transparent or translucent material (e.g., glass or a resin).

The stacking wheel 42 includes a plurality of flexible blades, and has the function of tapping the banknotes B falling into the container 40 on their rear edges in the transport direction so as to help the banknotes B fall. Even when the banknotes B are brought into the container 40 successively, each of the banknotes B is prevented from being inserted below the rear edge of the preceding banknote B, and thus the banknotes B can be sequentially stacked one by one on top of the previously stacked ones.

Two or more first banknote sensors 45 are provided for each of the bundling stackers 4. In the present embodiment, two first banknote sensors 45 are provided in the container 40 at different positions in the transport direction of the banknotes B. The first banknote sensor 45 is configured in the same manner as the banknote sensor 25. Each of the first banknote sensors 45 is arranged to project light in the stacking direction of the banknotes B in the container 40. That is to say, the first banknote sensor 45 can detect the presence of the banknotes B in the container 40 when the light is blocked. The provision of the two first banknote sensors 45 at the different positions in the transport direction enables any one of the first banknote sensors 45 to detect the presence of the banknotes B even when the positions of the banknotes B vary in the transport direction in the container 40. Note that two or more first banknote sensors 45 may be provided at different positions in the direction orthogonal to both of the transport and thickness directions of the banknotes B (the direction coming out of the paper of FIG. 10).

The second banknote sensor 46 is configured to detect the banknotes B located at a predetermined height in the container 40. The second banknote sensor 46 is configured in the same manner as the banknote sensor 25. The second banknote sensor 46 is arranged such that light emitted from the transmitter to the receiver is blocked by the banknotes B when the banknotes B are present at a level higher than the predetermined height, and that the light emitted from the transmitter is received by the receiver when the banknotes B are not present at any level higher than the predetermined height.

<Detailed Configuration of Bundling Unit 9>

As shown in FIG. 11, the bundling unit 9 includes a tape feeding unit 91 which feeds a tape T, a tape loop forming unit 92 which forms a tape loop L from the tape T, a clamp 94 which presses the banknotes B in the stacking direction when the banknotes B are bundled together with the tape T, a heater 95 which heat-seals portions of the tape T wound around the banknotes B, a cutter 96 which cuts the tape T at a portion not wound around the banknotes B, a printer 97 which prints characters on the tape T, and a stamper 98 which stamps a seal on the tape T. The bundling unit 9 functions as an exemplary processing unit and as an exemplary stacking and bundling unit.

The tape feeding unit 91 includes a tape reel 911 around which the tape T is wound, and a tape transport unit 912 which transports the tape T drawn from the tape reel 911. The tape transport unit 912 transports the tape T along a predetermined transport path. The tape transport unit 912 has a guide (not shown) and multiple pairs of rollers.

The tape loop forming unit 92 forms a tape loop L from the tape T, and rewinds the tape T after the stacked banknotes B have been arranged in the tape loop L to wind the tape T around the banknotes B. The tape loop forming unit 92 includes a pair of feed rollers 920 which feeds and rewinds the tape T, a tape gripping part 921 which grips an end portion of the tape T, a guide 925 which defines the shape of the tape loop L being formed from the tape T, a first tape sensor 9210 which detects the end portion of the tape T, and a second tape sensor 9211 which detects that a large tape loop L2 has been formed. The tape loop forming unit 92 has a small tape loop L1 formed from the tape T by the tape gripping part 921, and then has the tape T fed by the pair of feed rollers 920 to enlarge the small tape loop L1 into a large tape loop L2. In the meantime, the guide 925 guides the tape T to define the shape of the large tape loop L2, and the second tape sensor 9211 detects that the large tape loop L2 has been formed.

The pair of feed rollers 920 is driven by a tape feed motor 9212 (see FIG. 14), and feeds the tape T in forming the tape loop L. The pair of feed rollers 920 is located at the downstream end of the tape transport unit 912, and forms part of the tape transport unit 912. The pair of feed rollers 920 is an exemplary feeder. A pair of rollers of the tape transport unit 912 is also driven by the tape feed motor 9212 through a belt, a gear, or any other suitable mechanism.

The tape reel 911 is further provided with a tape reel motor 9111 (see FIG. 14) which rotates the tape reel 911 in the direction in which the tape T is rewound. When the tape T is going to be wound around the banknotes B that have been arranged into the tape loop L, this tape reel motor 9111 and the tape feed motor 9212 rotate in such a direction as to rewind the tape T. The tape feed motor 9212 and the tape reel motor 9111 are each implemented as a stepping motor.

The first tape sensor 9210 is provided on the transport path of the tape T between the pair of feed rollers 920 and the tape gripping part 921. The first tape sensor 9210 is configured in the same manner as the banknote sensor 25. The first tape sensor 9210 detects the tape T when the light is blocked. For example, the first tape sensor 9210 may detect the end portion of the tape T when the light that has been blocked starts being received again by the first tape sensor 9210 as the pair of feed rollers 920 rewinds the tape T.

Figure 17:
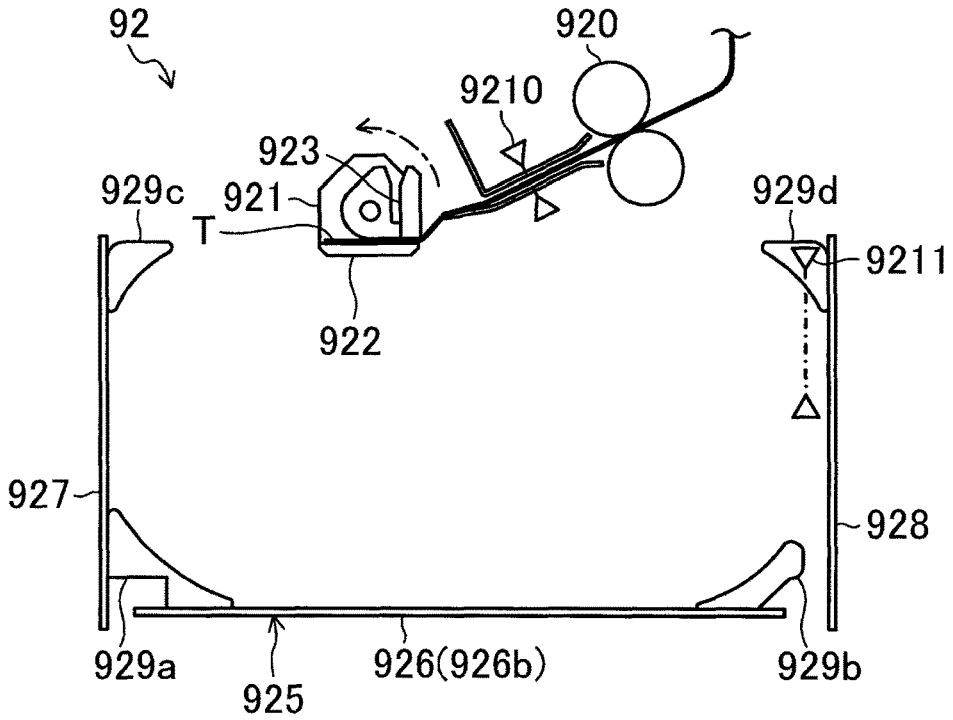
FIG. 17 illustrates a state where a tape gripping part has gripped an end portion of the tape.
Figure 18:
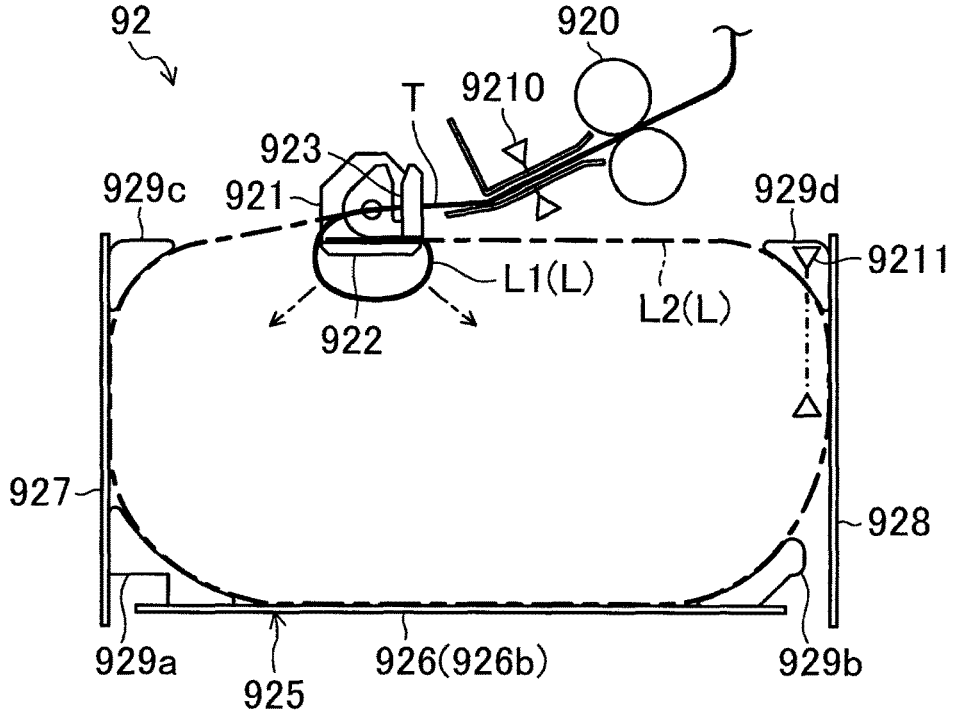
FIG. 18 illustrates a state where the tape gripping part has formed a small tape loop and a large tape loop.

The tape gripping part 921 is arranged at a position where the tape gripping part 921 can receive the tape T fed from the pair of feed rollers 920. The tape gripping part 921 is configured to be able to grip the tape T between a base plate 922 and a movable part 923 and to be rotatable while gripping the tape T as shown in FIGS. 17 and 18. The tape gripping part 921 rotates while gripping, at the end portion thereof, the tape T fed from the pair of feed rollers 920, thereby forming the tape loop L.

In forming the large tape loop L2, the guide 925 comes into contact with an outer peripheral surface of the large tape loop L2 to define the shape of the large tape loop L2. The guide 925 defines the shape of the large tape loop L2 to be a generally rectangular shape, more specifically, a rectangular shape having rounded corners.

Figure 12:
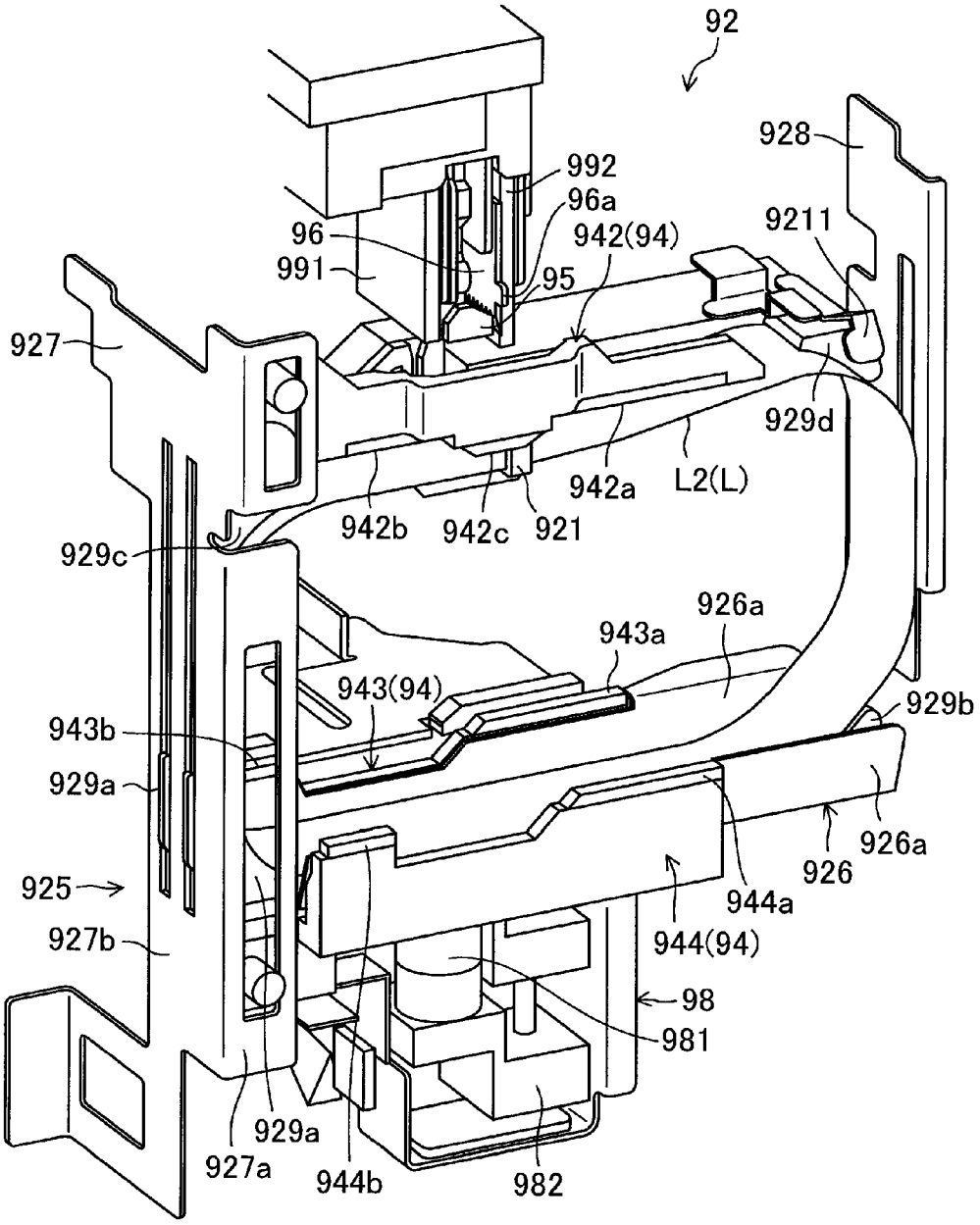
FIG. 12 is a perspective view illustrating a tape loop forming unit.

FIG. 12 illustrates a perspective view of the tape loop forming unit 92. The guide 925 includes a lower guide 926 which comes into contact with the outer peripheral surface of the large tape loop L2 from under the large tape loop L2, first and second lateral guides 927 and 928 which come into contact with the outer peripheral surface of the large tape loop L2 horizontally, and four corner guides, namely, first to fourth corner guides 929*a* to 929*d*, which correspond to the four corners of the rectangle.

Figure 20:
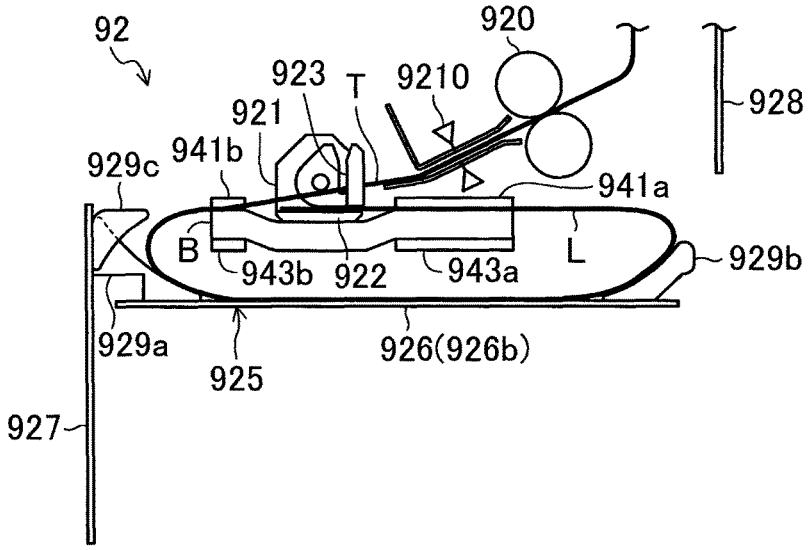
FIG. 20 illustrates a state of a guide when the clamp presses the banknotes.
Figure 21:
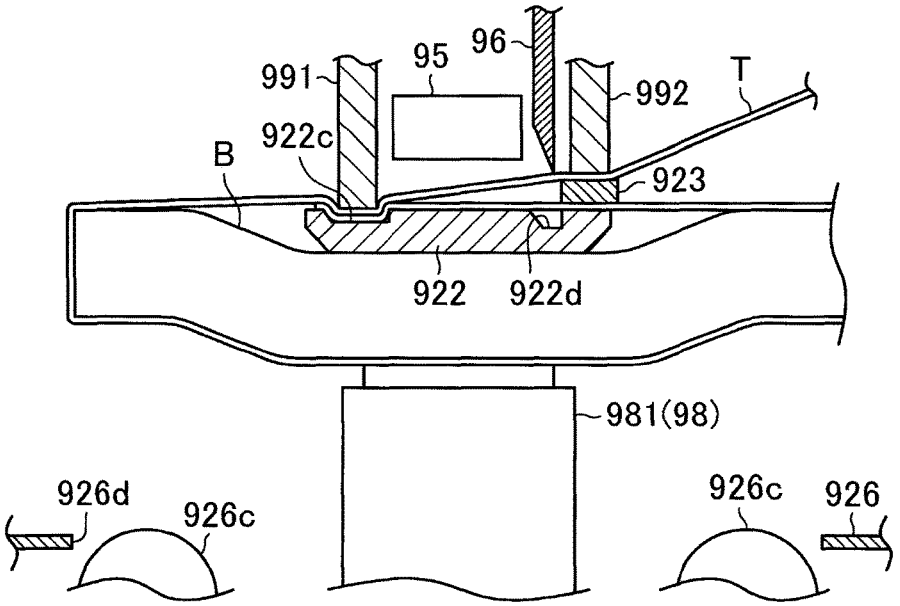
FIG. 21 illustrates how the tape is bonded and cut, and a seal is stamped on the tape.

The lower guide 926 has a pair of sidewalls 926*a* which regulates the position of the tape T in the tape width direction and a bottom wall 926*b* (see FIGS. 17, 18, and 20), and thus has the shape of a groove. The bottom wall 926*b* is broader than the width of the tape. As shown in FIG. 21, the bottom wall 926*b* is provided with a plurality of rollers 926*c* to improve slidability of the tape T. The bottom wall 926*b* has a through hole 926*d* through which a stamp 981 of the stamper 98 (to be described later) passes. The first and second corner guides 929*a* and 929*b* are respectively provided at the longitudinal ends of the bottom wall 926*b*. The first corner guide 929*a* curves the tape T located at the corner formed by the lower guide 926 and the first lateral guide 927. The second corner guide 929*b* curves the tape T located at the corner formed by the lower guide 926 and the second lateral guide 928. Each of the first and second corner guides 929*a* and 929*b* is made up of two plates (see FIG. 12 as well). Each of the two plates has an edge curved in a concave shape, and the two plates are provided to stand upright on the bottom wall 926*b* and face each other.

The lower guide 926 is provided with a displacement mechanism, and is configured to be readily moved in the vertical direction by the displacement mechanism. The displacement mechanism also functions as a displacement mechanism for lower clamps which will be described later.

The first lateral guide 927 extends in the vertical direction at one of longitudinal ends of the lower guide 926 closer to the bundling stacker 4. The first lateral guide 927 includes a sidewall 927*a* and a bottom wall 927*b*, and thus has the shape of a groove. The sidewall 927*a* regulates the position of the tape T in the tape width direction. The bottom wall 927*b* is broader than the width of the tape. The bottom wall 927*b* is provided with two slits through which the first corner guide 929*a* passes.

The second lateral guide 928 extends in the vertical direction at the other longitudinal end of the lower guide 926 closer to the dispense unit 11. The second lateral guide 928 is substantially in the shape of a flat plate, and does not have a portion corresponding to the sidewall 927*a* of the first lateral guide 927. The second lateral guide 928 is supported to be movable up and down by the support, and is coupled to the lower guide 926 through the link. Thus, the second lateral guide 928 moves upward or downward as the lower guide 926 moves upward or downward. Note that the magnitude of movement of the second lateral guide 928 is amplified by the link. The second lateral guide 928 is configured to retreat upward during the transportation of the bundled banknotes B so as not to interfere with the transportation of the bundled banknotes B.

A third corner guide 929*c* and a fourth corner guide 929*d* are provided above the first and second corner guides 929*a* and 929*b* at almost the same level as the tape gripping part 921. The third corner guide 929*c* is arranged adjacent to the first lateral guide 927. The third corner guide 929*c* has two plates although not shown in detail. Each of the two plates has an edge curved in a concave shape, and the two plates are provided to stand upright on the bottom wall 927*b* and face each other. The fourth corner guide 929*d* is arranged adjacent to the second lateral guide 928. The fourth corner guide 929*d* is formed of a block having a surface curved in a concave shape. When it is not necessary to distinguish the first to fourth corner guides 929*a* to 929*d* from each other, they may be hereinafter referred to as "corner guides 929" collectively.

The second tape sensor 9211 is configured in the same manner as the banknote sensor 25, and detects the tape T when the light is blocked. The receiver of the second tape sensor 9211 is attached to the fourth corner guide 929*d* as shown in FIG. 12. The transmitter of the second tape sensor 9211 is arranged such that the light emitted from the transmitter is blocked by the tape T guided along the fourth corner guide 929*d*. That is, the second tape sensor 9211 detects that the fourth corner guide 929*d* is guiding the tape T, i.e., the tape loop L has reached a predetermined size, when the light emitted from the transmitter is not received by the receiver.

Figure 13:
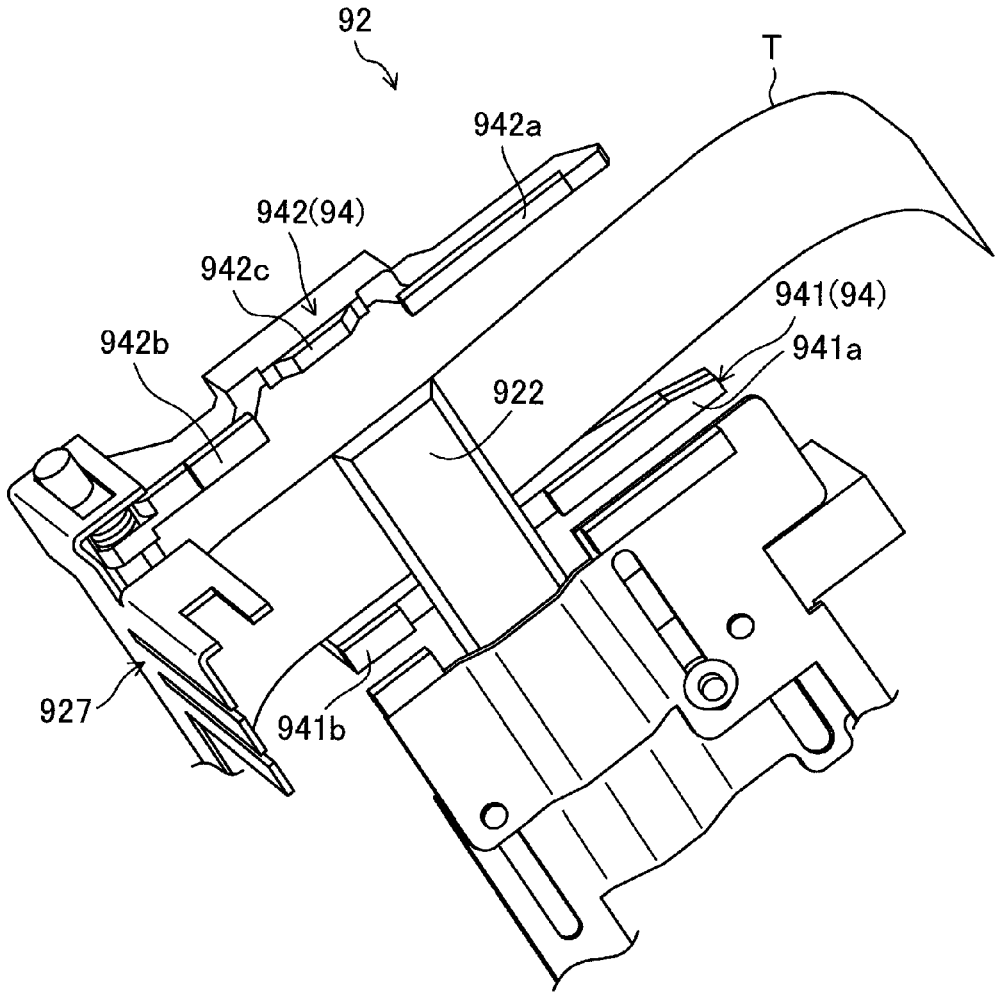
FIG. 13 is a perspective view illustrating an upper portion of the tape loop forming unit as viewed obliquely from below.

The clamp 94 presses the banknotes B in the stacking direction when the banknotes B are bundled together with the tape T. The clamp 94 presses the banknotes B around their portion to be bundled with the tape T. The clamp 94 includes, as shown in FIGS. 12 and 13, a pair of upper clamps 941, 942 provided above the banknotes B transported into the tape loop L, a pair of lower clamps 943, 944 provided below the banknotes B, and a displacement mechanism which allows one of the upper clamps 942 and the lower clamps 943, 944 to move up and down.

The upper clamps 941, 942 are arranged on the respective sides of the tape T in the tape width direction. The upper clamp 941 located more distant from the second transport unit 8 is fixed, and is not movable up or down. On the other hand, the upper clamp 942 located closer to the second transport unit 8 is configured to be movable up and down. When it is necessary to distinguish the upper clamps from each other, the former will be hereinafter referred to as an "upper fixed clamp 941," and the latter will be hereinafter referred to an "upper movable clamp 942."

The upper fixed clamp 941 includes first and second abutting portions 941*a*, 941*b*. The first and second abutting portions 941*a*, 941*b* are arranged side by side in the direction parallel to the shorter edges of the banknotes B. The first and second abutting portions 941*a* and 941*b* are located at the same level. The base plate 922 of the tape gripping part 921 is arranged between the first and second abutting portions 941*a* and 941*b*. The base plate 922 is located at a lower level than the first and second abutting portions 941*a*, 941*b*.

On the other hand, the upper movable clamp 942 includes first to third abutting portions 942*a* to 942*c*. The first to third abutting portions 942*a* to 942*c* are arranged side by side in the direction parallel to the shorter edges of the banknotes B. The third abutting portion 942*c* is located between the first and second abutting portions 942*a* and 942*b* in the direction parallel to the shorter edges of the banknotes B. The first and second abutting portions 942*a* and 942*b* are located at the same level. The third abutting portion 942*c* is located at a lower level than the first and second abutting portions 942*a* and 942*b*. The upper movable clamp 942 moves up and down between a clamp position where the first and second abutting portions 942*a* and 942*b* are level with the first and second abutting portions 941*a* and 941*b* of the upper fixed clamp 941, and a retreat position where the third abutting portion 942*c* is at a higher level than the first and second abutting portions 941*a* and 941*b* of the upper fixed clamp 941. When the upper movable clamp 942 is at the clamp position, the third abutting portion 942*c* is located at substantially the same level as the base plate 922*a* of the tape gripping part 921.

The lower clamps 943, 944 are arranged on the respective sides of the tape T in the tape width direction. The lower clamp 943 located more distant from the second transport unit 8 and the lower clamp 944 located closer to the second transport unit 8 are configured in the same manner. The lower clamp 943 includes first and second abutting portions 943*a*, 943*b*. The first and second abutting portions 943*a*, 943*b* are arranged side by side in the direction parallel to the shorter edges of the banknotes B. The first and second abutting portions 943*a* and 943*b* are located at the same level. The first and second abutting portions 943*a*, 943*b* respectively face the first and second abutting portions 941*a*, 941*b* of the upper fixed clamp 941. The lower clamp 944 includes first and second abutting portions 944*a*, 944*b*. The first and second abutting portions 944*a*, 944*b* are arranged side by side in the direction parallel to the shorter edges of the banknotes B. The first and second abutting portions 944*a* and 944*b* are located at the same level, and also at the same level as the first and second abutting portions 943*a* and 943*b* of the lower clamp 943. The first and second abutting portions 944*a*, 944*b* respectively face the first and second abutting portions 942*a*, 942*b* of the upper movable clamp 942.

The lower clamps 943, 944 are configured to be movable up and down. In this embodiment, the lower clamps 943, 944 are attached to the lower guide 926 of the guide 925, and move up and down together with the lower guide 926. In other words, the displacement mechanism which displaces the lower clamps 943, 944 in the vertical direction also functions as the displacement mechanism for the lower guide 926.

The heater 95 bonds together portions of the tape T wound around the banknotes B. The heater 95 heat-seals such portions of the tape T. The heater 95 is an exemplary bonding unit.

The cutter 96 cuts a portion of the tape T not wound around the banknotes B, that is, an excessive portion of the tape T that has not been used to bundle the banknotes B together with the tape T. The cutter 96 has a saw-toothed cutting edge at its end. The cutter 96 has guiding tabs 96*a* protruding outward from its side edges as shown in FIG. 12. The cutter 96 is an exemplary cutting unit.

The heater 95 and the cutter 96 are configured as a unit, and is arranged opposite to the stamper 98 relative to the banknotes B brought into the tape loop L, that is, opposite to the stamper 98 in the stacking direction of the banknotes B, i.e., above the tape gripping part 921.

More specifically, the heater 95 and the cutter 96 are configured as a unit together with first and second tape pressers 991, 992. The first and second tape pressers 991, 992 are arranged side by side in the first horizontal direction. Each of the first and second tape pressers 991, 992 is a flat plate member, and has a lower end face extending in the tape width direction. The heater 95 and the cutter 96 are arranged between the first and second tape pressers 991, 992.

The heater 95, the cutter 96, and the first and second tape pressers 991 and 992 are configured to be movable up and down. The heater 95, the cutter 96, and the first and second tape pressers 991 and 992 move down toward the tape gripping part 921 in bonding and cutting the tape T. The first tape presser 991 is configured to fit in the first recessed groove 922*c* of the base plate 922 so that the tape T is sandwiched between itself and the bottom surface of the first recessed groove 922*c* as shown in FIG. 21. The second tape presser 992 is configured to sandwich the tape T between itself and the movable part 923. The heater 95 bonds the tape T between the first and second recessed grooves 922*c* and 922*d* of the base plate 922. The cutter 96 enters the second recessed groove 922*d* of the base plate 922 to cut the tape T.

The printer 97 is arranged in the tape transport unit 912 as shown in FIG. 11. The printer 97 includes a print head which prints characters on the tape T transported by the tape transport unit 912. The printer 97 prints, for example, information about the banknotes B to be bundled (e.g., denomination, date, and/or serial number) on the tape T. The information printed on the tape T may be used as an identifier to identify the bundle of banknotes bundled together. The print made by the printer 97 is shifted in the tape width direction from a portion on which a seal will be stamped by the stamper 98 so that the print does not overlap with the seal stamped by the stamper 98.

The stamper 98 stamps a seal on the tape T wound around the banknotes B compressed by the clamp 94. The stamper 98 stamps a seal related to the banknotes B to be bundled (e.g., a seal of a financial institution, a seal indicating the kind of the banknotes such as fit or unfit notes) on the tape T. The stamper 98 is arranged opposite to the heater 95 and the cutter 96 relative to the banknotes B brought into the tape loop L as shown in FIG. 12, in particular, opposite to the heater 95 and the cutter 96 in the stacking direction of the banknotes B. The stamper 98 includes a stamp 981 and a displacement mechanism 982 which displaces the stamp 981 in the vertical direction. When the displacement mechanism 982 displaces the stamp 981 upward, the stamp 981 stamps a seal on the tape T wound around the banknotes B in the stacking direction of the banknotes B. The stamper 98 forms an integral part of the lower guide 926, and moves up and down along with the lower guide 926 that is moving up and down. The stamp 981 is arranged between the pair of sidewalls 926*a* of the lower guide 926 in the direction parallel to the shorter edges of the lower guide 926, i.e., in the width direction of the tape T. The stamp 981 is switched by the displacement mechanism 982 between a retreat position (indicated by the solid lines in FIG. 11) where the stamp 981 is located under the through hole 926*d* of the bottom wall 926*b* of the lower guide 926 and a protrusion position (indicated by the phantom lines in FIG. 11) where the stamp 981 protrudes upward from the bottom wall 926*b*. When the stamp 981 is moved upward by the displacement mechanism 982 with the lower guide 926 located above the stamp 981, the stamp 981 goes through the through hole 926*d* to protrude upward from the bottom wall 926*b*, thereby stamping a seal on the tape T (see FIG. 21 as well).

The stamp 981 is disposed at the retreat position while the banknote handling apparatus 100 is ON and performing the counting process and/or the bundling processing. In this manner, the stamp 981 may be prevented from stamping a seal on the tape T by mistake while the guide 925 is guiding the tape T. On the other hand, while the banknote handling apparatus 100 is in a standby state (where the guide 925 is not guiding the tape T, in particular) and is not performing the counting processing and/or the bundling processing, the stamp 981 may be disposed at either the retreat position or the protrusion position. Furthermore, if the stamp 981 is disposed at the retreat position while the banknote handling apparatus 100 is in the standby state, the stamp 981 may be moved to the protrusion position through a tap on the touch panel 17, for example. Alternatively, if the housing 12 is opened to uncover the inside of the apparatus, the stamp 981 may be moved to the protrusion position upon the detection of that opening. If the stamp 981 is moved to the protrusion position, the user is allowed to check the stamp 981 with his or her own eyes when the housing 12 is opened to uncover the inside of the apparatus. This facilitates doing various kinds of maintenance on the stamp 981 such as filling the stamp 981 with ink or replacing the stamp 981 with a new one.

Also, while the banknote handling apparatus 100 is OFF, the stamp 981 may be disposed at the protrusion position where the stamp 981 protrudes upward from the bottom wall 926 with the maintenance to be done on the stamper 98 taken into consideration.

A fall detecting sensor 99 for detecting the fall of a banknote is provided near the bundling unit 9. In the vicinity of the bundling unit 9, the gripper 81 of the second transport unit 8 performs the operation of gripping and transporting bundles of banknotes or the operation of changing the bundles of banknotes to grip as will be described in detail later. Thus, in the vicinity of the bundling unit 9, either a bundle of banknotes or some of the banknotes included in a bundle may fall. This banknote handling apparatus 100 is configured to abort its processing when the fall detecting sensor 99 detects the fall of a banknote.

The fall detecting sensor 99 has the same or similar configuration to the banknote sensor 25 and other sensors. When a fallen banknote blocks transmitting light, the fall detecting sensor 99 detects that the banknote has fallen in the vicinity of the bundling unit 9. In the example illustrated in FIG. 10, the fall detecting sensor 99 includes five pairs of fall detecting sensors 99*a*-99*e*, each being comprised of a transmitter and a receiver. The respective pairs of fall detecting sensors 99*a*-99*e* are arranged such that the light beams emitted from them are transmitted in mutually different directions, thus minimize eliminating a blind spot for the fall detecting sensor 99 as much as possible.

<System Configuration for Banknote Handling Apparatus>

Figure 14:
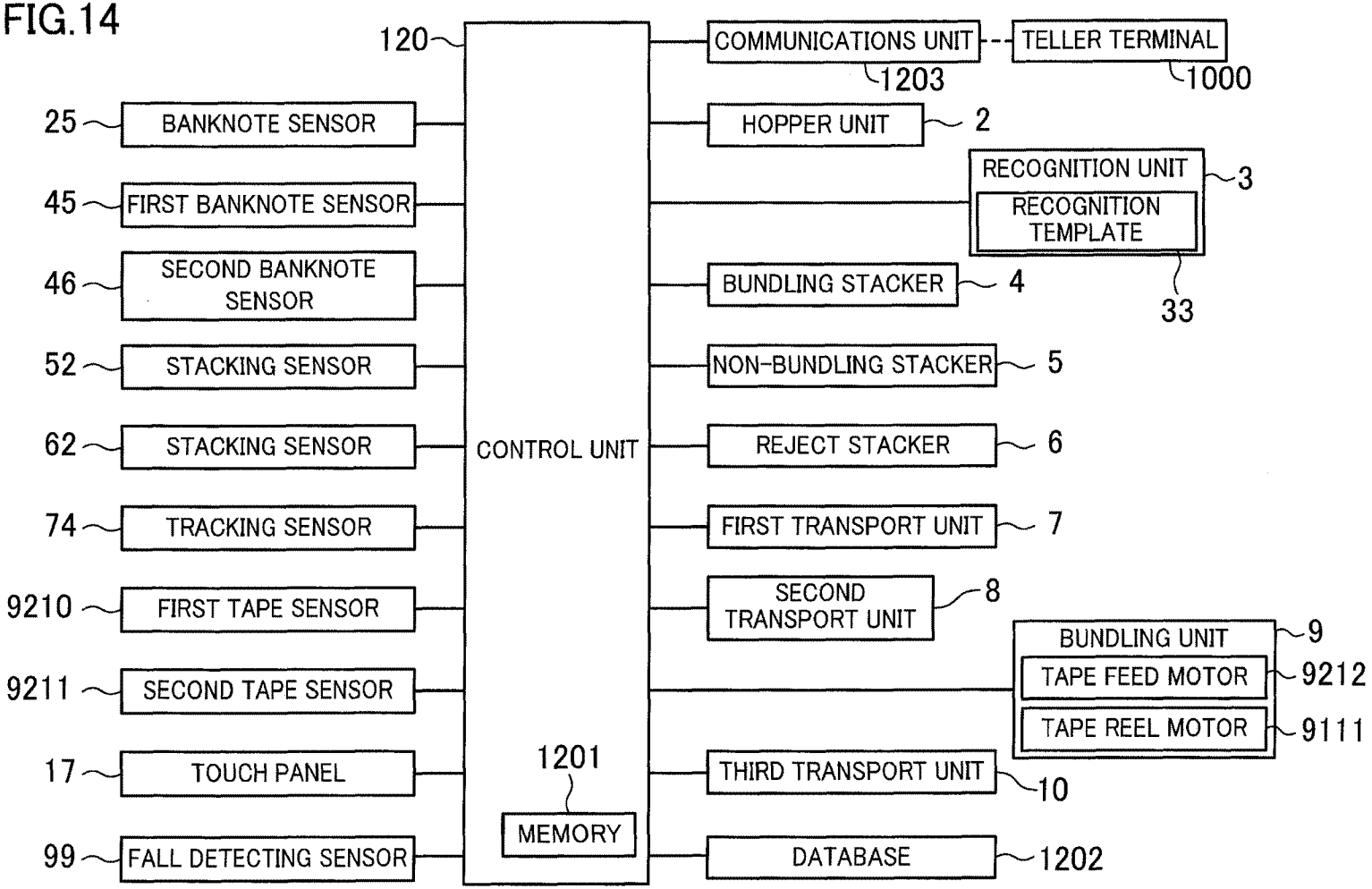
FIG. 14 is a block diagram illustrating a general configuration for the banknote handling apparatus.

FIG. 14 is a block diagram illustrating a general configuration for the banknote handling apparatus 100.

The banknote handling apparatus 100 includes a control unit 120 based on a well-known microcomputer, for example. The control unit 120 includes a memory 1201 which stores various kinds of information. The control unit 120 is connected to the above-described units, namely, the hopper unit 2, the recognition unit 3, the bundling stackers 4, the non-bundling stackers 5, the reject stacker 6, the first and second transport units 7 and 8, the bundling unit 9, the third transport unit 10, and the touch panel 17 so as to transmit and receive signals to/from these units. The control unit 120 is also connected to the banknote sensor 25, the first and second banknote sensors 45 and 46, the stacking sensor 52 which determines whether or not there are any banknotes in the non-bundling stackers 5, the stacking sensor 62 which determines whether or not there are any banknotes in the reject stacker 6, the tracking sensors 74, the first and second tape sensors 9210 and 9211, and the fall detecting sensor 99 to receive detection signals from these sensors. The control unit 120 generates a control signal based on the signal supplied from the touch panel 17, the detection signals from the sensors and other suitable signals, and outputs the generated control signal to the hopper unit 2 and other units. The hopper unit 2 and other units operate in accordance with the control signal. Taking the bundling stacker 4 as an example, the control unit 120 controls the front wall 40*a* of the container 40, the stage 41, and the stacking wheel 42. The control unit 120 is an exemplary recovery unit.

A database 1202 is connected to the control unit 120. The database 1202 is provided for this banknote handling apparatus 100 and stores at least results of counting related to deposit processing (i.e., transactions) and information about the serial numbers read from the respective banknotes. The serial number information is stored in association with information to identify a bundle including the banknote. The information to identify the bundle is information to be printed on a tape T that bundles the banknotes together as described above. The database 1202 is also configured to store information about the processing that was carried out in the past by this banknote handling apparatus 100. The database 1202 is an exemplary memory. Note that the range of the data stored in the database 1202 (e.g., data of the transactions for the past half year period) is determined depending on the storage capacity of the database 1202. Furthermore, the banknote handling apparatus 100 is connected to a teller terminal 1000 via a communications unit 1203. The teller terminal 1000 also stores the results of counting related to deposit processing, information about the serial numbers read from the respective banknotes, and information about bundles. The teller terminal 1000 has a larger storage capacity (i.e., may store a greater deal of information (or information about older transactions)) than the database 1202 of the banknote handling apparatus 100. The teller terminal 1000 corresponds to a database provided outside of the housing 12 of the banknote handling apparatus 100. The teller terminal 1000 is also an exemplary memory.

<Working Mechanism of Banknote Handling Apparatus>

It will be described how to perform deposit processing using this banknote handling apparatus 100. In the deposit processing, loose banknotes are sorted and stacked in the predetermined stackers, and predetermined ones of the banknotes are bundled. In the following description, a single kind of banknote bundling processing will be described, in which a predetermined number of banknotes of a prescribed kind to be bundled are stacked alternately in the first and second bundling stackers 4A, 4B, and the predetermined number of banknotes stacked are bundled sequentially by the bundling unit 9.

The banknote handling apparatus 100 is placed on a teller counter to be positioned on the front left side of the operator (on the front right side of a customer) when the operator faces the customer over the teller counter. At this time, the banknote handling apparatus 100 is arranged such that the first side surface 123 of the housing 12 faces the customer. In this state, the second side surface 124 of the housing 12 faces the operator. However, since the banknote handling apparatus 100 is located slightly on the front left side of the operator, the customer can also see the second side surface 124.

First, the operator receives loose banknotes to be deposited from the customer, and places the banknotes on the hopper unit 2. At this time, even if the loose banknotes include banknotes of multiple different kinds, all the banknotes are just placed on the hopper unit 2 without sorting them. The operator adjusts the guides 22 according to the dimension of the banknotes. Then, the operator operates the touch panel 17 to start the intake of the banknotes. The banknote handling apparatus 100 may automatically start the intake of the banknotes when the banknote sensor 25 detects the banknotes placed on the hopper unit 2.

The banknotes placed on the hopper unit 2 are brought into the housing 12 one by one through the inlet 24 as the intake rollers 23 are activated. The banknotes thus taken in are transported by the first transport unit 7, and pass through the recognition unit 3. The recognition unit 3 detects the kind of the banknotes passed, and informs the control unit 120 of the kind of the banknotes. The recognition unit 3 also reads and recognizes the serial numbers of those banknotes. Information about the serial numbers thus recognized is stored in the database 1202.

The control unit 120 designates the banknotes' destination according to the kind of the banknotes. In particular, if the banknotes are fit banknotes of a predetermined denomination to be bundled, the control unit 120 designates the bundling stacker 4 (any one of the bundling stackers 4A and 4B) as their destination. If the banknotes are unfit banknotes of the predetermined denomination to be bundled, the control unit 120 designates the first non-bundling stacker 5A as their destination. If the banknotes are of any denomination other than the predetermined denomination, the control unit 120 designates the second non-bundling stacker 5B as their destination. If the banknotes are rejected banknotes, the control unit 120 designates the reject stacker 6 as their destination.

The control unit 120 controls the first transport unit 7 such that the banknotes are transported to the stacker designated as their destination. In particular, the control unit 120 controls the sorting mechanism 73 corresponding to the diverged path 72 leading to the destination stacker such that the banknotes are guided from the main transport path 71 to the diverged path 72. The control unit 120 switches the sorting mechanism 73 when the tracking sensor 74 just before the diverged path 72 detects the banknotes. In this manner, the banknotes are brought into that stacker.

The banknotes to be transported to the bundling stacker 4 are transported to one of the two bundling stackers 4. When the number of banknotes stacked in one of the bundling stackers 4 reaches a predetermined bundling number (e.g., 100), the remaining banknotes are then transported to the other bundling stacker 4. In this example, the banknotes are intended to be transported to the first bundling stacker 4A first. When the banknotes are transported one after another to the first bundling stacker 4A, the stacking wheel 42 rotates to stack the banknotes one by one. At this time, when the uppermost one of the banknotes on the stage 41 is detected by the second banknote sensor 46, the stage 41 moves downward to a predetermined degree so that the second banknote sensor 46 does not detect any banknotes. Then, when the banknotes are further stacked much enough for the second banknote sensor 46 to detect the banknotes, the stage 41 then moves downward again to the predetermined degree. Performing this series of processing steps a number of times makes it possible to keep the distance for the banknotes falling into the bundling stacker 4 to travel within a predetermined range, thus enabling the banknotes falling freely to be stacked at the same position and with the same orientation.

When the number of banknotes stacked in the first bundling stacker 4A reaches the bundling number, the control unit 120 controls the second transport unit 8 so that the banknotes in the first bundling stacker 4A are gripped by the gripper 81 and transported to the bundling unit 9. Then, the control unit 120 controls the bundling unit 9 so that the banknotes are bundled with the tape T.

When the number of banknotes stacked in the first bundling stacker 4A reaches the bundling number, the remaining banknotes are stacked in the second bundling stacker 4B. Then, when the number of banknotes stacked in the second bundling stacker 4B reaches the bundling number, the remaining banknotes are stacked again in the first bundling stacker 4A. By this time, the banknotes in the first bundling stacker 4A have been all bundled together, and thus the first bundling stacker 4A is now empty. Thus, the provision of the two bundling stackers 4 makes it possible to perform the bundling processing while stacking the banknotes continuously.

Subsequently, the control unit 120 controls the third transport unit 10 so that the bundled banknotes are dispensed through the dispense port 111.

The unfit banknotes of the predetermined denomination are transported to the first non-bundling stacker 5A. Likewise, the banknotes of any denominations other than the predetermined denomination are transported to, and stacked in, the second non-bundling stacker 5B. The rejected banknotes are also transported to, and stacked in, the reject stacker 6.

This series of processing steps will be performed over and over again until there are no banknotes placed on the hopper unit 2. The banknote sensor 25 determines whether banknotes are still present on the hopper unit 2 or not.

When the handling of the banknotes placed on the hopper unit 2 is finished, the rejected banknotes are taken in and recognized again. Specifically, the operator extracts the rejected banknotes from the reject stacker 6, and places them on the hopper unit 2 to take them into the apparatus again. The rejected banknotes are those which were not recognized as normal banknotes for any reason, and thus another attempt is made to take in and recognize them. Banknotes still recognized as rejected banknotes, if any, are restacked in the reject stacker 6. Then, the operator returns those restacked banknotes to the customer.

Note that the banknotes stacked in the first and second non-bundling stackers 5A, 5B are not taken in again.

Thus, when the handling of the banknotes placed on the hopper unit 2 and the re-handling of the rejected banknotes are finished, the single-kind banknote bundling processing is finished, i.e., the counting and sorting of the banknotes passed as those to be deposited by the customer are finished. The touch panel 17 displays the counted amount of the banknotes. The operator asks for a customer's approval of the amount, or checks whether the displayed amount corresponds with the amount written down on a deposit slip by the customer, and, if the answer is YES, the operator operates the touch panel 17 to confirm the deposit amount. When the confirmation has been done, the transaction is completed, and the teller terminal 1000 is informed of the confirmed deposit amount, thereby finishing the deposit processing. The teller terminal 1000 stores not only the deposit amount but also information about the serial numbers of the banknotes that have been subjected to the bundling processing and other types of processing as described above by this banknote handling apparatus 100 in association with information about the bundles including those paper sheets. In the same way, the database 1202 of the banknote handling apparatus 100 also stores information about the serial numbers of the banknotes that have been subjected to the bundling processing and other types of processing in association with information about the bundles including those paper sheets. In this case, the information stored in the database 1202 during the processing is in a provisionally confirmed state. When the transaction has been completed, the stored information will be changed from the provisionally confirmed state into a confirmed state.

After the deposit processing has been finished, the operator removes the bundled banknotes dispensed in the dispense unit 11, the banknotes stacked in the bundling stackers 4, and the banknotes stacked in the non-bundling stackers 5, and stores them in a predetermined storage place.

By performing this series of processing steps, loose banknotes of different kinds are sorted into fit banknotes of a predetermined denomination, unfit banknotes of the predetermined denomination, banknotes of every denomination but the predetermined denomination, and rejected banknotes. The fit banknotes of the predetermined denomination are bundled on a bundling number basis.

<Leftover Mode of Operation of Stackers and Batch Setting>

In the example described above, after the deposit processing has been finished, the banknotes stacked in the bundling stackers 4 and non-bundling stackers 5 are intended to be removed by the operator. That is to say, the banknote handling operation is intended to be performed such that bundles of banknotes processed on a single transaction completed are treated as a different set from bundles of banknotes processed on the next transaction. However, the banknote handling operation may also be performed differently such that banknotes are continuously stacked and bundled over multiple transactions until the number of banknotes bundled reaches a predetermined number, for example.

Thus, this banknote handling apparatus 100 is configured to be switchable between the former mode of operation in which the banknotes stacked in the bundling stackers 4 and non-bundling stackers 5 are removed when a single transaction has been completed and the latter mode of operation in which the banknotes stacked in the bundling stackers 4 and non-bundling stackers 5 are not removed when a single transaction has been completed but continue to be stacked there from the next transaction and on (i.e., a leftover mode of operation). This banknote handling apparatus 100 is configured such that the leftover mode of operation is performed by the bundling stackers 4 only, or by the non-bundling stackers 5 only, or by both of the bundling and non-bundling stackers 4 and 5. Any of these modes of operation may be selected through a tap on the touch panel 17.

Also, this banknote handling apparatus 100 is configured to allow the user to enter a batch setting such that the number of banknotes stacked in the bundling stackers 4 and/or the non-bundling stackers 5 is limited to a preset number (of, e.g., 100). The batch setting may be entered into the bundling stackers 4 only, or the non-bundling stackers 5 only, or both the bundling and non-bundling stackers 4 and 5. If the batch setting is entered into the bundling stackers 4, the preset number of banknotes stacked in the bundling stackers 4 may be either bundled together in the bundling unit 9 or removed by the operator through the first outlet 47 with the operation of the banknote handling apparatus 100 temporarily stopped. On the other hand, if the batch setting is entered into the non-bundling stackers 5, the preset number of banknotes stacked in the non-bundling stackers 5 may be removed by the operator through the second outlet 53 with the operation of the banknote handling apparatus 100 temporarily stopped. If no batch setting is entered, the banknotes continue to be stacked in the bundling stackers 4 and/or non-bundling stackers 5 until their full capacity (i.e., maximum capacity) is reached. When their full capacity is reached, the operation of the banknote handling apparatus 100 is temporarily stopped or the banknotes are bundled together by the bundling unit 9. The batch setting may also be entered through a tap on the touch panel 17.

The leftover mode of operation and batch setting described above may be selectively adopted and selectively entered independently of each other. Specifically, the leftover mode of operation may be applied to only the bundling stackers 4, only the non-bundling stackers 5, both the bundling stackers 4 and non-bundling stackers 5, or neither the bundling stackers 4 nor non-bundling stackers 5. The batch setting may be entered into only the bundling stackers 4, only the non-bundling stackers 5, both the bundling stackers 4 and non-bundling stackers 5, or neither the bundling stackers 4 nor non-bundling stackers 5. Thus, as far as the combination of the leftover mode of operation and batch setting is concerned, the apparatus may operate in any of 4×4 (=sixteen) different modes. For example, if the leftover mode of operation is applied to only the bundling stackers 4 and if the batch setting is entered into both the bundling stackers 4 and non-bundling stackers 5, the operation of the banknote handling apparatus 100 is stopped or the banknotes are bundled when the number of banknotes stacked in the bundling stackers 4 during a single transaction reaches a predetermined number or when the number of banknotes continuously stacked in the bundling stackers 4 over multiple transactions reaches a predetermined number. As for the non-bundling stackers 5, on the other hand, the operation of the banknote handling apparatus 100 is stopped only when the number of banknotes stacked in the non-bundling stackers 5 reaches a predetermined number during a single transaction.

Also, if the leftover mode of operation is applied to both the bundling stackers 4 and non-bundling stackers 5 and if the batch setting is entered into only the bundling stackers 4, for example, the operation of the banknote handling apparatus 100 is stopped or the banknotes are bundled when the number of banknotes stacked in the bundling stackers 4 during a single transaction reaches a predetermined number or when the number of banknotes continuously stacked in the bundling stackers 4 over multiple transactions reaches a predetermined number. As for the non-bundling stackers 5, on the other hand, the operation of the banknote handling apparatus 100 is stopped when the number of banknotes stacked in the non-bundling stackers 5 during a single transaction reaches their full capacity or when the number of banknotes stacked in the non-bundling stackers 5 over multiple transactions reaches their full capacity.

By allowing the user to select any of such various combinations of leftover mode of operation and batch setting, this banknote handling apparatus 100 may be used even more conveniently.

As shown in FIG. 9, in this banknote handling apparatus 100, the second outlets 53 of the non-bundling stackers 5 are provided with no doors 43 unlike the first outlets 47 of the bundling stackers 4, and therefore, the operator may touch the banknotes stacked in the non-bundling stackers 5 during the processing. That is why before the number of banknotes stacked reaches either the predetermined number when the batch setting is entered or the full capacity when no batch setting is entered, the operator might remove the banknotes by mistake from the non-bundling stackers 5.

In this banknote handling apparatus 100, the non-bundling stackers 5 are each provided with the stacking sensor 52 for determining whether or not there are any banknotes left in the non-bundling stacker 5 as described above. If the stacking sensor 52 detects that the banknotes stacked there have been removed from the non-bundling stacker 5 during the processing and before the predetermined number is reached when the batch setting is entered or before the full capacity is reached when no batch setting is entered, the control unit 120 aborts the processing and displays, on the touch panel 17 and/or the teller terminal 1000, an alert message prompting the operator to return the removed banknotes into the non-bundling stacker 5. Optionally, an alarm may be emitted along with the alert message displayed. Note that if the leftover mode of operation is applied as described above, the operator may also be alerted when he or she removes banknotes from the non-bundling stacker 5 after the transaction has been done. In that case, however, the processing performed by the banknote handling apparatus 100 is not aborted.

Such abortion of the processing by the banknote handling apparatus 100 makes the operator sense that he or she has removed banknotes by mistake and prompts him or her to return the banknotes into the non-bundling stacker 5. The return of the banknotes into the non-bundling stacker 5 may be detected by the stacking sensor 52. Thus, the control unit 120 may resume its processing automatically on receiving the result of detection from the stacking sensor 52. Furthermore, not only when the result of detection is received from the stacking sensor 52 but also when the operator performs an operation of resuming the processing on the touch panel 17 or any other user interface, the control unit 120 may resume its processing.

Note that considering that the operator may remove banknotes intentionally for some reason, not only an alert message prompting the operator to return the removed banknotes into the original non-bundling stacker 5 but also an operating button allowing the operator to resume the processing without returning the banknotes may be displayed on the touch panel 17 or any other user interface. This allows the operator to select either an option of continuing the processing with the banknotes returned or an option of continuing the processing with no banknotes returned.

<Detailed Description of Processes to be Performed after Banknotes have been Stacked>

Processes to be performed until the banknotes stacked in the bundling stacker 4 are dispensed to the dispense unit 11 will be described below.

—Transportation of Banknotes from the Stacking Unit to the Bundling Unit—

Figure 15:
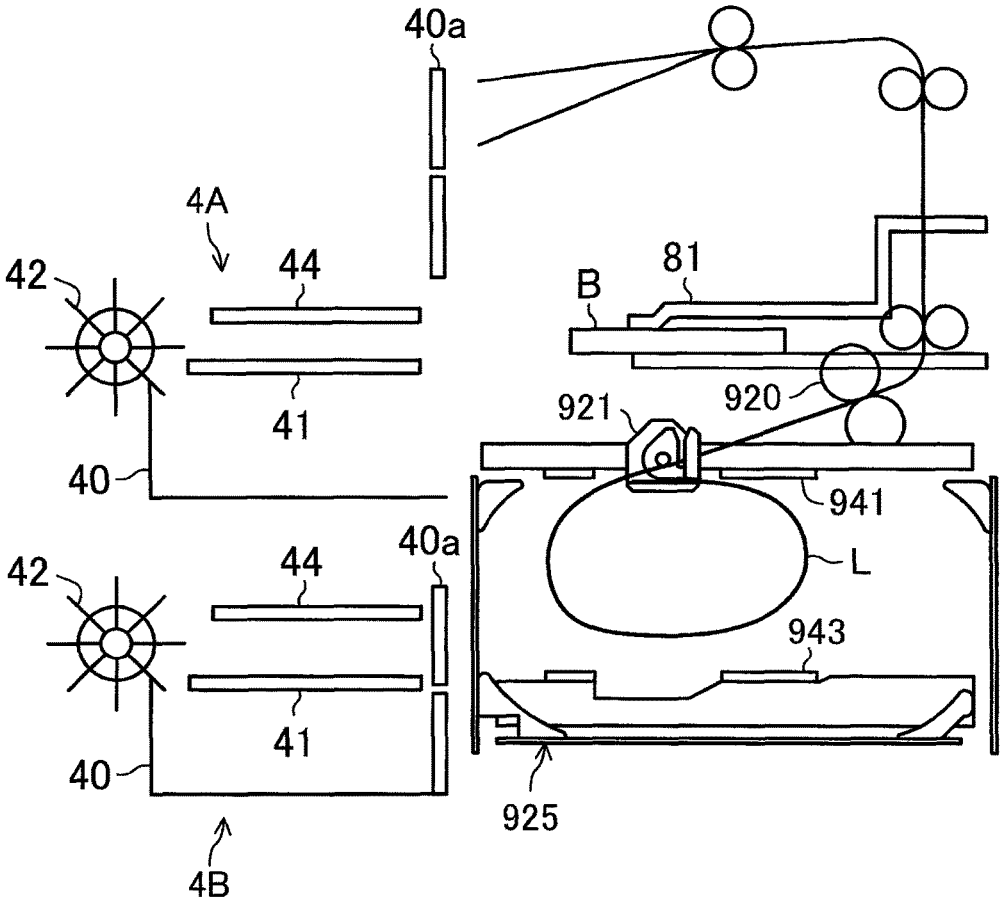
FIG. 15 illustrates a state where a second transport unit has removed the banknotes from the bundling stacker.
Figure 16:
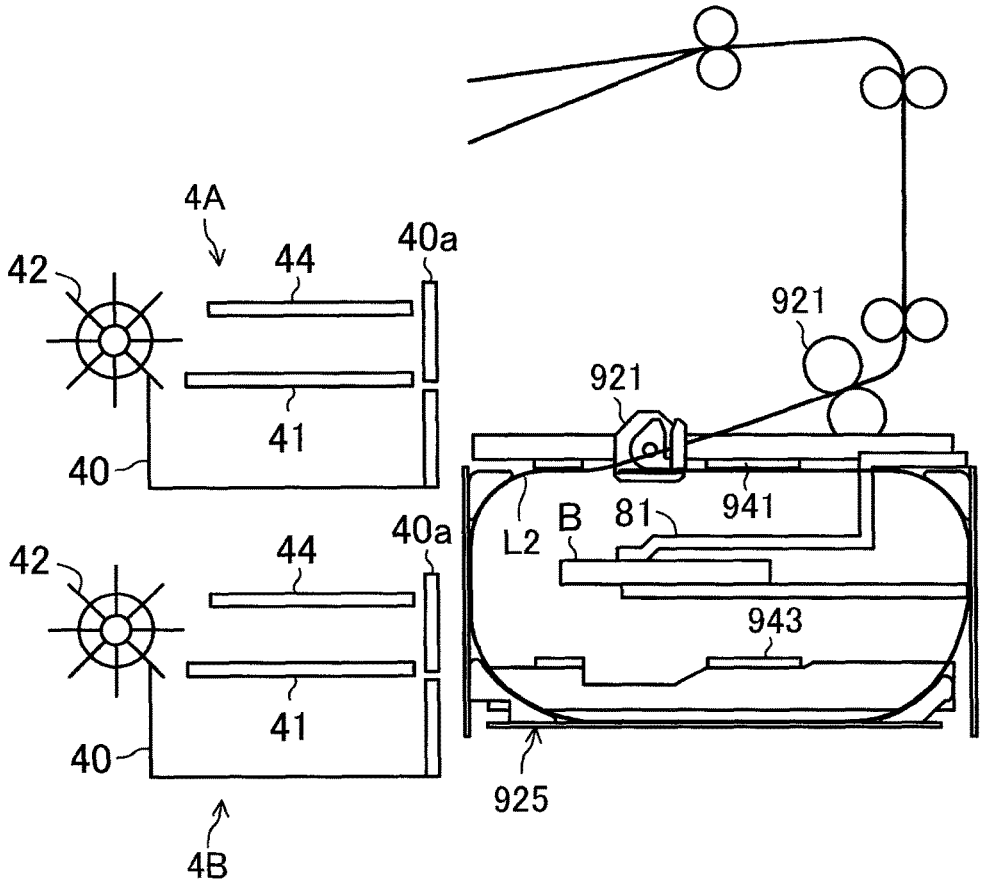
FIG. 16 illustrates a state where the second transport unit has transported the banknotes to beside a tape loop.

When the stacking of the banknotes B in the bundling stacker 4 is finished, the second transport unit 8 transports the banknotes B from the bundling stacker 4 to the bundling unit 9. FIG. 15 shows a state where the second transport unit 8 has removed the banknotes B from the bundling stacker 4. FIG. 16 shows a state where the second transport unit 8 has transported the banknotes B to beside the tape loop L.

Specifically, when the banknotes B have been stacked, the second transport unit 8 moves to the bundling stacker 4 in which the banknotes B have been stacked, grips the banknotes B in the bundling stacker 4, and removes the banknotes B from the bundling stacker 4 as shown in FIG. 15. In this case, suppose that the banknotes B have been stacked in the first bundling stacker 4A. Then, the gripper 81 of the second transport unit 8 grips the banknotes B in the first bundling stacker 4A. The second transport unit 8 removes the gripped banknotes B from the first bundling stacker 4A in the first horizontal direction. At this time, the second transport unit 8 moves the banknotes B in the first horizontal direction to a first predetermined position (the position shown in FIG. 15). This first position corresponds with a first horizontal position for transporting the banknotes B into the large tape loop L2 as will be described later.

Subsequently, the second transport unit 8 displaces the banknotes B vertically to a second predetermined position as shown in FIG. 16. At this second position, the banknotes B are going to be transported into the large tape loop L2. At the second position, the banknotes B are located around the center of the large tape loop L2 as viewed in a direction parallel to the longer edges of the banknotes B.

—Formation of Tape Loop—

The control unit 120 forms a tape loop L while the second transport unit 8 is transporting the banknotes B from the bundling stacker 4 to the second position. FIG. 17 shows a state where the tape gripping part 921 has gripped an end portion of the tape T. FIG. 18 shows a state where the tape gripping part 921 has formed a small tape loop L1.

First, the pair of feed rollers 920 rewinds the tape T until the first tape sensor 9210 detects the end portion of the tape T. When the end portion of the tape T is detected, the pair of feed rollers 920 feeds the tape T. At this time, the tape gripping part 921 is in a standby state with a gap left between the movable part 923 and the base plate 922 to allow the tape T fed by the pair of feed rollers 920 to be inserted into the gap. When the end portion of the tape T is inserted between the movable part 923 and the base plate 922, the end portion of the tape T is gripped by the movable part 923 and the base plate 922 as shown in FIG. 17. The movable part 923 is locked with the end portion of the tape T gripped by itself and the base plate 922. The end portion of the tape T is gripped by the tape gripping part 921 substantially in a horizontal position.

Then, the tape gripping part 921 starts to rotate while gripping the tape T at the end portion thereof as indicated by the one-dot chain arrow in FIG. 17. In the meantime, the pair of feed rollers 920 keeps feeding the tape T. The tape gripping part 921 rotates to displace the end portion of the tape T downward, i.e., rotates counterclockwise in FIG. 17.

When the tape gripping part 921 makes substantially one round, a tape loop L is formed as shown in FIG. 18. Such a tape loop L formed by having the tape gripping part 921 make substantially one round will be hereinafter referred to as a "small tape loop L1." The end portion of the tape T gripped by the tape gripping part 921 is located at an upper portion of the small tape loop L1, and the small tape loop L1 is formed under the tape gripping part 921. The small tape loop L1 is formed at a lower level than the pair of feed rollers 920.

When the small tape loop L1 is formed, the rotation of the tape gripping part 921 stops, while the pair of feed rollers 920 keeps feeding the tape T. As a result, the small tape loop L1 gradually expands as indicated by the one-dot chain arrows in FIG. 18. Since the end portion of the tape T gripped by the tape gripping part 921 is located at the upper portion of the small tape loop L1, and the tape T is fed by the pair of feed rollers 920 from the upper portion of the small tape loop L1, the small tape loop L1 expands downward. Since the guide 925 is arranged under the tape gripping part 921, the tape loop L soon comes into contact with the guide 925, and thus the shape of the tape loop L is defined by the guide 925. When the cumulative length of the tape T fed by the pair of feed rollers 920 finally reaches a predetermined value, the tape loop L is formed into a substantially rectangular shape by the guide 925 as indicated by the one-dot chains in FIG. 18. This tape loop L will be hereinafter referred to as a "large tape loop L2." The large tape loop L2 is in contact with the lower guide 926 and the first and second lateral guides 927 and 928, and has a substantially rectangular shape. In addition, the large tape loop L2 is also in contact with the first to fourth corner guides 929*a* to 929*d* such that the large tape loop L2 has a rectangular shape having rounded corners.

The control unit 120 detects that the large tape loop L2 has been formed by being notified of the fact that the second tape sensor 9211 detects the tape T when the cumulative length of the tape T fed by the pair of feed rollers 920 reaches the predetermined value. The control unit 120 calculates the cumulative length of the tape T fed based on the angle of rotation of the stepping motor that has driven the pair of feed rollers 920 since the first tape sensor 9210 has detected the end portion of the tape T. If the second tape sensor 9211 has not detected the tape T yet even though the cumulative length of the tape T fed by the pair of feed rollers 920 has already reached a predetermined value, a portion of the tape loop L may possibly sag inward and the shape of the tape loop L may be different from the desired shape along the guide 925 (i.e., the shape of the large tape loop L2). Thus, if the second tape sensor 9211 has not detected the tape T yet when the cumulative length of the tape T fed by the pair of feed rollers 920 reaches the predetermined value, the control unit 120 rewinds the tape T to a predetermined rewinding length, and then feeds the tape T again until the cumulative length fed reaches the predetermined value. Then, the control unit 120 determines whether the second tape sensor 9211 has detected the tape T or not. If the second tape sensor 9211 still has not detected the tape T yet, the control unit 120 performs the rewinding, feeding and detection check of the tape T all over again.

The second tape sensor 9211 is configured to detect the tape T guided by the fourth corner guide 929*d*. That is, the second tape sensor 9211 detects whether the tape T is present or not at a predetermined position above the banknotes B transported into the large tape loop L2. If any portion of the tape loop L sags inward, it is highly likely that the upper portion of the tape loop L sags due to the tape's own weight. That is to say, arranging the second tape sensor 9211 at the above-described position allows detection of the sag of the tape loop L accurately.

The large tape loop L2 is formed synchronously with the transportation of the banknotes B from the bundling stacker 4 to the bundling unit 9 by the second transport unit 8 as shown in FIGS. 15 and 16. Ordinarily (i.e., if the large tape loop L2 is formed at a time by feeding the tape T once), the large tape loop L2 has already been formed when the banknotes B are transported to the second position.

—Winding of the Tape—

FIGS. 19A-19C show how the respective members operate until the banknotes B transported into the large tape loop L2 are wound with the tape T when the banknotes B are viewed in the thickness direction. FIG. 19A shows a state just before the banknotes B are transported into the large tape loop L2. FIG. 19B shows a state where the banknotes B are transported into the large tape loop L2. FIG. 19C shows a state where the banknotes B are wound with the tape T. FIG. 20 shows the state of the guide 925 when the clamp 94 presses the banknotes B.

As described above, the second transport unit 8 transports the banknotes B to the second position as shown in FIGS. 15 and 16 (see FIG. 19A), and then moves the banknotes B in the second horizontal direction to bring the banknotes B into the large tape loop L2. The second transport unit 8 moves the banknotes B in the second horizontal direction to a third predetermined position as shown in FIG. 19B. At this third position, the tape T corresponds with approximately the center of the banknotes B in a direction parallel to their longer edges in the second horizontal direction in the example illustrated in FIG. 19B.

When the banknotes B are transported to the third position, the gripper 81 grips the banknotes B again at their portion other than a portion to be bundled (a portion around which the tape T will be wound later in the processing). Subsequently, the clamp 94 presses the banknotes B in the stacking direction, i.e., from over and from under the banknotes in the vertical direction. Specifically, the lower clamps 943, 944 of the clamp 94 move upward. At this time, the upper movable clamp 942 is located at the clamp position. Finally, the lower clamps 943, 944 press the banknotes B against the upper clamps 941, 942. The upper clamps 941, 942 and the lower clamps 943, 944 sandwich the banknotes B vertically at both sides of their portions to be bundled in the direction parallel to their longer edges. Thus, the banknotes B are compressed vertically by the upper clamps 941, 942 and the lower clamps 943, 944. The lower clamps 943, 944 that move upward stop at a position where the upper clamps 941, 942 and the lower clamps 943, 944 compress the banknotes B to a predetermined thickness.

The lower clamps 943, 944 form integral parts of the lower guide 926. Thus, the lower guide 926 also moves upward as the lower clamps 943, 944 move upward. At this time, as the tape reel motor 9111 and tape feed motor 9212 are driven in a rewinding direction, the tape T is rewound as the lower guide 926 moves upward. As a result, as shown in FIG. 20, the tape loop L shrinks as the lower guide 926 moves upward. In addition, the second lateral guide 928 also moves upward as the lower guide 926 moves upward. Thus, a space is left for the tape loop L to deform. That is to say, if the velocity of the upward movement of the lower guide 926 is too high as compared with the rate of shrinkage of the tape loop L, the tape loop L deforms so as to grow out of the guide 925. At this time, the second lateral guide 928 has retreated from beside the tape loop L, and thus the tape loop L is allowed to expand toward the space where the second lateral guide 928 was located originally. This prevents the tape T from bending.

Note that the third abutting portion 942*c* is provided between the first and second abutting portions 942*a* and 942*b* of the upper movable clamp 942, and the third abutting portion 942*c* is located at a lower level than the first and second abutting portions 942*a*, 942*b*. Further, the base plate 922 of the tape gripping part 921 is arranged between the first and second abutting portions 941*a* and 941*b* of the upper fixed clamp 941, and located at a lower level than the first and second abutting portions 941*a*, 941*b*. On the other hand, in the lower clamps 943, 944, there is a downward recess between the first and second abutting portions 943*a* and 943*b*, and between the first and second abutting portions 944*a* and 944*b*. Thus, the banknotes B pressed by the clamp 94 are depressed downward substantially at the middle of their shorter edges.

The upward movement of the lower guide 926 stops when the upward movement of the lower clamps 943, 944 stops. On the other hand, the tape reel motor 9111 and tape feed motor 9212 keep rewinding the tape T even after the upward movement of the lower guide 926 has stopped. Finally, as shown in FIG. 19C, the tape T is wound around the banknotes B. As described above, the position of the tape T in the tape width direction is regulated by the lower guide 926 until just before the tape T is wound around the banknotes B. Thus, the tape T is wound correctly around the intended portion of the banknotes.

—Bonding of the Tape, Cutting of the Tape, and Stamping of a Seal on the Tape—

Subsequently, the heater 95 bonds together portions of the tape T, and the cutter 96 cuts the tape T. In addition, the stamper 98 stamps a seal on the tape T. FIG. 21 shows how the tape T is bonded and cut, and a seal is stamped on the tape T.

When the tape T is wound around the banknotes B, the heater 95 and the cutter 96 move downward together. At this time, the first and second tape pressers 991, 992 also move downward together with the heater 95 and the cutter 96.

As a result, the first tape presser 991 is caught in the first recessed groove 922*c* of the base plate 922 to sandwich the tape T between itself and the bottom surface of the first recessed groove 922*c* as shown in FIG. 21. At the same time, the second tape presser 992 sandwiches the tape T between itself and the movable part 923. At this time, heat sealing by the heater 95 and cutting by the cutter 96 are not performed yet.

Subsequently, although not shown, the heater 95 and the base plate 922 of the tape gripping part 921 sandwich the end portion of the tape T and a portion of the tape T which has made one round and which overlaps with the end portion of the tape T. That is to say, the heater 95 sandwiches these portions of the tape T between itself and a portion of the base plate 922, which is located between the first and second recessed grooves 922*c* and 922*d*. A glue which melts under heat and which solidifies with cooling is applied to one side of the tape T. The heater 95 heat-seals the overlapping portions of the tape T by sandwiching and heating the tape T.

Synchronously with the heat-sealing by the heater 95, the cutter 96 cuts the tape T. The cutter 96 cuts a portion of the tape T upstream of the portions that are heat-sealed by the heater 95, i.e., a portion of the tape T located closer to the pair of feed rollers 920 than the heat-sealed portions (hereinafter referred to as an "excessive portion"). In this manner, the portions of the tape T wound around the banknotes B are bonded together, and the excessive portion of the tape T is cut off.

When the heater 95 heat-seals the overlapping portions of the tape T together by sandwiching the tape T for a predetermined amount of time, the heater 95 leaves the tape T. Meanwhile, the first and second tape pressers 991, 992 that press the tape T continue pressing the tape T even after the heater 95 has left the tape T. In this manner, if the tape T continues to be pressed for a predetermined cooling time since the tape T has been heat-sealed, no load is applied to the heat-sealed portion of the tape T. This allows the molten glue to solidify and heat-seal the tape T with reliability.

In this case, the cooling time, or the duration of the cooling processing to be performed after the heat-sealing, varies according to the heating temperature of the heater 95, the ambient temperature of the tape T, the type of the tape, and other factors. Thus, the cooling time may be set in advance to be sufficiently long such that the tape T can be heat-sealed with reliability irrespective of the condition. However, if the cooling time were too long, then it would take a long time to have the bundling processing done, which is a problem. Nevertheless, if the cooling time were too short, then the tape T would not be heat-sealed sufficiently and might peel off.

Thus, this banknote handling apparatus 100 is configured to be able to change the cooling time. This allows for shortening the cooling time as much as possible while heat-sealing the tape T with reliability by optimizing the cooling time according to the situation in which the banknote handling apparatus 100 is used. In addition, the cooling time may also be optimized according to the type of the tape T introduced into the banknote handling apparatus 100.

The cooling time may be set by the operator to be any arbitrary value. Alternatively, the banknote handling apparatus 100 may optimize the cooling time automatically. For example, the cooling time may be set automatically according to the heating temperature of the heater 95, i.e., by a preset function based on the difference in temperature between the heating temperature of the heater 95 and the temperature at which the glue of the tape T solidifies (such that the greater the temperature difference, the longer the cooling time). Optionally, the cooling time may also be set based on the temperature detected inside the housing 12, e.g., at a point around the position where the heater 95 is provided. Furthermore, the cooling time may also be set according to the type of the tape T. If there are multiple types of tapes T that may be used in the banknote handling apparatus 100, multiple cooling times may be set in advance for the respective types of tapes T, and then an associated one of the cooling times may be selected according to the type of the tape introduced into this banknote handling apparatus 100.

Still alternatively, the cooling time may also be set automatically with any of these various factors combined.

Optionally, the operator may be allowed to make an appropriate correction to the cooling time automatically set by the banknote handling apparatus 100. Conversely, the banknote handling apparatus 100 may be allowed to make an automatic correction to the cooling time that has been arbitrarily set by the operator.

The cooling time may be set only during the initialization of the banknote handling apparatus 100 and unchanged after that. Alternatively, the cooling time may be changed regularly (e.g., on a season-by-season basis).

The stamper 98 stamps a seal on the tape T synchronously with the heat sealing by the heater 95 and the cutting by the cutter 96. The stamper 98 also moves upward together with the lower guide 926, and is located right under the banknotes B when the tape T is heat-sealed and cut. After the tape T has been rewound by the pair of feed rollers 920 to wind the tape T around the banknotes B, the stamper 98 allows the stamp 981 to move upward. The stamp 981 comes into contact with the tape T wound around the banknotes B to stamp a seal on the tape T.

The stamper 98 forms an integral part of the lower guide 926 which regulates the position of the tape T in the tape width direction, and thus the stamp 981 is positioned relative to the tape T. Specifically, the stamp 981 goes through the through hole 926*d* in the bottom wall 926*b* of the lower guide 926, and stamps a seal on the tape T between the sidewalls 926*a*. The position of the tape T wound on the lower surface of the banknotes B is regulated in the tape width direction by the sidewalls 926*a*, and thus the tape T is located at the destination of the stamp 981 moving upward between the sidewalls 926*a*. Thus, the stamp 981 stamps a seal on the tape T so as to prevent any portion of the seal from running off the edges of the tape T.

Even if there are any characters or signs printed by the printer 97 under a portion of the tape T on which the stamp 981 stamps a seal in the longitudinal direction of the tape T, the seal stamped by the stamp 981 does not overlap with the print made by the printer 97, because the portion on which the stamp 981 stamps the seal and the portion on which the printer 97 prints the characters or signs are misaligned with each other in the tape width direction.

—Discharge of Banknotes—

The banknotes B bundled with the tape T are transported to the dispense unit 11 by the second and third transport units 8 and 10. Specifically, although not shown in detail, after the tape T has been bonded and cut and the seal has been stamped on the tape T, the gripper 81 grips the bundled banknotes B. Then, the lower clamps 943, 944 move downward to release the pressure applied by the clamp 94. In addition, the upper movable clamp 942 moves upward. Thereafter, the second transport unit 8 transports the bundled banknotes B to a predetermined extent in the second horizontal direction and to the opposite direction from the direction of transportation of the banknotes into the large tape loop L2.

Subsequently, the gripper 81 releases its grip on the bundled banknotes B. In place of the gripper 81, the third transport unit 10 grips the bundled banknotes B in turn. Then, the third transport unit 10 transports the bundled banknotes B in the first horizontal direction toward the dispense unit 11. Finally, the bundled banknotes B are pushed toward the dispense unit 11 by the third transport unit 10.

The bundled banknotes pushed toward the dispense unit 11 are dispensed out of the housing 12 through the dispense unit 11.

<Deciding Whether or not to do Recounting at the Time of Error>

As described above, in the deposit processing, the banknotes mounted on the hopper unit 2 which are recognized to be fit banknotes of a predetermined denomination to be bundled are bundled. If the processing performed by the banknote handling apparatus 100 is aborted upon the occurrence of an error during the bundling processing, at least the banknotes remaining in the housing 12 need to be recounted. As used herein, the banknotes remaining in the housing 12 include the banknotes present on the transport path inside the housing 12 (ejectable ones of which are ejected to the reject stacker 6 and non-ejectable ones of which (e.g., jammed banknotes) are manually removed by the operator with the housing 12 opened) and the banknotes stacked in the bundling stackers 4 and non-bundling stackers 5.

On the other hand, the banknotes already bundled together and dispensed out of the housing 12 through the dispense unit 11 which have had their result of counting stored in the database 1202 as a provisionally confirmed one are regarded as banknotes subjected to the bundling processing and not considered the targets of recounting. Note that the transaction itself is not completed yet, and the result of counting of those banknotes is still a provisionally confirmed one. In this case, the time when the result of counting is stored as a provisionally confirmed one in the database 1202 does not always agree with, but may be later than, the time when the banknotes bundled are dispensed out of the housing 12. Thus, if an error occurs just before or after the bundles have been dispensed out of the housing 12, sometimes the operator cannot determine whether or not the bundles dispensed out of the housing 12 are the targets of recounting.

To overcome this problem, this banknote handling apparatus 100 displays, on the touch panel 17 and/or the teller terminal 1000, information that allows the operator to identify a bundle to be recounted upon the occurrence of an error. More specifically, a piece of information printed on the tape T as data for identifying the bundle to be recounted, namely, an identification code indicating a denomination, a date and time, or a sequential number, is displayed on the touch panel 17 or any other user interface. This allows the operator to identify the bundle to be recounted by comparing the identification code printed on the bundle already dispensed when the processing is aborted upon the occurrence of an error to the piece of information displayed on the touch panel 17 or any other user interface. Note that if there are no bundles to be recounted, that information may be displayed on the touch panel 17 or any other user interface.

Alternatively, the identification code of a bundle that does not have to be recounted may be displayed on the touch panel 17 or any other user interface instead of the identification code of the bundle to be recounted. Even so, the operator is also allowed to identify a bundle to be recounted.

According to this configuration, even if an error occurs while the banknote handling apparatus 100 is performing processing, a bundle to be recounted may be identified with reliability. As a result, both a situation where banknotes to be recounted fail to be recounted and a situation where banknotes not to be recounted are recounted unnecessarily are avoidable, thus enabling the operator to avoid making miscalculations.

<Recovery Process to be Performed when Fall Detecting Sensor Detects Fall>

As described above, a banknote may fall around the bundling unit 9, and therefore, a fall detecting sensor 99 for detecting the fall of banknotes is provided around the bundling unit 9. When the fall detecting sensor 99 detects the fall of any banknote, the banknote handling apparatus 100 stops. Then, the operator opens the housing 12 of the banknote handling apparatus 100 and removes the fallen banknote. In this manner, miscalculation is avoidable.

However, the fallen banknote could be located in a blind spot for the fall detecting sensor 99. In that case, the fall of a banknote could not be detected immediately at the time of falling, but could be detected accidentally later by the fall detecting sensor 99.

Also, even if the operator has removed at least one fallen banknote from the housing 12 in response to the detection of the fallen banknotes by the fall detecting sensor 99, some of the fallen banknotes could be left in a blind spot for the fall detecting sensor 99 but could be detected accidentally later by the fall detecting sensor 99.

In these cases, there is a time lag between the time when a banknote actually fell and the time when the fall detecting sensor 99 detects the fall of the banknote. Thus, the operator cannot determine exactly when the banknote fell, which is inconvenient for him or her.

Thus, on detecting that a banknote has fallen, this banknote handling apparatus 100 determines exactly when the fallen banknote was processed, and more particularly, identifies a bundle that should include the fallen banknote (i.e., an associated bundle).

Figure 22:
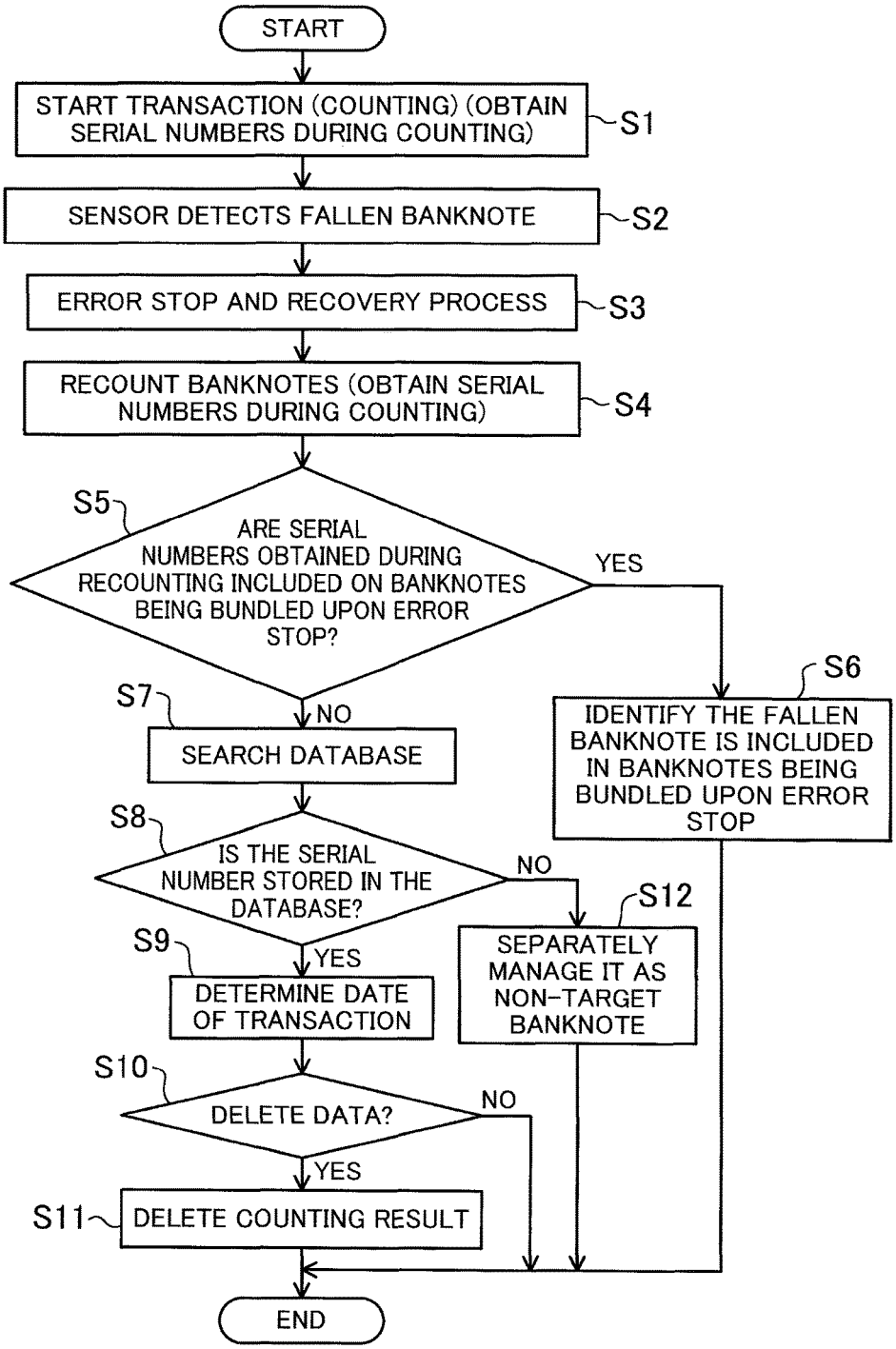
FIG. 22 is a flowchart showing the procedure of recovery processing to be performed when the fall of a banknote is detected.

FIG. 22 is a flowchart showing the procedure of recovery processing to be performed when the fall detecting sensor 99 detects a fall. First, in Step S1 right after the start of the processing, a transaction (including counting processing and bundling processing) is started. Specifically, as described above, the banknotes mounted on the hopper unit 2 are taken into the housing 12, and are recognized, and have their serial numbers read, by the recognition unit 3. Among other things, fit banknotes of a predetermined denomination to be bundled are transported to the bundling stackers 4 and are subjected to bundling processing on a predetermined number basis.

Next, in Step S2, the fall detecting sensor 99 detects that a banknote has fallen. Subsequently, in Step S3, the banknote handling apparatus 100 stops operating to start the recovery processing. That is to say, the operator opens the housing 12 to remove the fallen banknote. On the touch panel 17 of the banknote handling apparatus 100 (and/or the teller terminal 1000), displayed is an alert message recommending that recounting processing be started as shown in FIG. 23, for example. In response, the operator puts, on the hopper unit 2, the banknotes removed from the housing 12 and performs an operation to start the processing on the touch panel 17 or any other user interface. The banknotes removed from the housing 12 include not only the banknote fallen in the housing 12 but also banknotes being bundled, banknotes transported on the transport path and stacked in the reject stacker 6, and banknotes that have been bundled and dispensed but that are still included in a bundle to be recounted as described above.

When the recounting processing is started, the banknotes put on the hopper unit 2 are taken into the housing 12 again and start being recounted in Step S4. As a result, the serial numbers of the respective banknotes are obtained again. Once this recounting processing is started, the processing (i.e., the transaction) that was being performed by the banknote handling apparatus 100 when the fall detecting sensor 99 detected a fall of a banknote is canceled. That is to say, it means that once this recounting processing is started, the processing needs to be started over from the beginning.

On the other hand, the dialog box shown in FIG. 23 includes a cancel button. If this cancel button is selected and pressed, then the error recovery ends without recounting. This is a button to be selected by the operator if even though no banknotes have actually fallen in the housing 12, the fall detecting sensor 99 has detected a fall by mistake to bring the banknote handling apparatus 100 to an error stop. If the operator presses the cancel button on the dialog box shown in FIG. 23, the processing that was being performed by the banknote handling apparatus 100 when the fall detecting sensor 99 detected a fall of a banknote is not canceled. The reason is that no banknotes have actually fallen and there is no need to start over the processing from the beginning.

As can be seen, this banknote handling apparatus 100 is configured to present an option of canceling the transaction that was being performed when the fall detecting sensor 99 detected the fall of the banknote and an option of continuing the transaction to the operator such that he or she can pick one of these two options. This configuration is adopted with a possible erroneous detection by the fall detecting sensor 99 taken into consideration, and allows the apparatus to save the trouble of performing unnecessary recovery work, which is more convenient for the user.

In Step S4, the recognition unit 3 reads the serial numbers of all banknotes at the time of recounting. If the recounting processing ends normally, the processing proceeds to the next processing step S5. On the other hand, if the recognition unit 3 has failed to read the serial numbers of any banknotes at the time of recounting in Step S4, the banknotes in question are transported to the reject stacker 6. If there are any such banknotes with unreadable serial numbers, then an alert message prompting the operator to enter the serial numbers of those banknotes manually is displayed on the touch panel 17 or any other user interface. FIG. 24 shows an exemplary dialog box allowing the operator to enter the serial numbers manually. In this example, there are as many blanks to fill in as the banknotes transported to the reject stacker 6. The operator does not have to enter the serial numbers of multiple banknotes at a time but may enter the serial number of a banknote one by one. Looking at the serial numbers of the banknote at hand, the operator enters the serial numbers into the blanks on the dialog box. When the operator finishes entering all serial numbers, he or she presses the end button.

Figure 25:
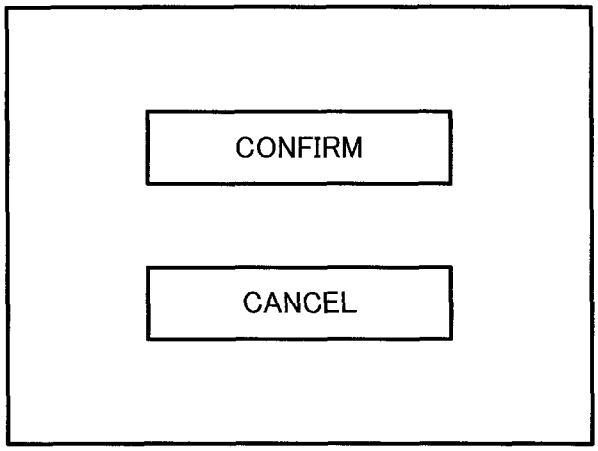
FIG. 25 illustrates still another exemplary dialog box to be displayed during the recovery processing.

If the end button is pressed, then a dialog box allowing the operator to choose either "confirm" or "cancel" such as the one shown in FIG. 25 is displayed on the touch panel 17. If the operator chooses the "confirm" button, the manually entered serial numbers are all confirmed. As a result, the serial numbers of all banknotes to be recounted are obtained either by the recognition unit 3 or by the manual entry. Then, the processing proceeds to Step S5. By allowing the operator to enter the serial numbers manually, the banknote handling apparatus 100 may obtain the exact serial numbers of those banknotes with unreadable serial numbers.

Figure 26:
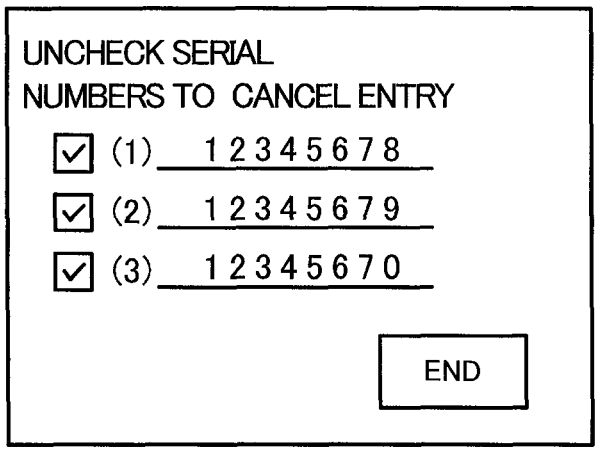
FIG. 26 illustrates yet another exemplary dialog box to be displayed during the recovery processing.

On the other hand, if the operator chooses the "cancel" button, part or all of the serial numbers that have been entered manually on the dialog box shown in FIG. 24 may be canceled. In that case, a dialog box such as the one shown in FIG. 26 is displayed on the touch panel 17 or any other user interface. In this example, the serial numbers that have been entered manually are displayed, and a check box is provided for each of those serial numbers. That is to say, this dialog box is designed to allow the operator to uncheck the serial numbers to be canceled. If the operator unchecks some serial numbers as needed and then presses the end button on this dialog box, then the dialog box shown in FIG. 25 is displayed again.

Optionally, the end button may also be pressed with some or all of the blanks left unfilled on the serial number manual entry dialog box shown in FIG. 24. Then, the operator will manually enter the serial numbers with respect to either no banknotes at all or only some banknotes. If the operator is allowed to cancel manually entering some or all of the serial numbers as needed on the dialog box shown in FIG. 24 or 26, the error recovery may be ended smoothly.

In Step S5, a determination is made, on a serial number basis, with reference to the database 1202 whether or not the banknotes obtained by the recounting in Step S4 which are fit banknotes of a predetermined denomination to be bundled are included in the banknotes that were being processed (i.e., that were being bundled in the vicinity of the bundling unit 9) while the banknote handling apparatus 100 was at an error stop. In this processing step, the information stored in the database 1202 before the provisional confirmation is referred to. The reason is that the fall of a banknote is most likely detected by the fall detecting sensor 99 at the very time of falling. If the answer to the question of Step S5 is YES, then the processing proceeds to Step S6, in which the fallen banknote is identified with one of the banknotes that were being bundled at the time of the error stop. In that case, the bundling processing that was being performed at the time of the error stop is aborted so that the recounting is recommended.

Alternatively, in Step S6, with the serial numbers of the banknotes obtained again compared to the serial numbers stored in the database 1202 with respect to the banknotes being bundled, a determination may be made whether or not the serial numbers of the banknotes obtained again match those serial numbers stored in the database 1202 without exception. In that case, the same bundle as the one that was being formed at the time of occurrence of an error may be formed. In addition, even if any extra banknotes other than the ones removed from the housing 12 are put by mistake on the hopper unit 2 during recounting, that mistake may also be detected. This allows the operator to avoid making miscalculations.

On the other hand, if the answer to the question of Step S5 is NO (i.e., if the bundle that was being formed at the time of occurrence of an error does not include at least one of the banknotes obtained again), then the processing proceeds to Step S7. Such a situation may arise because the fallen banknote may have fallen during past processing. Thus, in Step S7, the past processing data stored in the database 1202 or the teller terminal 1000 is searched for the serial number of that banknote in question obtained again. The past processing data includes the provisionally confirmed data stored in the database 1202. In this case, the search range may be the entire range in which the banknote handling apparatus 100 has performed processing so far. Alternatively, the search range may also be limited to a range where the fall detecting sensor 99 performed processing on the very day of fall detection. Still alternatively, the search range may also be limited to a particular period on and after a predetermined day, e.g., the past one week or the past one month. Furthermore, the search range may be either a preset one or specified by the operator at the time of search.

Next, in Step S8, a determination is made whether or not the serial number of that banknote obtained again is included in the past processing data stored in the database 1202 or the teller terminal 1000. If that is the case (i.e., if the answer is YES), the processing proceeds to Step S9. Otherwise (i.e., if the answer is NO), the processing proceeds to Step S12. In the latter case, the time when that banknote was processed is outside of the search range specified in Step S7 and cannot be determined, and therefore, in Step S12, that banknote is regarded as a non-target banknote to be managed separately and the error recovery ends.

In Step S9, the exact time when the fallen banknote was processed may be determined, i.e., a past transaction in which a bundle that should have included the fallen banknote was formed may be identified. In this case, the bundle that was formed at that time actually did not include that banknote. Thus, in Step S10, an alert message (not shown) asking the operator if he or she wants to delete the counting result currently stored in the database 1202 and/or the teller terminal 1000 in association with that bundle is displayed on the touch panel 17 or any other user interface. If the operator opts to delete that counting result, the processing proceeds to Step S11 to delete that counting result stored in the database 1202 and/or the teller terminal 1000. Alternatively, the confirmed counting result may be changed into an unconfirmed one, which is equivalent to canceling. In the database 1202 and teller terminal 1000, information about a bundle formed and information about the serial numbers of banknotes included in that bundle are stored in association with each other. Thus, in Step S11, the counting result may be deleted on a bundle basis. That is to say, the number of counting results to be deleted from the confirmed counting results stored in the database 1202 or any other storage may be minimized. The deletion of the counting result in Step S11 completes the error recovery. On the other hand, if the operator opts to delete no counting results, the processing does not proceed to Step S11, but the error recovery ends as it is.

In this procedure, when the search is carried out in Step S7, fuzzy matching may be performed following a predetermined rule. This fuzzy matching increases the probability of extracting the serial number from the database 1202 or any other storage and facilitates identifying the transaction in which the fallen banknote was handled. The fuzzy matching may be carried out so that the serial numbers are compared to each other with a particular digit of theirs masked, for example. The match between the serial numbers may also be determined by forward match, backward match, or broad match. Furthermore, the serial number of a banknote may naturally be read with all of the digits recognized, but may also be read with only some of the digits that are equal to or greater than a predetermined digit recognized. The fuzzy matching also refers to such ambiguous reading of a serial number. If a plurality of serial numbers (i.e., transactions) have been extracted as a result of the fuzzy matching, those serial numbers may be displayed on the touch panel 17 or any other user interface such that the operator is allowed to pick his or her desired one from the serial numbers.

As can be seen from the foregoing description, if the fall detecting sensor 99 detects the fall of any banknote, this banknote handling apparatus 100 obtains again the serial numbers of banknotes removed from the housing 12, including the fallen banknote, and compares the serial numbers of the banknotes obtained again to the serial numbers stored in the database 1202 or any other storage, thereby identifying a bundle associated with the banknotes removed, i.e., a bundle that should include that banknote. There may be a time lag between the time when the banknote actually fell and the time when the fall detecting sensor 99 detects the fall of that banknote. However, since a bundle associated with the fallen banknote is identifiable accurately, the recovery may be done appropriately.

Note that this procedure of recovery is applicable to not only the recovery to be carried out when the fall detecting sensor 99 detects the fall of any banknote but also the recovery to be carried out when any other kind of error occurs.

<Management of Rejection Factor>

As described above, when processing related to a deposit transaction is performed, the banknotes put on the hopper unit 2 are taken into the housing 12 and then subjected to recognition and other types of processing. In the meantime, some banknotes may be rejected due to either a transport error such as skewing or chaining or any other factor deriving from the banknote itself (such as a banknote which has had its fitness level determined abnormally). The banknotes to be rejected are transported to the reject stacker 6, and then the rejected banknotes are taken in and recognized all over again. In the example described above, if any banknotes are recognized to be rejected banknotes even after the banknotes have been taken in and recognized again, then such banknotes are intended to be just returned to the customer without being further taken in or recognized. However, this banknote handling apparatus 100 may also be operated such that every time any banknote is recognized to be a rejected banknote, the rejected banknote will be taken in and recognized an unlimited number of times.

Among various rejection factors, the transport error is not caused by the banknote itself but results from its transportation state. Thus, if the transportation state is changed, then the banknote may no longer be recognized as a rejected banknote. On the other hand, rejection factors such as a fitness level determination error and counterfeit notes derive from the banknote itself. That is why the banknote with such a rejection factor is highly likely to be recognized as a rejected banknote, no matter how many times the banknote is taken in and recognized. To take in and recognize such a banknote over and over again is a time-consuming wasteful job. However, even if there is any such rejected banknote, the operator cannot sense its rejection factor, which leads to such wasteful repetitive insertion and recognition of the rejected banknote.

Thus, by taking advantage of the fact that the serial number of each given banknote has been read, this banknote handling apparatus 100 stores the serial number and rejection factor of such a rejected banknote in the database 1202 in association with each other, and counts the number of times the banknote is recognized to be a rejected banknote. This function will be described with reference to FIGS. 27 and 28.

FIG. 27 illustrates an example in which banknotes taken into the banknote handling apparatus 100 are recognized to be rejected banknotes and then repeatedly subjected to the insertion and recognition a number of times. In this example, three banknotes with Serial Numbers 1, 2, and 3 are taken into the banknote handling apparatus 100 and each recognized to be a rejected banknote. Specifically, when these banknotes are taken in for the first time, the banknote with Serial Number 1 is recognized to be a rejected banknote as being a skewed one (i.e., due to a transport error), the banknote with Serial Number 2 is recognized to be a rejected banknote as the stacker that should stack it is already full (i.e., because it is a non-specified banknote), and the banknote with Serial Number 3 is recognized to be a rejected banknote as having had its fitness level determined abnormally (i.e., because it is an abnormal banknote).

Figure 28:
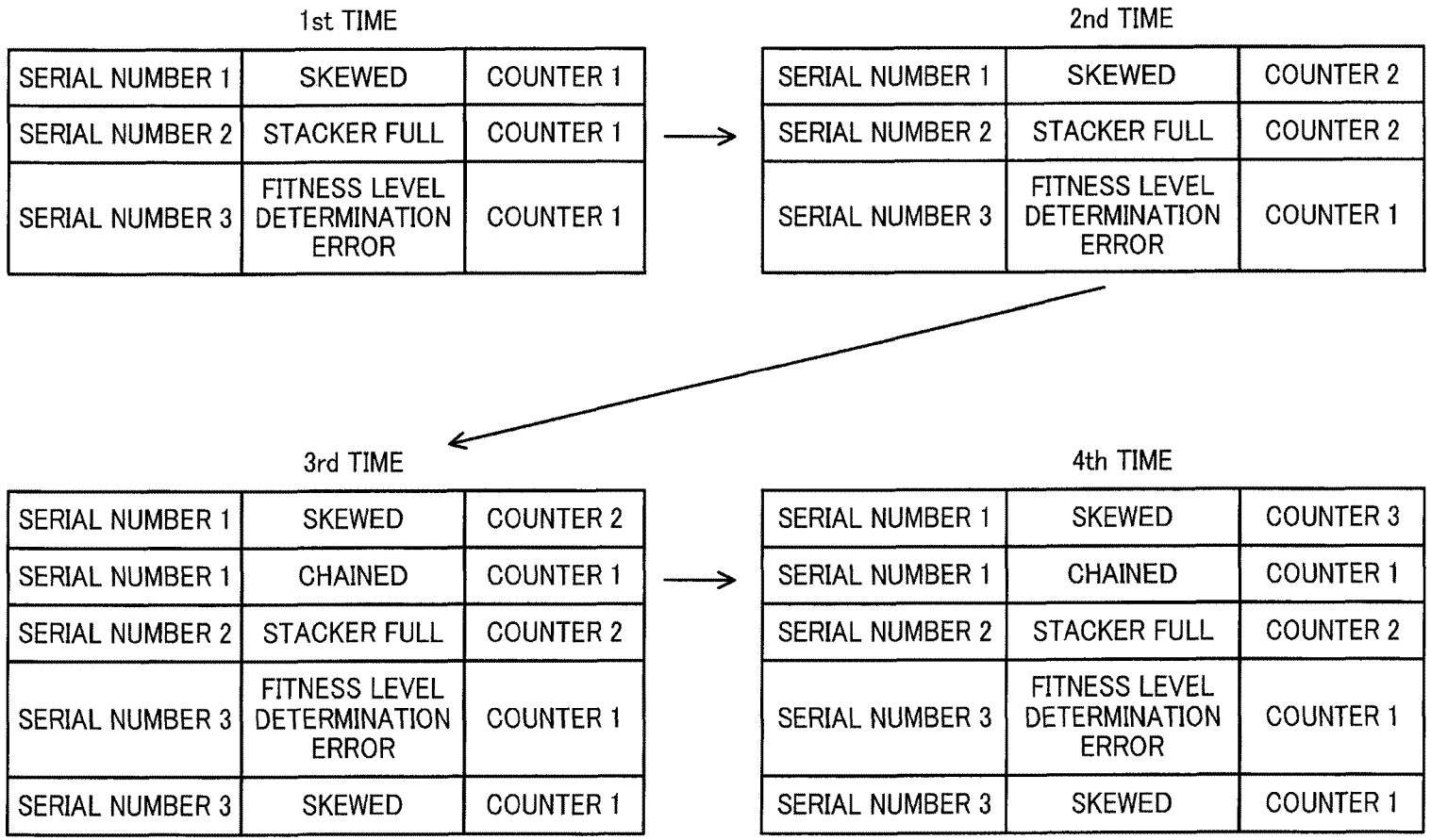
FIG. 28 illustrates how the data stored in a rejection manager that stores rejection factors changes.

The control unit 120 stores the respective serial numbers of these banknotes and their rejection factors in association with each other in a rejection manager of the database 1202 (i.e., a predetermined storage area of the database 1202). In the rejection manager, pieces of information about the banknotes with Serial Numbers 1, 2, and 3 are stored in the rejection manager in association with the rejection factors "skewing," "stacker full," and "fitness level determination error," respectively, as shown in FIG. 28. In addition, a counter is also provided for each of these rejection factors. When the banknotes are taken in completely for the first time, the count of each of these counters is one.

Next, when taken in for the second time, the banknote with Serial Number 1 is recognized to be a rejected banknote due to skewing, and the banknote with Serial Number 2 is recognized to be a rejected banknote due to stacker full as shown in FIG. 27. When these banknotes are taken in completely for the second time, the control unit 120 increments the skewing counter and the stacker full counter by +1 (i.e., their count increases to two) with respect to the banknote with Serial Number 1 and the banknote with Serial Number 2, respectively, in the rejection manager in the database 1202 as shown in FIG. 28.

Next, when taken in for the third time, the banknote with Serial Number 1 is recognized to be a rejected banknote due to chaining as shown in FIG. 27. That is to say, the banknote with Serial Number 1 is recognized again to be a rejected banknote due to a different rejection factor. On the other hand, the banknote with Serial Number 3 is recognized to be a rejected banknote due to skewing. That is to say, the banknote with Serial Number 3 is recognized again to be a rejected banknote due to a different rejection factor. When the banknotes are taken in completely for the third time, the control unit 120 stores information about the banknote with Serial Number 1 in association with the new rejection factor "chaining" in the rejection manager of the database 1202 and increments its counter to one, and also stores information about the banknote with Serial Number 3 in association with the new rejection factor "skewing" in the rejection manager of the database 1202 and increments its counter to one as shown in FIG. 28. As can be seen, even a banknote with the same serial number may have two or more different rejection factors. In that case, the rejection factors are counted separately and independently of each other.

Next, when taken in for the fourth time, the banknote with Serial Number 1 is recognized to be a rejected banknote due to skewing once again as shown in FIG. 27. When the banknotes are taken in completely for the fourth time, the control unit 120 increments the "skewing" rejection factor counter by +1 (i.e., its count increases to three) in the rejection manager of the database 1202 with respect to the banknote with Serial Number 1 as shown in FIG. 28.

The banknote handling apparatus 100 constantly checks each of the counters in the rejection manager. When the counter reaches a preset number of times, the banknote handling apparatus 100 may instruct the touch panel 17 to display the serial number and rejection factor of the rejected banknote. In the example shown in FIG. 28, if the preset number of times is three, an alert message indicating that the banknote with Serial Number 1 has been rejected over and over again due to skewing is displayed on the touch panel 17 and/or the teller terminal 1000. This tells the operator that the rejection factor is a transport error and therefore the banknote may be recognized to be a non-rejected banknote depending on its transportation state. In that case, the operator may take some appropriate countermeasure for preventing the banknote from being recognized as a rejected banknote (e.g., change the position of the banknote being inserted).

On the other hand, if an alert message indicating that the rejection factor is not a transport error but the fact that the banknote is a counterfeit note, for example, is displayed on the touch panel 17, then the operator senses that no matter how many times the banknote is taken in, the banknote is highly likely to be recognized as a rejected banknote. Thus, the operator may take a countermeasure of giving up inserting the banknote again.

If the operator senses that the rejection factor derives from the banknote itself and that the banknote is highly likely to be recognized as a rejected banknote no matter how many times the banknote is taken in, then such information about the banknote in question (i.e., the banknote is highly likely to be a rejected banknote) may be separately registered with the database 1202 (i.e., manually registered by the operator). If such a separately registered banknote is taken in again, its alert may be displayed on the touch panel 17 or any other user interface, even if the counter of the rejection manager is yet to reach the predetermined number of times. This allows the operator to avoid inserting the rejected banknote over and over again.

Optionally, the storage capacity of the rejection manager in the database 1202 may be set to be a predetermined capacity such that the amount of information stored there is limited. In that case, if the predetermined storage capacity is going to be exceeded, a new piece of information may be added as needed with an old piece of information deleted.

Note that the information stored in the rejection manager may be valid only during a single transaction and may be reset before another transaction is newly started. Alternatively, the information stored in the rejection manager may be retained even after a single transaction has been done such that the information is valid over multiple different transactions. Still alternatively, the operator may determine whether the information stored in the rejection manager should be valid only during a single transaction or over multiple different transactions.

Also, as described above, it is recommended that the information about the rejected banknote to be separately registered with the database 1202 be valid over multiple different transactions. However, that information may be registered at any time. For example, as for a banknote with a particular serial number, information about the banknote with the serial number may be registered with the database 1202 not just at a timing when an alert message indicating that the counter of a certain rejection factor reaches a predetermined number of times is displayed on the touch panel 17 or any other user interface. In addition, even after a transaction has been completed, the information may also be registered with the database 1202 afterward with reference to the data stored in the rejection manager.

<Function of Collecting Unfit Banknotes Early>

Depending on the environment under which the banknote handling apparatus 100 is used, the same banknote could be processed by the banknote handling apparatus 100 over and over again. Such a situation may arise when the same banknote is used repeatedly within a limited range. In that case, a single banknote goes through the banknote handling apparatus 100 a number of times, and therefore, tends to be damaged. Once a banknote is damaged, such a banknote could cause a banknote jam and other types of trouble even if the banknote is not recognized to be an unfit banknote by the recognition unit 3. This banknote handling apparatus 100 reads the serial number of a banknote that has been taken in during processing and stores that serial number, along with the counting result, in the database 1202 or the teller terminal 1000 as described above. Thus, the banknote handling apparatus 100 may detect, by reference to the serial numbers stored in the database 1202 or any other storage, that the same banknote goes through (i.e., is processed by) the banknote handling apparatus 100 over and over again. This banknote handling apparatus 100 is configured to compare the serial number of a given banknote that has been read to the serial numbers stored in the database 1202 or any other storage with respect to the banknotes that have been processed so far, and to increase its count, i.e., the number of times the banknote has been processed, on detecting any pair of duplicated serial numbers. This tells the operator how many times the same banknote has been processed by the banknote handling apparatus 100.

Alternatively, the upper limit may be set in advance to the number of times of processing. In that case, on detecting that a single banknote has been processed equal to or more than a predetermined number of times, the banknote handling apparatus 100 may stack the banknote as either substantially an unfit banknote or a rejected banknote, even if the banknote has been recognized to be a fit banknote by the recognition unit 3. In that case, a message alerting the operator to the fact may be displayed on the touch panel 17 or any other user interface. Also, the upper limit to the number of times of processing may be set in advance as the maximum number of times that the same banknote may be processed within a predetermined period.

If the state of a banknote is checked before the banknote turns into an unfit banknote such that banknotes that are going to turn into unfit banknotes are identified, the banknote handling apparatus 100 is allowed to avoid causing various types of trouble (such as a banknote jam).

Note that the present disclosure is not intended to be applied to only banknote handling apparatuses but is broadly applicable to paper sheet processing devices configured to process checks, gift certificates, and various other kinds of paper sheets as well.

Other Embodiments

Embodiments have just been described as examples of the technique disclosed in the present application. However, the present disclosure is not limited to those exemplary embodiments, but is also applicable to other embodiments which are altered or substituted, to which other features are added, or from which some features are omitted, as needed. Optionally, the components described in those embodiments may be combined to create a new embodiment. The components illustrated on the accompanying drawings and described in the detailed description include not only essential components that need to be used to overcome the problem, but also other unessential components that do not have to be used to overcome the problem but that are illustrated or mentioned there just for the sake of showing a typical example of the technique. Therefore, such unessential components should not be taken for essential ones, simply because such unessential components are illustrated in the drawings or mentioned in the detailed description.

The above-described embodiments may be modified in the following manner.

In the embodiments described above, the banknote handling apparatus 100 has been described as an example of the paper sheet processing device. However, the paper sheet processing device is not limited to the banknote handling apparatus 100. For example, recognition, sorting, and stacking of the paper sheets may be performed by a different apparatus, and the paper sheet processing device may only perform the processing of transporting loose paper sheets, stacking the paper sheets in the stacking unit, and then transporting the paper sheets stacked in the stacking unit to a different place using the transport unit. Further, in the foregoing description, banknotes are intended to be used as exemplary paper sheets. However, the paper sheets do not have to be banknotes, and may be vouchers such as gift certificates.

The configuration of the banknote handling apparatus 100 described above is merely an example, and the present disclosure is not limited thereto. For example, the banknote handling apparatus 100 described above is provided with two bundling stackers 4, two non-bundling stackers 5, and a single reject stacker 6. However, the numbers of these stackers are just an example and not limiting. For example, one bundling stacker 4 or three or more bundling stackers 4 may be provided. One non-bundling stacker 5 or three or more non-bundling stackers 5 may be provided. Two or more reject stackers 6 may be provided. Alternatively, the non-bundling stackers 5 and the reject stacker 6 may even be omitted.

In the foregoing description, the duplication check is intended to be carried out during deposit processing. However, the duplication check is not carried out only during deposit processing but may also be carried out during withdrawal processing as well.

Also, the banknote handling apparatus 100 performs the duplication check in confirming a transaction. However, this is only a non-limiting exemplary embodiment. For example, when banknotes are taken in and have their serial numbers read by the recognition unit 3, the banknote handling apparatus 100 may compare the serial numbers read to the serial numbers stored in the database 1202 with respect to the banknotes that have been processed so far in order to search for any duplicated serial numbers. This thus allows the banknote handling apparatus 100 to detect the duplicate processes as soon as possible. If the duplicate processes are detected in an early stage, the trouble to deal with the duplicate processes may be reduced. Nevertheless, if the duplication check is performed at a time when a series of processing on the banknotes is done (e.g., when the transaction is going to be confirmed) as described above, the load on the control unit 120 may be lightened. Consequently, the overall processing time, including the time for making the duplication check, may be shortened after all.

Furthermore, the duplication check does not have to be performed as the operation of confirming a transaction but may be performed as any other type of operation as well. For example, after all of the banknotes have been taken in and before the operation of confirming the transaction is performed, the operator may be prompted to perform an operation to make a duplication check. Alternatively, on detecting that all banknotes have been taken in, the control unit 120 may automatically start performing the duplication check.

Furthermore, in the embodiments described above, the duplication check is intended to be made every time a transaction is completed. However, this is only a non-limiting exemplary embodiment. Alternatively, the banknote handling apparatus 100 may make the duplication check every time a predetermined amount of time passes, e.g., at a predetermined point in time every day. Also, if the transaction information is not transferred from the banknote handling apparatus 100 to the teller terminal 1000 every time a single transaction is completed but if transaction information covering multiple transactions is transferred at a time to the teller terminal 1000, then the banknote handling apparatus 100 may make the duplication check within the transaction information to be transferred when transferring the transaction information to the teller terminal 1000.

Furthermore, in the foregoing description, when the duplicate processes are detected, it is the operator who decides what to do with the duplicate processes. However, the control unit 120 may determine the countermeasure automatically. For example, on detecting the duplicate processes, the control unit 120 may have only one of the processes performed on the duplicated serial numbers left and cancel the others. That is to say, when duplicate processes are detected, the control unit 120 may deal with the duplicate processes automatically. For example, only the newest one of the duplicated serial numbers may be left with the others deleted, and the processing that should have been performed on the deleted serial numbers may also be canceled. In this manner, the duplicate processes may be corrected such that only one of the duplicate processes is left. In that case, the control unit 120 may notify the user, via the touch panel 17, that the duplicate processes have been detected. That is to say, the duplicate processes are automatically corrected and the operator is just notified of that.

Furthermore, the display unit to notify the user that the duplicate processes have been detected does not have to be the touch panel 17. Alternatively, the display unit may also be a liquid crystal display with no touch panel function. Also, means for notifying the user may also be an indicator such as a lamp or may even be an alarm or a voice message as well.

As described above, even if the processing unit deals with the duplicate processes automatically, the user is still notified that the duplicate processes have been detected. The user does not have to take any particular action against the duplicate processes, but is notified that there are duplicate processes.

The second embodiment described above may be summarized as follows:

(1)

A paper sheet processing device comprising:

a housing with an inlet through which paper sheets are taken in one by one;

a recognition unit configured to read serial numbers of the paper sheets;

a memory configured to store the serial numbers read by the recognition unit;

a processing unit configured to make the recognition unit sequentially read the serial numbers of the paper sheets taken in through the inlet and to perform a predetermined type of processing on the paper sheets;

a sensing unit configured to detect such an error that causes the processing unit to abort its processing; and a recovery unit configured to compare the serial number of the paper sheet removed by a user from the housing after the sensing unit has detected the error and aborted its processing to the serial numbers stored in the memory and determine exactly when the removed paper sheet was subjected to its associated processing.

(2)

A paper sheet processing device comprising:

a housing with an inlet through which paper sheets are taken in one by one;

a recognition unit configured to read serial numbers of the paper sheets;

a memory configured to store the serial numbers read by the recognition unit;

a stacking and bundling unit configured to stack and bundle a predetermined number of paper sheets;

a processing unit configured to instruct the recognition unit to sequentially read the serial numbers of the paper sheets taken in through the inlet and then instruct the stacking and bundling unit to perform bundling processing of forming bundles of the paper sheets;

a sensing unit configured to detect such an error that causes the processing unit to abort its bundling processing; and a recovery unit configured to compare the serial number of the paper sheet removed by a user from the housing after the sensing unit has detected the error and aborted the bundling processing to the serial numbers stored in the memory and identify a bundle associated with the paper sheet removed.

(3)

The paper sheet processing device of (2), wherein the recovery unit is configured to obtain the serial number of the removed paper sheet by having the serial number read by the recognition unit.

(4)

The paper sheet processing device of (3), wherein the recovery unit is configured to prompt the user to insert the removed paper sheet through the inlet into the housing and to instruct the recognition unit to stop reading the serial numbers in response to the user's cancel operation.

(5)

The paper sheet processing device of (3) or (4), wherein the recovery unit is configured to obtain the serial number of the removed paper sheet by having the user enter the serial number manually.

(6)

The paper sheet processing device of (5), wherein the recovery unit is configured to require the user to manually enter the serial numbers of paper sheets, of which the serial numbers have not been successfully read by the recognition unit, and to accept an operation of canceling manually entering the serial numbers of some or all of the paper sheets in question.

(7)

The paper sheet processing device of any one of (2)-(6), wherein the recovery unit is configured to compare the obtained serial numbers to the serial numbers stored in the memory by making fuzzy matching following a predetermined rule, and if a plurality of serial numbers have been extracted as a result of the fuzzy matching, to present the plurality of serial numbers to the user so that the user is allowed to pick any one of the serial numbers presented.

(8)

The paper sheet processing device of any one of (2)-(7), wherein each of the bundles formed by the stacking and bundling unit is provided with an identification code allowing the user to identify the bundle.

(9)

The paper sheet processing device of any one of (2)-(8), wherein the memory stores the serial number of each paper sheet and information about a bundle including the paper sheet in association with each other, and the recovery unit is configured to identify a bundle that should include the serial number of the paper sheet removed.

(10)

The paper sheet processing device of (9), wherein the processing unit is configured to perform the processing of counting the paper sheets taken in through the inlet while the bundling processing is being performed, and the recovery unit is configured to present the result of counting that has been determined with respect to the bundle identified with a one that should include the removed paper sheet to the user such that the user is allowed to decide either changing the determined result of counting into an undetermined one or keeping the determined result of counting unchanged.

(11)

The paper sheet processing device of (9) or (10), wherein if after a bundle that should include the serial number of the paper sheet removed has been identified, a bundle comprised of that bundle and the removed paper sheet needs to be formed again, the recovery unit is configured to compare the serial numbers of the paper sheets that have been newly read by the recognition unit to the serial numbers stored in the memory for the paper sheets that are now included in that bundle.

(12)

The paper sheet processing device of any one of (2)-(11), wherein the sensing unit is configured to detect that a paper sheet has fallen from a transport path provided inside the housing.

(13)

The paper sheet processing device of (9), wherein the recovery unit is configured to present an option of canceling a transaction which was performed when the sensing unit output the detection signal and an option of continuing the transaction to the user such that the user is allowed to pick one of these two options.

(14)

The paper sheet processing device of (12) or (13), wherein the recovery unit is configured to determine whether or not the serial number of the removed paper sheet is included in a bundle that was being formed when the sensing unit output the detection signal, and to identify the paper sheet fallen in the housing with a one that should be included in that bundle if the answer is YES, or to compare the serial number based on the data stored about a bundle that had been formed before the detection signal was output if the answer is NO.

(15)

The paper sheet processing device of (14), wherein the recovery unit is configured to retrograde to the data stored about a bundle that was formed on the day of detection of the error.

(16)

The paper sheet processing device of (14), wherein the recovery unit is configured to retrograde to the data stored about a bundle that was formed on or after a predetermined day preceding the day of detection of the error.

(17)

The paper sheet processing device of any one of (14)-(16), wherein the memory includes a database provided outside of the housing and the recovery unit is configured to be able to refer to the data stored in the database.

INDUSTRIAL APPLICABILITY

As can be seen from the foregoing description, the present disclosure is useful for a paper sheet processing device.

DESCRIPTION OF REFERENCE CHARACTERS

100 Banknote Handling Apparatus (Paper Sheet Processing Device)

2 Hopper Unit (Intake Unit)

3 Recognition Unit

120 Control Unit (Processing Unit)
1202 Database (Memory)
17 Touch Panel (Display Unit)

The invention claimed is:

1. A paper sheet processing device comprising:
an intake unit configured to take in paper sheets;
a recognition unit configured to read serial numbers of the paper sheets taken in through the intake unit;
a memory configured to store the serial numbers read by the recognition unit;
a processing unit configured to process the paper sheets, and
a display unit configured to display information thereon, wherein
the processing unit searches the serial numbers stored in the memory for any duplicated serial number, and detects, when finding any duplicated serial number in the memory, that duplicate processes have been performed on a paper sheet identified by the duplicated serial number, and
when the processing unit detects any duplicate processes, the processing unit notifies a user of the duplicate processes detected by displaying the duplicated serial number on the display unit.

2. The paper sheet processing device of claim 1, wherein
when the processing unit detects any duplicate processes, the processing unit allows one of the duplicate processes performed on the duplicated serial number and cancels the other of the duplicate processes.

3. The paper sheet processing device of claim 2, wherein
when the processing unit detects any duplicate processes, the processing unit notifies a user, via the display unit, of the duplicate processes detected.

4. The paper sheet processing device of claim 1, wherein
the processing unit searches for any duplicated serial number when a predetermined operation has been performed.

5. The paper sheet processing device of claim 4, wherein
the predetermined operation is allowing the process performed by the processing unit.

6. The paper sheet processing device of claim 1, wherein
the process performed by the processing unit is counting the number of paper sheets.

7. A paper sheet processing device comprising:
an intake unit configured to take in paper sheets;
a recognition unit configured to read serial numbers of the paper sheets taken in through the intake unit;
a memory configured to store the serial numbers read by the recognition unit; and
a processing unit configured to process the paper sheets, wherein
the processing unit searches the serial numbers stored in the memory for any duplicated serial number, and detects, when finding any duplicated serial number in the memory, that duplicate processes have been performed on a paper sheet identified by the duplicated serial number, and
when the processing unit detects any duplicate processes, the processing unit notifies a user of the duplicate processes detected, and
the processing unit prompts the user to choose an option to be exercised with respect to the duplicate processes.

8. The paper sheet processing device of claim 7, wherein
the option to be exercised with respect to the duplicate processes is either to allow one of the duplicate processes performed on the duplicated serial number and cancel the other of the duplicate processes or to allow all of the duplicate processes.

9. A paper sheet processing device comprising:
an intake unit configured to take in paper sheets;
a recognition unit configured to read serial numbers of the paper sheets taken in through the intake unit;
a memory configured to store the serial numbers read by the recognition unit;
a processing unit configured to process the paper sheets, and
a display unit configured to display information thereon, wherein
the processing unit compares the serial numbers of the paper sheets read by the recognition unit to the serial numbers stored in the memory, and detects, when finding any duplicated serial number in the memory, that duplicate processes have been performed on a paper sheet identified by the duplicated serial number, and
when the processing unit detects any duplicate processes, the processing unit notifies a user of the duplicate processes detected by displaying the duplicated serial number on the display unit.

10. The paper sheet processing device of claim 9, wherein
the processing unit prompts the user to choose an option to be exercised with respect to the duplicate processes.

11. The paper sheet processing device of claim 10, wherein
the option to be exercised with respect to the duplicate processes is either to allow one of the duplicate processes performed on the duplicated serial number and cancel the other of the duplicate processes or to allow all of the duplicate processes.

12. The paper sheet processing device of claim 9, wherein
when the processing unit detects any duplicate processes, the processing unit allows one of the duplicate processes performed on the duplicated serial number and cancels the other of the duplicate processes.

13. The paper sheet processing device of claim 12, wherein
when the processing unit detects any duplicate processes, the processing unit notifies a user, via the display unit, of the duplicate processes detected.

14. The paper sheet processing device of claim 9, wherein
the processing unit searches for any duplicated serial number when a predetermined operation has been performed.

15. The paper sheet processing device of claim 14, wherein
the predetermined operation is allowing the process performed by the processing unit.

16. The paper sheet processing device of claim 9, wherein
the process performed by the processing unit is counting the number of paper sheets.

* * * * *